US005753424A

United States Patent [19]

Ishikawa

[11] Patent Number: 5,753,424

[45] Date of Patent: May 19, 1998

[54] PROCESS FOR TREATING SILVER HALIDE COLOR PHOTOSENSITIVE MATERIAL

[75] Inventor: Takatoshi Ishikawa, Kanagawa, Japan

[73] Assignee: Fuji Photo Film Co., Ltd., Kanagawa, Japan

[21] Appl. No.: 864,342

[22] Filed: May 28, 1997

Related U.S. Application Data

[63] Continuation of Ser. No. 533,743, Sep. 26, 1995, abandoned.

[30] Foreign Application Priority Data

Sep. 26, 1994 [JP] Japan ..... 6-254119

[51] Int. Cl.[6] ..... G03C 7/44

[52] U.S. Cl. ..... 430/463; 430/372; 430/398; 430/428; 430/429

[58] Field of Search ..... 430/372, 398, 430/428, 429, 463

[56] References Cited

U.S. PATENT DOCUMENTS

| | | | |
|---|---|---|---|
| 5,009,983 | 4/1991 | Abe | 430/463 |
| 5,108,879 | 4/1992 | Abe et al. | 430/429 |
| 5,229,259 | 7/1993 | Yokota | 430/140 |
| 5,238,794 | 8/1993 | Hirose et al. | 430/140 |
| 5,254,446 | 10/1993 | Ikenoue et al. | 430/140 |
| 5,336,589 | 8/1994 | Mukunoki et al. | 430/140 |
| 5,348,845 | 9/1994 | Morigaki et al. | 430/463 |
| 5,372,925 | 12/1994 | Kobayashi et al. | 430/533 |
| 5,382,494 | 1/1995 | Kudo et al. | 430/140 |
| 5,441,852 | 8/1995 | Hagiwara et al. | 430/372 |
| 5,460,923 | 10/1995 | Goto et al. | 430/455 |
| 5,474,883 | 12/1995 | Mihayashi et al. | 430/533 |
| 5,543,272 | 8/1996 | Kojima et al. | 430/455 |
| 5,547,817 | 8/1996 | Okada et al. | 430/430 |

FOREIGN PATENT DOCUMENTS

| | | |
|---|---|---|
| 4-68336 | 3/1992 | Japan . |
| 4-73737 | 3/1992 | Japan . |
| 5-88283 | 4/1993 | Japan . |

*Primary Examiner*—Hoa Van Le

*Attorney, Agent, or Firm*—Sughrue, Mion, Zinn, Macpeak, & Seas, PLLC

[57] ABSTRACT

In a process for processing a silver halide color photosensitive material having a transparent substrate each possessing at least one red-sensitive layer, at least one green-sensitive layer, and at least one blue-sensitive layer and containing ferromagnetic fine powder, when a salt content in the final bath is not more than 7000 ppm in the processing stages of water washing and/or stabilization after the color development and desilvering, the deterioration in an S/N ratio of a magnetically recorded information can be drastically improved.

10 Claims, No Drawings

PROCESS FOR TREATING SILVER HALIDE COLOR PHOTOSENSITIVE MATERIAL

This is a continuation of application Ser. No. 08/533,743 filed Sep. 26, 1995, now abandoned.

FILED OF THE INVENTION

This invention relates to a process for processing a silver halide color photosensitive material (hereinafter abbreviated as "photosensitive material") having a magnetic layer. Particularly, it relates to a process for processing a sensitive material excellent in reading performance of magnetic information.

DESCRIPTION OF THE PRIOR ART

Conventionally, it has been hardly possible to input or output information in the course of taking a photograph or printing it, and it is only possible to optically input or output a time and date of photography. As described in JP-A4-68336 (the term "JP-A" used herein means a Japanese unexamined patent publication), JP-A-4-73737, and JP-A-5-88283, a transparent magnetically recording layer is applied on the whole surface of the sensitive material, whereby conditions of photography, such as time and date of photograph, and magnification, can be input. Furthermore, various kinds of information can be input in the course where they are input into a movie devices such as television set and video and, thus, such a technique is promising in the near future.

In a process for treating such a sensitive material, color developing, removal of silver, water washing and stabilization are applied as a rule. Recently, in the stages of water washing and stabilization, a treating process in which an amount replenished is decreased is introduced in many cases. In particular, since no piping for water washing is required in the case of the treatment in a shop such as a small-scale laboratory, such a process is popularized as a so-called treatment without piping. In the case of such a treatment using a small replenishing, amount the salt content in the washed water and stabilized water is, of course, increased. Moreover, there are large amounts of additives for improving uneven treatment and image storage ability, a sanitizer, a preservative, etc. in the final bath and, thus, it has a tendency to increase the salt content in the final bath. It has been proven that in the case where a silver halide having a magnetic layer as described in the present invention is treated in a final bath having a high salt content, its magnetic performance is deteriorated (deterioration of S/N ratio) and, thus, no satisfactory image can be provided.

We have analyzed the factors of the deterioration of the magnetic performance and found that organic and inorganic components adhered to the sensitive material in the final bath are adhered to the magnetically reading head, and an S/N ratio is deteriorated as a result.

An object of the present invention is, therefore, to provide a process for processing a silver halide photosensitive material having a transparent magnetically recording layer without deterioration of the magnetically recorded information, S/N ratio, and further to provide a processing of water washing and a stabilization treatment excellent in image storage performance and photographic performance.

SUMMARY OF THE INVENTION

It has been found the object can be achieved by carrying out the following treating processes:

(1) A process for processing a silver halide color photosensitive material having transparent substrate possessing at least one red-sensitive layer, at least one green-sensitive layer, and at least one blue-sensitive layer and a magnetic layer containing ferromagnetic fine powder comprising color developing, desilvering and water washing and/or stabilization, wherein a total salt content in the final bath is not more than 7000 ppm.

(2) A process according to Item (1), wherein the total treating period of water washing and/or stabilization stages is from 15 to 45 seconds.

(3) A process according to Item (1), wherein the final bath of water washing and/or stabilization stages is treated through a reverse osmosis device or with an ion-exchange resin.

DISCLOSURE OF THE INVENTION

The present invention will now be described.

The magnetically recording layer to be used in the present invention will be described. The magnetically recording layer may resides adjacent to the substrate or exist via any other constructing layer. It may also resides at the side having the emulsion layer or the side opposite to the side having the emulsion layer. Magnetic particles are used as a recording medium in the magnetically recording layer. The magnetic particles which can be used in the present invention are ferromagnetic iron oxides ($FeO_x$: $4/3 \leqq x \leqq 3/2$) such as $\gamma$-$Fe_2O_3$, Co-covered ferromagnetic iron oxides ($FeO_x$: $4/3 \leqq x \leqq 3/2$) such-as Co-covered $\gamma$-$Fe_2O_3$, Co-covered magnetite, other Co-containing ferromagnetic iron oxides, ferromagnetic chromium dioxide, ferromagnetic metals, ferromagnetic alloys, as well as other ferrites such as hexagonal system Ba ferrite, Sr ferrite, Pb ferrite, Ca ferrites, and solid solutions and ion-exchanged substances thereof. Of them, Co-covered ferromagnetic iron oxide having an $Fe^{2+}/Fe^{+3}$ ratio of from 0 to 10% is preferred in terms of transmission density.

Processes for producing these ferromagnetic powders have been known, and those which can be used in the present invention can also be used according to any of the known processes.

The shape and size of the ferromagnetic substance will now be described. The shape may be needle, rice, globular, cubic, or plate form, but needle form is preferred in terms of electromagnetic conversion character. As for the particle, in the case of a needle form, the long axis is preferably in the range of from 0.01 to 0.8 μm, preferably from 0.05 to 0.3 μm, and the long axis/short axis ratio is preferably in the range of from 2 to 100, more preferably from 4 to 15. The specific surface area expressed as $S_{BET}$ is preferably not less than 20 $m^2/g$, more preferably not less than 30 $m^2/g$.

The saturation magnetization ($\delta s$) is preferably as large as possible, and is preferably not less than 50 emu/g, more preferably not less than 70 emu/g, and practically not more than 100 emu/g. The angular ratio ($\delta r/\delta s$) of the ferromagnetic body is not less than 40%, preferably not less than 45%. If the coercive force (Hc) is too small, information tends to easily be erased. Conversely, if it is too large, image cannot be recorded depending on the system. Consequently, the coercive force should be within an appropriate value, i.e. from 200 Oe to 3000 Oe, preferably from 500 Oe to 2000 Oe, and more preferably from 650 Oe to 950 Oe.

These ferromagnetic particles may be surface-treated with silica and/or alumina as described in JP-A-59-23505 and JP-A-4-096052. They may also be surface-treated with an inorganic and/or organic material as described in JP-A-4-

195726, JP-A-4-192116, JP-A-4-25991, and JP-A-5-081652. In addition, these ferromagnetic particles may be surface-treated with a silane coupling agent or a titanium coupling agent. As a coupling agent, the known coupling agents, such as those described in JP-B-1-261469 (the term "JP-B" used herein means a Japanese examined patent publication), may be used as the coupling agents, but the following compounds may also be used:

Compound [1]-1 Vinyltrichlorosilane

[1]-2 Vinyltriethoxysilane

[1]-3 γ-Methacryloxypropyltrimethoxysilane

[1]-4 γ-Glycidoxypropyltrimethoxysilane

[1]-5 N-β-(Aminoethyl)-γ-aminopropylmethyl dimethoxysilane

[1]-6 N-phenyl-γ-aminopropyl trimethoxysilane

[1]-7 Vinyloctylmethoxysilane

[1]-8 10-(Vinyloxycarbonyl)nonyl trimethoxysilane

[1]-9 p-Vinylphenyl triisopropylsilane

[1]-10 3-(Glicidyloxy)propyl triethoxysilane

[1]-11 3-(Acryloyl)propyl trimethoxysilane

[1]-12 11-(Methacryloyl)undecyl trimethoxysilane

[1]-13 3-Aminopropyl trimethoxysilane

[1]-14 3-Phenylaminopropyl trimethoxysilane

[1]-15 3-N,N-dibutylaminopropyl trimethoxysilane

[1]-16 3-Ttimethylammoniopropyl trimethoxysilane iodide

[1]-18 3-Isocyanylpropyl methyldimethoxysilane

[1]-19 3-(Poly (polymerization degree 10) oxyethynyl) oxypropyl trimethoxysilane

[1]-20 3-Methoxy(poly (polymerization degree 6) oxyethynyl)oxypropyl trimethoxysilane

[1]-21 Decyltrimethoxysilane

Compound [2]-1 Isopropyl-triisostearoyl titanate

[2]-2 Isopropyl-tridecylbenzenesulfonyl titanate

[2]-3 Isopropyltris(dioctylpyrophosphate) titanate

[2]-4 Tetraisopropylbis(dioctylphosphite) titanate

[2]-5 Tetraoctylbis(ditridecylphosphite) titanate

[2]-6 Tetra(2,2'-diallyloxymethyl-1-butyl)bis-(ditridecyl)phosphite titanate

[2]-7 Bis(dioctylpyrophosphate)oxyacetate titanate

[2]-8 Bis(dioctylpyrophosphate)ethylene titanate

[2]-9 Isopropyltrioctanoyl titanate

[2]-10 Isopropyldimethacrylisostearoyl titanate

[2] -11 Isopropylisostearoyldiacryl titanate

[2]-12 Isopropyltri(dioctylphosphate) titanate

[2]-13 Isopropyltricumylphenyl titanate

[2]-14 Isopropyltri(N-amidoethyl-aminoethyl) titanate

[2]-15 Dicumylphenyloxyacetate titanate

[2]-16 Diisostearoylethylene titanate.

The amount of the silane coupling agent and titanium coupling agent is preferably 1.0 to 200% by weight based on the magnetic particles (powder). If it is less than 1.0% by weight, liquid stability becomes poor. Too excessive amount makes liquid stability poor. It is preferably from 1 to 75% by weight, and more preferably from 2 to 50% by weight.

The silane coupling agent and/or titanium coupling agent is used to treat the magnetic particles according to the present invention by a generally known method, thereby modifying the surfaces of the magnetic particles to impart stability of coating solution of the magnetic particles. That is, the coupling agent is treated by a process of direct treatment with the magnetic particles or an integral blending process. The direct process is largely classified into a dry process, a slurry process, and a spray process. The magnetic particles obtained in a direct process are added to the binder to ensure the modification or the surface of the magnetic particles with the coupling agent. Among them, the drying process is carried out by uniformly dispersing the magnetic particles into an alcohol solution, an organic solvent solution or an aqueous solution of silane coupling agentwater, and then drying the dispersion. Preference is given to the use of a stirrer such as Henschel mixer, super mixer, Ready mixer, V type blender, or open kneader. Of the stirrers, an open kneader is particularly preferable. It is preferably that the magnetic particles, the coupling agent and a small amount of water or an organic solvent containing water are mixed and stirred in an open kneader, and then the mixture is further finely dispersed after water is removed.

With regard to the slurry process, the coupling agent is added to a slurry in which the magnetic particles are slurried . This is advantageous in that the coupling agent is able to be added during the production. The spray process is a process in which the coupling agent is added to the magnetic particles in the stage of drying the magnetic particles, and has an advantage that coupling agent can be added during production, but is disadvantageous in view of uniformity in treatment.

The integral process is a process in which the coupling agent is added to the magnetic particles and the binder, which requires well kneading, but is very easy in handling.

The binder which can be preferably used in the present invention is described.

The binders which can be used in the present invention are thermoplastic resins, thermosetting resins, radically curing resins, reactive resins, acid-, alkali-, or bio-degradable polymers, natural polymers (such as cellulose derivatives and saccharide derivatives) which have conventionally been utilized as binders for magnetically recording media, and mixtures thereof.

The resin which is preferably used possesses a Tg value in the range of from −40° to 300° C., and an average molecular weight of from 2,000 to 1,000,000, more preferably from 5,000 to 300,000.

Examples of the thermoplastic resins include vinyl copolymers such as vinyl chloride-vinyl acetate copolymers, copolymers of vinyl chloride, vinyl acetate, vinyl alcohol, maleic acid and/or acrylic acid, vinyl chloride-vinylidene chloride copolymers, vinyl chloride-acrylonitrile copolymers, ethylene-vinyl acetate copolymers; cellulose derivatives such as nitrocellulose, cellulose diacetate, cellulose triacetate, cellulose acetate propionate, cellulose acetate butyrate, cellulose tripropionate, and cellulose decanoate resins; acrylic resins; polyvinylacetal resins; polyvinylbutyral resins; polyester polyurethane resins; polyether polyurethane resins; polycarbonate polyurethane resins; polyester resins; polyether resins; polyamide resins; amino resins; and rubber resing such as styrene-butadiene resins and butadiene-acrylonitrile reins; silicone resins, fluorine resins, etc.

The thermosetting resins or the reactive resins include those in which their molecular weight is markedly increased by heating, such as phenol resins, phenoxy resins, epoxy resins, curing polyurethane resins, urea resins, melamine resins, alkyd resins, silicon resins, acrylic reactive resins, epoxy-polyamide resins, nitrocellulose-melamine resins, mixtures of high molecular weight polyester resins with isocyanate prepolymers, urea-formaldehyde resins, low molecular weight glycol/high molecular weight diol/polyisocyanate mixtures, polyamine resins and mixtures thereof.

The radically curing resins which can be used are those which have a carbon-carbon unsaturated bond as a radically curing functional group. Preferred functional groups include acryloyl group and methacryloyl group.

Of the binders, cellulose diacetate is preferable.

It is preferable to incorporate a polar group (epoxy group, $CO_2M$, OH, $NR_2$, $NR_3X$, $SO_3M$, $OSO_3M$, $PO_3M_2$, $OPO_3M_2$, wherein M represents hydrogen, an alkali metal or ammonium and when two or more of M present in one group, M may be different from each other, R is hydrogen or an alkyl group and X represents an anion) in the binder listed above in terms of dispersibility of the magnetic particle and durability. The content of the polar group is from $10^{-7}$ to $10^{-3}$ equivalent, more preferably $10^{-6}$ to $10^{-4}$ equivalent, per g of polymer.

The binders listed above are used singly or as a mixture of two or more of them, and can be cured by adding a known crosslinking agent such as an epoxy, aziridine, or isocyanate type crosslinking agent and/or a radically curing vinyl monomer.

Examples of isocyanate type crosslinking agents are polyisocyanate compound having two or more isocyanate groups such as tolylene diisocyanate, 4,4'-diphenylmethane diisocyanae, hexamethylene diisocyanate, xylylene diisocyanate, naphthylene-1,5-diisocyanate, o-toluidine diisocyanate, isophorone diisocyanate, and triphenylmethane diisocyanate, reaction products of these isocyanates with polyalcohols (e.g., a reaction product of 3 mol of tolylene diisocyanate with 1 mol of trimethylol propane), and polyisocyanates produced by the condensation of these isocyanates.

The radically curing vinyl monomers are compounds which are polymerizable with the radiation irradiation and which have at least one carbon-carbon unsaturated bond such as (meth)acrylates, (meth)acrylamide, allyl compounds, vinyl esters, vinyl ethers, vinyl heterogenous compounds, N-vinyl compounds, styrene, (meth)acrylic acid, crotonic acid, itaconic acid, and olefins. Of them, preferable are ones having at least two (meth)acryloyl groups such as polyethylene glycol (meth)acrylates, e.g., diethylene glycol di(meth)acrylate and triethylene glycol di(meth)acrylate; trimethylol propane tri(meth)acrylate; pentaerythritol tetra(meth)acrylate; dipentaerythritol penta (meth)acrylate; dipentaerythritol hexa(meth)acrylate; reaction products of polyisocyanates and hydroxy(meth)acrylate compounds.

These crosslinking agents are preferably used in an amount of 5 to 45 wt % based on the total amount of the binder containing the crosslinking agent.

A hydrophilic binder may also be used in the magnetically recording layer of the present invention.

The hydrophilic binders which can be used are described in Research Disclosure No. 17643 p. 26 and No. 18716, p. 651, and water-soluble polymers, cellulose esters, latex polymers, water-soluble polyesters etc. are exemplified. The water-soluble polymers include gelatine, gelatine derivatives, casein, agar, sodium alginate, starch, polyvinyl alcohol, polyacrylic acid copolymers, maleic anhydride copolymers and the like; and the cellulose esters include carboxymethyl cellulose, hydroxyethyl cellulose, and the like. The latex polymers include vinyl chloride-containing copolymers, vinylidene chloride-containing copolymers, vinylacetate-containing copolmers, acrylate-containing copolymers, butadiene-containing copolymers, and the like. Gelatine is proven to be most preferable among them.

Gelatine may be a so-called alkali-treated (lime-treated) gelatine which is impregnated in an alkali bath before the extraction of gelatine, an acid-treated gelatine which is impregnated in an acid bath, a double impregnated gelatine which is impregnated in both bathes, or enzyme-treated gelatine. If necessary, colloidal albumin, casein, cellulose derivatives such as carboxymethyl cellulose and hydroxyethyl cellulose, agar, sodium alginate, starch derivatives, saccharide derivatives such as dextran, synthetic hydrophilic colloids such as polyvinyl alcohol, poly-N-vinylpyrolidone, polyacrylic acid copolymers, and polyacrylamide or their derivative, partially hydrolyzed products, gelatine derivatives, etc. may be partially used together with gelatine.

The magnetically recording material containing gelatine is preferably hardened. Examples of the hardeners which can used in the magnetically recording layer include aldehyde compounds such as formaldehyde and glutaraldehyde, ketone compounds such as diacetyl and cylopentanedione, bis(2-chloroethylurea), 2-hydroxy-4,6-dichloro-1,3,5-triazine, compounds having a reactive halogen as described in U.S. Pat. Nos. 3,288,775 and 2,732,303, and U.K. patent Nos. 974,723 and 1,167,207, etc., divinylsulfone, 5-acetyl-1,3-diacryloylhexahydro-1, 3, 5-triazine, compounds having a reactive olefin as described in U.S. Pat. Nos. 3,635,718 and 3,232763, UK patent No. 994,869, etc., N-hydroxymethylphthalimide, N-methylol compounds as described in U.S. Pat. Nos. 2,732,316 and 2,586,168, etc., isocyanates as described in U.S. Pat. No. 3,103,437, etc., aziridine compounds as described in U.S. Pat. Nos. 3,017,280 and 2,983,611, etc., acid derivatives as described in U.S. Pat. Nos. 2,725,294 and 2,725,295, etc., epoxy compounds as described in U.S. Pat. No. 3,091,537, etc., and halogen carboxyaldehydes such as mucochloric acid. Alternatively, as hardeners of inorganic compounds, chromium alum, zirconium sulfate, carboxyl group activating type hardeners as described in JP-B-56-12853, JP-B-58-32699, Belgian patent No. 825,726, JP-A-60-225148, JP-A-51-126125, JP-B-58-50699, JP-A-52-54427, U.S. Pat. No. 3,321,313, etc. can be exemplified.

The amount of the hardener to be used is usually from 0.01 to 30% by weight, preferably from 0.05 to 20% by weight, based on the dry gelatine.

As a process for dispersing the magnetic particles in the binder, various processes such as the process described in JP-A-4-189652, etc. can be applied, with the use of a kneader, a pin-type mill being preferable. Also, the combination of a kneader and a pin type mill or of a kneader and an annuler type mill is also preferable. As the kneader, an open type, a close type or a continuous type kneader, as well as a kneader such as a three-roll mill or a laboplastomill can be used. In the dispersion, a dispersant described in JP-A-5-088283 and the other known dispersant can be used.

The thickness of the magnetically recording layer is from 0.1 to 10 μm, preferably from 0.2 to 5 μm, and more preferably from 0.3 to 3 μm.

The weight ratio of the magnetic particles to the binder is preferably from 0.5:100 to 60:100, and more preferably from 1:100 to 30:100.

The amount of the magnetic particles added is from 0.005 to 3 $g/m^2$, preferably from 0.01 to 2 $g/m^2$, and more preferably from 0.02 to 0.5 $g/m^2$.

The magnetically recording layer of the present invention can be provided on the whole rear surface of a substrate for photograph or the surface of the rear surface of the substrate in a stripe form by application or printing. Alternatively, it is preferable that a binder solution having the magnetic particles dispersed therein and a binder solution for preparing a substrate are cast on the whole surface or in a stripe form to produce a substrate having the magnetically recording layer. In this case, the compositions of the two kinds of the polymers may be different, but they are preferably the same.

As the process for coating the magnetically recording layer, air doctor coating, blade coating, air knife coating, squeeze coating, impregnation coating, reverse roll coating, transfer roll coating, gravure coating, kiss coating, cast coating, spray coating, dip coating, bar coating, extrusion coating, etc. can be used, and any other process can be used. For the typical explanation, "Coating Engineering (Coating Kogaku)", pp. 253–277 May, 20, 1971, pressed from Asakura Shoten describes in detail.

For the magnetically recording layer applied on the substrate by such a process, optionally after the magnetic material in the layer is oriented while immediately drying it, the magnetically recording layer thus formed is dried. The transporting speed of the substrate at this time is usually from 2 to 500 m/min., the drying speed id regulated at a temperature of from 20° to 2500° C. In order to orient the magnetic substance, a permanent magnet or a solenoid coil is used. The strength of the permanent magnet is preferably 2,000 Oe or more, and particularly 3,000 Oe or more. In the case of the solenoid coil, the strength may be 5000 Oe. For the timing of the orientation at the time of the drying, a point where the residual solvent is from 5 to 70% is desirable as described in JP-A-5-005822. Optionally, the surface is treated to be smooth to produce the magnetically recording layer of the present invention. They are described, for example, in JP-B-40-23625, JP-B-39-28368, U.S. Pat. No. 3,473,960, etc. The process shown in JP-B-41-13181 is considered to be a basic and important technique in this field.

The magnetically recording layer may have some functions such as improvement in smoothness, regulation of curl, anti-static property, prevention of adhesion, and head polishing. Alternatively, another functional layer may be provided to impart such functions. Optionally, a protective layer adjacent to the magnetically recording layer may be provided to improve the resistance to scratching. For example, fine inorganic or organic particles (e.g., silica, $SiO_2$, $SnO_2$, $Al_2O_3$, $TiO_2$, crosslinked polymethyl methacrylate, barium carbonate, fine silicone particles, etc.) are preferably added.

For example, there is a process in which additives are incorporated in the magnetically recording layer, and projections having a height of not more than 0.8 μm are provided on the surface of the back layer to prevent a magnetic output error due to the dust adhered during the course of magnetic input or output without deteriorating an S/N ratio, which is one of magnetic characteristic, s and influencing the photographic properties. As a process for imparting surface projections to the back surface, there are processes in which particles are added to the back surface, in which brushing takes place on drying, and in which a Bernard cell is intentionally generated. Of them, the process of adding particles to the back surface is preferable in view of freely controlling the shape of the surface projections.

The particles to be added are insoluble in the development treating liquid, and fine organic particles, polymer particles, crosslinked polymer particles, etc., can be used. Examples of the particles of the present invention include fine powders of barium sulfate, manganese colloide, titanium dioxide, strontium barium sulfate, silicon dioxide, etc. as well as synthetic silicone dioxide obtained by a wetting method or gelation of silicic acid and titanium dioxide (rutile type or anatase type) formed from titanium sludge and sulfuric acid, for the fine inorganic particles. The fine inorganic particles can also be obtained by pulverizing an inorganic substance having a relatively large particle size such as a particle size of not less than 20 μm, followed by classification (such as vibrating filtration and air classification).

Examples of macromolecular compounds include polytetrafluoroethylene, cellulose acetate, polystyrene, polymethylmethacrylate, polypropylmethacrylate, polymethylacrylate, polyethylenecarbonate, starch, etc., and their pulverized and classified substances. In addition it is also possible to use particles obtained by various processes such as suspension polymerization, spray drying and dispersing of macromolecular compounds which are polymer of one or more monomer(s) such as acrylates, methacrlyates, itaconic diesters, crotonates, maleic acid diesters, phthalic acid diesters, styrene derivatives, vinyl esters, acrylamides, vinyl ethers, allyl compounds, vinyl ketones, vinyl heterogenous ring compounds, acrylonitrile, methacrylonitrile, polyfunctional monomers, siloxane three-dimensional polymers, benzoguanamine/formaldehyde condensation, benzoguanamine/melamine/formaldehyde condensation, etc.

In order not to deteriorate the photographic properties, the particles preferably has an average particle size of from 0.1 to 1 μm, and they are preferably applied in an amount of from 1 to 100 mg/$M^2$.

It is preferable in terms of being effective for cleaning the stain adhered to the magnetic head that at least one kind of the particles are preferably non-spherical inorganic particles possessing a Moh's scale of hardness of not less than 5.

The composition of the non-spherical inorganic particles is preferably fine particles inclusive of an oxide such as an aluminum oxide (α-alumina, γ-alumina, corundum, etc.), chromium oxides ($Cr_2O_3$), iron oxides (α-$Fe_2O_3$), silicon dioxide, titanium dioxide, and silicon carbide (SiC), carbides such as silicon carbide and titanium carbide, diamond, etc., and aluminum oxides and chromium oxide ($Cr_2O_3$) are more preferred. The non-spherical inorganic particles may be added to the magnetic layer or may be over-coated on the magnetic layer. The binder used therein is one which is previously described in the magnetic layer, with the preferable binder used in the magnetic layer being preferred.

The transparent substrate of the present invention will be described.

The transparent substrate of the present invention which can be used is triacetyl cellulose or polyethylene terephthalate which has conventionally been used in a color film, and polyethylene aromatic dicarboxylate type polyester substrate is most preferred in view of the magnetic recording ability.

The polyester according to the present invention is formed from a diol and an aromatic dicarboxylic acid as main ingredients, any other dicarboxylic acid may be combinatedly used. Examples of such dibasic carboxylic acids include terephthalic acid, isophthalic acid, phthalic acid, phthalic anhydride, naphthalene dicarboxylic acids (2,6-, 1,5-, 1,4-, and 2,7-), diphenylene-p,p'-dicarboxylic acid, tetrachlorophthalic anhydride, succinic acid, glutaric acid, adipic acid, sebacic acid, succinic anhydride, maleic acid, fumaric acid, maleic anhydride, itaconic acid, citraconic anhydride, tetrahydrophthalic anhydride, 3,6-endmethylenetetrahydrophthalic anhydride, 1,4-cyclohexane dicarboxylic acid, halogenated terephthalic acids, bis(p-carboxyphenol)ether, 1,1-dicarboxy-2-phenylethylene, 1,4-dicarboxymethylphenol, 1,3-dicarboxy-5-phenylphenol, sodium 3-sulfoisophthalate, etc. The aromatic dicarboxylic acid which is an indispensable component is a compound having at least one benzene ring.

Examples of diols include ethylene glycol, 1,3-propane diol, 1,2-propane diol, 1,4-butane diol, 1,5-pentane diol, 1,6-hexane diol, 1,7-heptane diol, 1,8-octane diol, 1,10-decane diol, 1,12-dodecane diol, 1,4-cyclohexane diol, 1,4-cyclohexane dimethanol, 1,3-cyclohexane diol, 1,1-cyclohexane dimethanol, catechol, resorcin, hydroquinone, 1,4-benzenedimethanol, dimethylol naphthalene, p-hydroxyethyloxybenzene, bisphenol A, etc.

If necessary, the polyester may be copolymerized with a compound containing a monofunctional or tri- or more functional hydroxy containing group or an acid group. The polyester compound of the present invention may also be copolymerized with a compound possessing hydroxy group and carboxyl group (or ester thereof) in the molecule at the same time such as salicylic acid.

As a preferred dicarboxylic acid which is co-polymerized, aromatic dicarboxylic acids such as 2,6-naphthalene dicarboxylic acid (NDCA), terephthalic acid (TPA), isophthalic acid (IPA), orthophthalic acid (OPA), paraphenylene dicarboxylic acid (PPDC) are included. As a preferred diol which is copolymerized, (poly)ethylene glycols (PEG or EG), cyclohexane dimethanol (CHDM), neopentyl glycol (NPG), bisphenol A (BPA) and biphenol (BP) are included. As a hydroxycarboxylic acid which is copolymerized, parahydroxybenzoic acid (PHBA) and 6-hydroxy-2-naphthalenecarboxylic acid (HNCA) are included.

Of the polymers, preferable are homopolymers such as polyethyleneterephthalate, polycyclohexanedimethanol terephthalate (PCT), etc., copolymers such as a copolymer of terephthalic acid, naphthalene dicarboxylic acid and ethylene glycol (the mixing molar ratio of terephthalic acid to naphthalene dicarboxylic acid is preferably from 0.9:0.1 to 0.1:0.9, more preferably from 0.8:0.2 to 0.2:0.8), copolymer of terephthalic acid, ethylene glycol, and bisphenol A (the mixing molar ratio of ethylene glycol to bisphenol A is preferably from 0.6:0.4 to 0:1.0, and more preferably from 0.5 to 0.5 to 0.1:0.9), copolymer of isophthalic acid, paraphenylenedicarboxylic acid, terephthalic acid, and ethylene glycol (the molar ratio of isophthalic acid to paraphenylene dicarboxylic acid is preferably from 0.1 to 0.5 and 0.1 to 0.5, respectively and more preferably 0.2 to 0.3 and 0.2 to 0.3, respectively, taking terephthalic acid as 1), copolymer of terephthalic acid, neopentyl glycol and ethylene glycol (molar ratio of neopentyl glycol to ethylene glycol is preferably from 1:0 to 0.7:0.3, and more preferably from 0.9:0.1 to 0.6:0.4), copolymer of terephthalic acid, ethylene glycol and biphenol (the molar ratio of ethylene glycol to biphenol is preferably from 0:1.0 to 0.8:0.2, and more preferably from 0.1:0.9 to 0.7 to 0.3), copolymer of parahydroxybenzoic acid, ethylene glycol, and terephthalic acid (the molar ratio of parahydroxybenzoic acid to ethylene glycol is preferably from 1:0 to 0.1 to 0.9, and more preferably from 0.9:0.1 to 0.2 to 0.8). Of them, polyesters containing 2,6-naphthalene dicarboxylic acid are particularly preferable. To be specific, polyesters containing 0.1 to 1.0 of 2,6-naphthalene dicarboxylic acid are preferred. Of them, polyethylene 2,6-naphthalate is particularly preferable.

These homopolymers and copolymers can be synthesized according to a process for producing a polyester which has been conventionally known. For example, they can be produced by the direct esterification of an acid component and a glycol component. When a dialkyl ester is used as the acid component, the acid component and a glycol component are subjected to an ester interchange reaction, and then heating the reaction product under a reduced pressure to remove an excess glycol component. Alternatively, an acid halide may be used as an acid compound to be reacted with a glycol. In this case, if required, a catalyst for an ester interchange reaction or a polymerization catalyst, or a heat resistant stabilizer. For the synthesis of these polyesters, for example, reference can be made to Kobunshi Jikkengaku (Macromolecule Experiments ), Vol. 5, "Jusyukugo to Jufuka (Polycondensation and Polyaddition)" (Kyoritsu Press, 1980), pp. 103–136, and "Gosei Kobunshi (Synthetic Macromolecules)" (Asakura Press, 1971), pp. 187–286.

A preferred average molecular weight of the polyester is in the range of from about 5,000 to about 200,000.

Furthermore, the polyester may be partly blended with any other polyester in order to enhance adhesive ability with another kind of polyester, may be copolymerized with a monomer constructing another kind of polyester, or may be copolymerized with a monomer having an unsaturated bond, which is then radically crosslinked.

The resulting polymer blend in which two or more polymers are blended may be easily produced according to processes described in JP-A-49-5482, JP-A-64-4325, JP-A-3-192718, Research Disclosure 283,739-41, Research Disclosure 284,779-82, and Research Disclosure 294,807-14.

The polyester of the present invention has a Tg value of not less than 50° C. However, since the photographic material is not always dealt with careful caution, and thus the product is often exposed to a temperature of about 40° C. at outdoor in summer, the Tg value is preferably not less than 55° C. in such a point of view. More preferably, the Tg value is not less than 60° C., and particularly not less than 90° C. Since the effect of improving curl habit due to heat treatment is disappeared when being exposed a temperature exceeding the glass transition temperature, the polyester preferably possesses a glass transition temperature which is a severe condition for use in a general user, i.e., a summer temperature of not less than 40° C.

Typical examples of the polyesters which are used in the present invention will now be described, but the present invention is not restricted thereto.

P-0: [Terephthalic acid (TPA)/ethylene glycol (EG)) 100 /100)] (PET), Tg=80° C.
P-1: [2,6-Naphthalene dicarboxylic acid (NDCA)/ethylene glycol (EG) 100/100)] (PEN), Tg=119° C.
P-2: [Terephthalic acid (TPA)/cyclohexane dimethanol (CHDM) 100/100)], Tg=93° C.
P-3: [TPA/Bisphenol A (BPA)100/100)], Tg=192° C.
P-4: 2,6-NDCA/TPA/EG (50/50/100), Tg=92° C.
P-5: 2,6-NDCA/TPA/EG (75/25/100), Tg=102° C.
P-6: 2,6-NDCA/TPA/EG/BPA (50/50/75/25), Tg=112° C.
P-7: TPA/EG/BPA (100/50/50), Tg=105° C.
P-8 TPA/EG/BPA (100/25/75), Tg=135° C.
P-9 TPA/EG/CHDM/BPA (100/25/25/50), Tg=115° C.
P-10 IPA/PPDC/TPA/EG (20/50/30/100), Tg=95° C.
P-11 NDCA/NPG/EG (100/70/30), Tg=105° C.
P-12 TPA/EG/BP (100/20/80), Tg=115° C.
P-13 PHBA/EG/TPA (200/100/100), Tg=125° C.
P-14 PEN/PET (60/40), Tg=95° C.
P-15 PEN/PET (80/20), Tg=104° C.
P-16 PAr/PEN (50/50), Tg=142° C.
P-17 PAr/PCT (50/50), Tg=118° C.
P-18 PAr/PET (60/40), Tg=101° C.
P-19 PEN/PET/PAr (50/25/25), Tg=108° C.
P-20 TPA/5-sulfoisophthalic acid (SIP)/EG (95/5/100), Tg=65° C.
P-21 PEN/SIP/EG (99/1/100), Tg=115° C.

The substrate of the present invention has a thickness of not less than 50 μm and not more than 300 μm. If it is less than 50 μm, the substrate cannot withstand shrinkage stress of the sensitive layer generating during the drying. On the other hand, the thickness exceeding 300 μm is inconsistent with the purpose of trying to produce a thin product in order to produce a compact product. In view of bending resistance, the substrate is preferably thick and, the thickness is preferably from 50 to 200 μm, more preferably from 80 to 115 μm, and particularly from 85 to 105 μm.

All of the polyesters of the present invention as described above have a higher modulus of elasticity in bending than that of TAC and it is possible to produce a thin product. Of them, PET and PEN have a markedly high modulus of elasticity in bending, and they can be used to produce a product having a film thickness of not more than 105 μm, which has generally had 122 μm of thickness in the case of TAC.

The polyester substrate of the present invention is characterized by being thermally treated, in which case the treatment should be carried out at a temperature higher than 40° C. and not less than the glass transition temperature over a period of 0.1 to 1500 hours. As a higher treated temperature is applied, the heat treatment is more effective. However, if the temperature exceeds the glass transition temperature, the resulting film tends to possess a curl habit. Consequently, the heat treatment should be carried out at a temperature lower than the glass transition temperature.

The heat treatment is carried out preferably at a temperature of not less than 40° C. and, more preferably, less than Tg and not less than (Tg −20° C.). If it is carried out at 40° C. or less, it requires a long period of time to obtain a sufficient effect of preventing curl habit, which deteriorates the commercial productivity.

The heat treatment can be carried out at a constant temperature within this temperature range, or carried out while cooling. The average cooling speed in this case is from −0.01° to −20° C./hour, more preferably from −0.1° to −5° C./hour.

The period of the heat treatment is from 0.1 to 1,500 hours, preferably from 0.5 to 200 hours. If it is less than 0.1 hour, no sufficient effect can be obtained, while if it is more than 1,500 hours, the effect is saturated and there is tendencies to color the substrate and to become brittle.

In order to increase the effect of suppressing the curl habit, a heat treatment is carried out at a temperature of not less than Tg and less than the melting point (melting temperature obtained in DSC) before this heat treatment so that the heat history of the substrate is disappeared, and then the heat treatment is again carried out at a temperature of not less than 40° C. and less than Tg.

In the present invention, the former heat treatment is called "pre-heat treatment" which is distinguished from the heat treatment at a temperature of less than Tg, which is called "post-heat treatment".

The pre-heat treatment is preferably carried out at a temperature of not less than Tg and less than the melting point, more preferably at temperature of not less than Tg plus 20° C. and less than the crystallization temperature (crystallization temperature obtained in DSC). If the post-heat treatment is carried out at a temperature higher than the melting point, the elasticity of the substrate is remarkably decreased, which causes a problem in a plane surface and transportability. The pre-heat treatment can be carried out at a constant temperature within this temperature range (constant temperature pre-heat treatment), carried out while cooling down (cooling down pre-heat treatment), or carried out while heating up (heating up pre-heat treatment).

The period of the pre-heat treatment is from 0.1 minutes to 1500 hours, preferably from 1 minute to 1 hour. If it is less than 0.1 minute, no sufficient effect can be obtained, while if it is more than 1500 hours, the effect is saturated and there is tendencies to color the substrate and to become brittle.

After the pre-heat treatment, the post-heat treatment is carried out. It is possible to rapidly cool down from the temperature at the time of finishing the pre-heat treatment to the temperature of initiating the post-heat treatment or to gradually cool down to the temperature of initiating the post-heat treatment via Tg. Alternatively, it is also possible to cool down to room temperature and then to heat up to the post-treatment temperature.

Although there are several combination of these pre- and post-heat treatments, it is preferable to carry out the pre-heat treatment at a temperature of not less than Tg+20° C. and less than the crystallization temperature and then to carry out the post-heat treatment while cooling down to the temperature of from Tg to Tg −20° C. at a cooling speed of from −0.1° to −5° C./hour.

The heat treatments of the substrate as described above can be carried at in a roll state of the substrate or in a web state during transportation of the substrate.

In the case of carrying out the heat treatment in a roll state, either (1) a method in which a roll at room temperature is thermally treated in a thermostat tank, or (2) a method in which a web is heat to a prescribed temperature during the course of its transportation and winded into a roll to be subjected to the heat treatment. Al though the method described under (1) has the disadvantage that it takes a long time to heat up to a prescribed temperature, it is advantageous in saving a cost for investment in plant and equipment. Although the method described under (2) requires a winding equipment, it has the merit of saving the period for heating up.

The heat treatment in a roll state is disadvantageous in that due to the thermal shrinkage reaction caused during the course of the heat treatments, wrinkles caused by winding brokage and a plane-state trouble of transferring of the cut area of the roll core portion are generated. For this reason, it is preferable to make unevenness on a surface (e.g., an electric conductive inorganic particles such as $SnO_2$ and $Sb_2O_5$ are applied) to decrease a creak between the substrates, whereby the wrinkles due to the rolling are prevented, or the edges are knurled to heighten the edges so as to prevent the transferring of the cut area of the roll core portion.

On the other hand, in the case of the heat treatment in a web state, a prolonged post-heat treatment is required, but a substrate having a good plane state can be obtained in comparison with the heat-treatments in a roll state.

Of these heat treatments, it is preferable to carry out the pre-heat treatment in a web state and to carry out the post-heat treatment in a roll state. When the pre-heat treatment is carried out in a web state, there is little tendency to cause the trouble of the plane state in comparison with the case of carrying out the treatment in a roll state, whereas the pre-heat treatment requires a relatively long period.

The heat treatment can be carried out at any stage after the film formation of the substrate, after the glow discharging, after the application of the back layer (anti-static agent, lubricant, etc.), or after the application of the primer. Preference is given to carry out the treatments after the application of an anti-static agent. This makes it possible to prevent the adhesion of dust, which is a cause of the plane trouble of the substrate.

In the method for the heat treatment of the polyester of the present invention, it is preferable for shortening the period to previously heat the substrate to a temperature above Tg for short period (preferably being treated at temperature 20° C. higher than Tg and not more than 100° C. for 5 minutes to 3 hours). The roll core used in the heat treatments is preferably one which is a hallow or has a construction where an electric heater is built-in or a construction which can flow a high temperature liquid so as to effectively transmit the temperature to the film. The material for the roll core is not specifically restricted, but a material which is free from a decrease in strength or deformation through heat, such as stainless or a glass fiber-containing resin is preferable.

It is preferable for the polyester of the present invention to coexist with various additives for further enhancing the functions for photograph substrate.

For the purpose of preventing fluorescence and imparting to stability with time elapse, a ultraviolet absorbent may be kneaded in the polyester film. A ultraviolet absorbent which does not have an absorption in the visible region, and the amount of the ultraviolet absorbent added is usually from 0.01 to 20% by weight, preferably from 0.05 to 10% by weight, based on the weight of the polyester film. If it is less than 0.01% by weight, no effect for suppressing the ultraviolet deterioration can be expected. Examples of the ultraviolet absorbent include benzophenone type ultraviolet absorbents such as 2,4-dihydroxybenzophenone, 2-hydroxy-4-methoxybenzophenone, 2-hydroxy-4-n-octoxybenzophenone, 4-dodecyloxy-2hydroxybenzophenone, 2,2',4,4'-tetrahydroxybenzophenone, and 2,2'-dihydroxy-4,4'-dimethoxybenzophenone; benzotriazole types such as 2-(2'-hydroxy-5-methylphenyl)benzoriazole, 2-(2'-hydroxy-3',5'-di-t-butylphenyl)benzoriazole, and 2-(2'-hydroxy- 3'-di-t-butyl-5'-methylphenyl)benzoriazole, and salicylic acid types such phenyl salicylate and methyl salicylate.

Whereas a preferred refractive index of the aromatic polyester of the present invention is as high as from 1.6 to 1.7, that of the gelatine layer which is applied thereon is from 1.5 to 1.55, which is lower than the former value. Consequently, when a light is transmitted from the film edge, reflection is easily caused on the interface between the base and the emulsion layer. Consequently, the polyester film brings about a so-called light-piping phenomenon (edge fogging).

As means for avoiding the light-piping phenomenon, a method in which inert inorganic particles are incorporated in the substrate and a method of adding a dyestuff have been known.

A preferred method for preventing the light-piping phenomenon in the present invention is a method of adding a dyestuff, which method does not markedly increase a film haze.

The dyestuffs used at this time are not specifically restricted, but a gray dyestuff which has usual color in the sensitive material is preferable, and also the dyestuff excelling in heat resistance at the temperature of forming a polyester film and having a good compatibility with polyester is preferred.

When the dyestuff, "Diaresin" produced by Mitsubishi Chemicals Co., Ltd. and the dyestuff "Kayaset", et., which are commercially available for polyester are mixed, the object can be achieved.

The color density within a visible light region is required to be at least 0.01 as determined by a color densitometer produced by Machbeth Inc. More preferably, it is at least 0.03.

It is possible to impart lubricative property to the polyester film according to the present invention depending on the application. An inert inorganic compound is kneaded or surfactant is coated as a general means. However, the application method thereof is not restricted.

Examples of such inert inorganic particles include $SiO_2$, $TiO_2$, $BaSO_4$, $CaCO_3$, talc, kaolin, etc. Apart from the imparting of lubricative property by an external particle system in which inert particles are added to the polyester synthetic system, it is also possible to employ a method for imparting lubricative property by an internal particle system in which a catalyst, etc. are deposited during polymerization of the polyester.

Although means for imparting lubricative property is not specifically restricted, since the transparency is an important requirement for the substrate for photosensitive material, it is preferable to use $SiO_2$ which has a refractive index relatively close to that of the polyester film as the external particle system or to select an internal particle system in which particles deposited are controlled in a relatively small particle size.

In a case of imparting lubricative property by kneading, a method of laminating a layer providing transparency of the film is used. A typical example of such means include a coextrusion method using two or more extruders and a feed block, or a multi-manifold die.

When the polyester film is used for the substrate, since the polyester substrate has a hydrophobic surface, it is very difficult to stiffly adhere a photographic layer comprising a protective collido mainly composed of gelatine (e.g., a photosensitive silver halide emulsion layer, an intermediate layer, a filter layer, etc.) to the substrate. The prior arts used for overcoming such difficulty include two methods:

(1) A method in which a surface activation treatment such as a chemical treatment, a mechanical treatment, a corona discharge treatment, a flame treatment, a ultraviolet treatment, a high frequency treatment, a glow discharge treatment, an active plasma treatment, a laser treatment, a mixed acid treatment, and an ozone oxidation treatment, is employed, and then a photographic emulsion is directly applied to the substrate thus activated to obtain an adhesivity and (2) A method in which with or without a surface-treatment, a primer layer is provided on a substrate and then a photographic emulsion layer is provided thereon (e.g., U.S. Pat. Nos. 2,698,241, 2,764,520, 2,864,755, 3,462,335, 3,475,193, 3,143,421, 3,501,301, 3,460,944, and 3,674,531, U.K. patent Nos. 788,365, 804,005, and 891,469, JP-B-48-43122, JP-B-51-446, etc.)

In these surface treatments, a somewhat polar group is provided on the originally hydrophobic surface of the substrate, or a crosslinked density of the surface is increased, as a result, an affinity with the polar group of the components contained in the primer coating liquid is increased or the fastness on the adhered surface is increased. Also the adhering mechanism due to the generation of a radical can be considered.

Various methods have been made to construct the primer layer, for example, a so-called lamination method in which a layer having good adhesion to the substrate (hereinafter referred to as "first primer layer") is provided and then a hydrophilic resin layer (hereinafter referred to as "second primer layer") is provided thereon, and a single layer method only one resin layer having a hydrophobic group and a hydrophilic group is applied can be mentioned.

Preferred surface treatment is a ultraviolet ray-irradiation treatment, a flame treatment, a corona treatment, and a glow discharge treatment.

First, the ultraviolet ray-irradiation treatment is described in the following. The treatment is preferably carried out according to a method described in JP-B-43-2603, JP-B-43-2604, JP-B-45-3828. As a mercury lamp, a high pressure mercury lamp composed of a quartz tube having a ultraviolet wavelength of 180 to 320 nm is preferable. Irradiation with ultraviolet ray may be performed at any stage of stretching the substrate or thermal fixation, or after the thermal fixation.

With regard to the method of the ultraviolet ray-irradiation, a high pressure mercury arc lamp having a main wavelength of 365 nm can be used, if the surface temperature of the support can be raised to about 150° C. not to cause any problem of the performance of the substrate. In the case where a low temperature treatment is required, it is also possible to use a low pressure mercury arc lamp having a main wavelength of 254 nm, a ozone-less type high mercury lamp or a low pressure mercury lamp. With regard to the amount of the light to be treated, an adhesivity between the substrate and a layer to be adhered is increased as an amount of the light to be treated is increased. However, with an increase in the amount of the light to be treated, there occurs the problem that the substrate becomes brittle. Consequently, in the treatment of a usual plastic film such as a polyester or a polyolefin film using a high pressure mercury arc lamp having a main wavelength of 365 nm, an irradiation quantity of light of from 20 to 10,000 (mJ/cm$^2$) is preferred, and more preferably from 50 to 2,000 (mJ/cm$^2$). In the case of a low pressure mercury arc lamp having a main wavelength of 254 nm, the irradiation quantity of light is preferably from 100 to 10,000 (mJ/cm$^2$), more preferably from 300 to 1500 (mJ/cm$^2$).

The corona discharge is described in the following. It can be attained by any of the known method disclosed, for example, in JP-B-48-5043, JP-B-47-51905, JP-A-47-28067, JP-A49-83767, JP-A-51-41770, JP-A-51-131576, etc. The discharge frequency is from 50 to 5,000 KHz, preferably 5 to several hundreds KHz, and particularly from 10 to 30 KHz. If the discharge frequency is too small, no stable discharge can be obtained, and there occur pin-holes in the substance for treatment. If the frequency is too high, a special device is required to match an impedance, resulting in an undesirable increase in the cost for equipment. It is suitable for the treatment strength of the substance for treatment to be usually in the range of from 0.001 to 5 KV.A.min./m$^2$, preferably from 0.01 to 1 KV.A.min./m$^2$. The gap clearance between the electrode and the dielectric roll is suitably in the range of from 0.5 to 2.5 mm, preferably from 1.0 to 2.0 mm. As the corona discharger, Solid state corona discharger, Model 6 KVA", produced from Pillar Inc. can be used.

In the flame treatment, natural gases, liquified propane gas, etc. may be used, and in this case the mixing ratio with air is important. A preferable gas/air mixing ratio is from 1/14 to 1/22 by volume, and more preferably from 1/16 to 1/19, for propane, and is from 1/6 to 1/10, and more preferably from 1/7 to 1/9, for the natural gas.

The flame treatment is carried out in from 1 to 50 Kcal/m$^2$, more preferably from 3 to 20 Kcal/m$^2$. It is more effective that the distance between the edge of the internal flame of the burner and the substrate is not more than 4 cm. As the treating equipment, a flame treating machine produced by Kasuga Denki K.K. can be used. A back-up roller which supports the substrate is preferably a hallow type roll because a cooling media can be passed through the interior of the roll to always maintain the temperature at a constant temperature.

The glow discharge treatment which is effective for surface treatment is carried out according to any of the conventionally known methods, for example, as described in JP-B-35-7578, JP-B-36-10336, JP-B-45-22004, JP-B-45-22005, JP-B-45-24040, JP-B-46-43480, U.S. Pat. Nos. 3,057,792, 3,057,795, 3,179,482, 3,288,638, 3,309,299, 3,424,735, 3,462,335, 3,475,307, and 3,761,299, U.K. patent. No. 997,093, JP-A-53-129262, etc.

It has been understood that glow discharge method is not preferred for the polyester substrate having a Tg value of from 90° C. to 200° C. in view of that the glow discharge method provide imparting adhesivity, suppression of yellow-staining and prevention of blocking for the polyester substrate, simultaneously. There is a method which is carried out under introducing various gasses, such as oxygen, nitrogen, helium or argon, into atmosphere of the glow discharge. However, in a case of the present invention, no drastic effect for imparting adhesion can be seen even if a specific gas is introduced and, thus, the introduction of a gas which requires much cost, is not suitable for carrying out the treatment in an industrial production. In contrast, steam-introduction method is effective in imparting adhesion, which effect is the same or higher than that exhibited in a case of a specific gas-introduction method, which is very costless to be excellent in an industrial production.

The steam partial pressure in carrying out the glow discharge in presence of steam according to the present invention is preferably from 10 to 100%, and more preferably from 40 to 90%. If it is less than 10%, it is difficult to obtain a sufficient adhesion. Gas other than the steam is air composed of oxygen, nitrogen, etc.

The quantitative introduction of steam in the atmosphere of the glow discharge is attained by inducing the gas from a sampling tube mounted on the glow discharge equipment to a tetrapole type weight analyzer (produced by Nippon Shinku K.K., Model MSQ-150), while quantitatively determine the composition.

It has also been found that when a film to be surface-treated is preheated and subsequently subjected to a glow discharge treatment, an adhesion is improved with a treatment of a shorter period than the treatment without preheating, and yellowing can be drastically decreased. The preheating described herein is different from the heat treatment for improving curl habit described later on.

The preheating temperature is preferably from 50° C. to Tg, more preferably from 70° C. to Tg, and particularly from 90° C. to Tg. The preheating at a temperature higher than Tg somewhat causes a deteriorated adhesivity.

Typical methods for increasing the polymer surface temperature in vacuo which can be used are heating through a infrared heater, contact with a heated roll, etc. For example, in a case where the film surface is wanted to be preheated to 115° C., it is sufficient that the film is brought into contact with a roll heated at 115° C. for at most 1 second. The heating methods are not restricted to those described above, and various known methods can be applied.

The substrate thus preheated is subjected to a glow discharge treatment. In this case, important conditions to be controlled, other than the above-mentioned steam partial pressure and the preheating temperature of the substrate, are vacuum degree, voltage between electrodes, and discharge frequency, etc. By controlling these treatment conditions, a glow discharge treatment which can impart an adhesion and suppress yellowing at the same time can be carried out.

The pressure on the glow discharge treatment is preferably from 0.005 to 20 Torr, more preferably from 0.02 to 2 Torr. When the pressure is too low, the surface of the substrate cannot be sufficiently modified and, thus, no sufficient adhesion can be obtained. Conversely, when it is too high, no stable discharge can take place.

The voltage is preferably between 500 and 5,000 V, more preferably between 500 and 3,000 V. If the voltage is too low, no sufficient adhesion can be obtained. Conversely, if it is too high, the surface is unduly modified, causing deterioration in adhesion.

The discharged frequency to be used is, as seen in the prior art, from a direct current to several thousands MHz, preferably from 50 Hz to 20 MHz, and more preferably from 1 KHz to 1 MHz.

The discharge strength which can provide a desired adhesion is preferably from 0.01 to 5 KV.A.min./$m^2$, and more preferably from 0.15 to 1 KV.A.min./$m^2$.

It is preferable that the substrate thus subjected to the glow discharge treatment is rapidly cooled with a cooling roll. The substrate tends to be flexibilized and deformed accompanying with an increase in the temperature due to external force and, thus, the plane property of the substrate is lost. Moreover, due to the external force, low molecular weight substances (monomers, oligomers, etc.) are deposited on the surface of the substrate, resulting in deteriorated transparency and anti-blocking.

Subsequently, the methods of primer-coating described under the item (2) is described. These methods have hitherto been studied. In the first primer layer in the lamination method, various polymers, such as copolymers comprising monomers such as vinyl chloride, vinylidene chloride, butadiene, methacrylic acid, acrylic acid, itaconic acid, maleic anhydride, and the like, as well as polyethyleneimine, epoxy resin, grafted gelatine, nitrocellulose, etc. have been examined for their characteristics, and in the second primer layer, gelatine has been examined for its characteristics.

In the single layer method, in many cases, many substrates are swelled to be mixed with a hydrophilic primer polymer at the interface, thereby achieving good adhesion.

Examples of hydrophilic primer polymers which is used in the present invention include water-soluble polymers, cellulose esters, latex polymers, and water-soluble polyesters. Examples of the water-soluble polymers include gelatine, gelatine derivatives, casein, agar, sodium alginate, starch, polyvinyl alcohol, polyacrylic acid copolymer and maleic acid anhydride copolymer, and examples of cellulose esters include carboxymethyl cellulose and hydroxyethyl cellulose. Examples of the polymer lattex include vinyl chloride-containing copolymers, vinylidene chloride-containing copolymers, acrylate-containing copolymers, vinyl acetate-containing copolymers, butadine-containing copolymers, etc. Of them, gelatin is most preferred.

As compounds which swell the substrate of the present invention, there can be mentioned resorcin, chlororesorcin, methylresorcin, o-cresol, m-cresol, p-cresol, phenol, o-chlorophenol, p-chlorophenol, dichlorophenol, trichlorophenol, monochroroacetic acid, dichloroacetic acid, trifluoroacetic acid, chloral hydrate, etc.

Various gelatine hardeners can be used in the primer coated layer of the present invention.

Examples of the gelatine hardeners include chromium salts (such as chromium alum), aldehydes (such as formaldehyde and glutalaldehyde), isocyanates, active halogen compounds (such as 2,4-dichloro-6-hydroxy-S-triazine), epichlorohydrin resins, etc.

In the primer-coated layer, fine inorganic particles such as $SiO_2$, $TiO_2$, matting agent, or fine polymethyl methacrylate copolymer particles (1 to 10 μm) can be incorporated as a matting agent.

In addition, various additives can optionally be incorporated in the primer coating liquid. For example, surfactants, anti-static agents, anti-halation agents, coloring dyestuffs, pigments, coating aids, anti-fogging agents, etc., can be exemplified. In the present invention, in a case where a primer coating liquid for the first primer layer is used, it is not required at all to incorporate an etching agent such as resorcin, chloral hydrate, chlorophenol in the primer coating liquid. However, if necessary, an etching agent previously described may be incorporated in the primer coating liquid.

The primer coating liquid according to the present invention can be applied by any of the applying methods which have been generally well known, such as dip coating, air knife coating, curtain coating, roller coating, wire coating, bar coating, gravure coating, and extrusion coating with a hopper as described in U.S. Pat. No. 2,681,294. Optionally, it can be applied to two or more layers at the same time by a method described in U.S. Pat. Nos. 2,761,791, 3,508,947, 2,941,898, and 3,526,528, and "Coating Engineering" pp. 253, Ed. Yuji Harasaki, 1973, published from Asakura Shoten, etc.

In the present invention, a preferable substrate is made of polyethylene-2,6-naphthalene dicarboxylate which has been thermally treated at a temperature between 100° and 115° C. for 24 hours which has a thickness of from 85 to 105 μm. The surface thereof has been subjected to a ultraviolet ray-treatment or a glow corona discharge treatment, and a light-insensitive hydrophilic layer on the back side thereof may be a gelatine layer having from 0.1 to 7 μm thickness, and preferably the light insensitive hydrophilic layer has a 0.1 to 5 μm thickness and comprises a cellulose binder, for example, triacetylcellulose and diacetylcellulose, in which the light-insensitive hydrophilic layer on the back layer may be gelatine, and the weight ratio of gelatine in the light-insensitive hydrophilic layer in the back layer and in an emulsion layer on the opposite side thereof is 0.1 to 0.5.

The treating process of the present invention will now be described.

The coloring developer which is used for developing the sensitive material of the present invention (color developer) is preferably an aqueous alkali solution mainly comprising an aromatic primary amine developing agent. As the developing agent, an aminophenol compound is preferable and, a p-phenylenediamine compound is also preferable. Typical examples thereof are 3-methyl-4-amino-N,N-diethylaniline, 3-methyl-4-amino-N-ethyl-N-β-hydroxyethylaniline, 3-methyl-4-amino-N-ethyl-N-β-methanesulfonamideethylaniline, 3-methyl-4amino-N-ethyl-N-β-methoxyethylaniline, 4-amino-3-methyl-N-methyl-N-(3-hydroxypropyl)aniline, 4-amino-3-methyl-N-ethyl-N-(3-hydroxypropyl)aniline, 4-amino-3-methyl-N-ethyl-N-(2-hydroxypropyl)aniline, 4-amino-3-ethyl-N-ethyl-N-(3-hydroxypropyl)aniline, 4-amino-3-methyl-N-propyl-N-(3-hydroxypropyl)aniline, 4-amino-3-propyl-N-methyl-N-(3-hydroxypropyl)aniline, 4-amino-3-methyl-N-methyl-N-(4-hydroxybutyl)aniline, 4-amino-3-methyl-N-ethyl-N-(4-hydroxybutyl)aniline, 4-amino-3-methyl-N-propyl-N-(4-hydroxybutyl)aniline, 4-amino-3-ethyl-N-ethyl-N-(3-hydroxy-2-methylpropyl)aniline, 4-amino-3-methyl-N,N-bis-N(4-hydroxybutyl)aniline, 4-amino-3-methyl-N,N-bis(5-hydroxypentyl)aniline, 4-amino-3-methyl-N-(5-hydroxypentyl)-N-(4-hydroxybutyl)aniline, 4-amino-3-methoxy-N-ethyl-N-(4-hydroxybutyl)aniline, 4-amino-3-ethoxy-N,N-bis(5-hydroxypentyl)aniline, 4-amino-3-propyl-N-(4-hydroxybutyl)aniline, and sulfates, hydrochlorides, and p-toluene sulfonates thereof. Of them, 3-methyl-4-amino-N-ethyl-N-β-hydroxyethylaniline, 4-amino-3-methyl-N-ethyl-N-(3-hydroxypropyl)aniline, 4-amino-3-methyl-N-ethyl-N-(4-hydroxybutyl)aniline, and sulfates, hydrochlorides and p-toluene sulfonates thereof are preferable. Two or more these compounds can be jointly used according to an object.

The amount of the aromatic primary amine main developer used is preferably from 0.0002 to 0.2 mol, and more preferably from 0.001 to 0.1 mol.

The color developer may comprise, in addition to various preservatives such as hydroxylamine, and diethylhydroxylamine, hydroxylamines described in JP-A-3-144446 represented by formula (I), sulfites, hydrazines such as N,N-biscarboxymethyl hydrazine, phenylsemicarbadides, triethanolamine, catechol sulfonic acids; organic solvents such as ethylene glycol and diethylene glycol; developing accelerators such as benzyl alcohol, quaternary ammonium salts, and amines, dye-forming couplers, competitive couplers, developing aids such as 1-phenyl-3-pyrazolidone, tackifiers, various chelating agents such as amino polycarboxylic acids, amino polysulfonic acids, alkylsulfonates, and phosphonocarboxylic acids, for example, ethylenediamine tetraacetic acid, nitrile triacetic acid, diethylenetriamine pentaacetic acid, cyclohexanediamine tetraacetic acid, hydroxyethylimino diacetic acid, 1-hydroxyethylidene-1,1-diphosphonic acid, nitrilo-N,N,N-trimethylene phosphonic acid, ethylenediamine-N,N,N-tritetramethylene phosphonic acid, ethylenediamine-di (o-hydroxyphenyl acetic acid), and salts thereof.

Of them, substituted hydroxylamines are preferred as the preservatives, and diethylhydroxylamine, monomethylhydroxylamine, and one having an alkyl substituent substituted with a water-soluble group, such as sulfo group, carboxy group, or hydroxyl group are more preferred. Examples of the most preferred preservatives include N,N-bis(2-sulfoethyl)-hydroxylamine, monomethylhydroxylamine, diethylhydroxylamine, and the like.

If necessary, an optional anti-fogging agent can be added to the color developer used in the present invention. Examples of the anti-fogging agents include alkali metal halides such as sodium chloride, sodium bromide, and sodium iodide, and organic anti-fogging agents. Typical examples of the organic anti-fogging agents include nitrogen-containing heterocyclic compounds, such as benzotriazole, 6-nitrobenzimidazole, 5-nitroisoindazole, 5-methylbenzotriazole, 5-nitrobenzotriazole, 5-chlorobenzotriazole, 2-thiazolylbenzoimidazole, 2-thiazolylmethylbenzoimidazole, indazole, hydroxyazaindolizine, and adenine.

A preferable pH range of the color developer used in the present invention is from approximately 9.5 to 10.5. For maintaining the developing activity, the pH value in the developing tank is preferably as low as possible in terms of the prevention of ammonia gas being generated from the wasted liquid. The most preferred pH value of the tank liquid is from approximately 9.9 to 10.4.

It is preferable for maintaining the above pH value to use various buffers. Examples of the buffers include carbonates, phosphorates, borates, tetraborates, hydroxybenzoates, glycyl salts, N,N-dimethyl glycine salts, leucine salts, norleucine salts, guanine salts, 3,4-dihydroxyphenylalanine salts, alanine salts, aminobutyrates, 2-amino-2-methyl-1,3-propane diol salts, valine salts, proline salts, trishydroxyaminomethane salts, lysine salts and the like. Particularly, the use of a carbonate is preferable.

The amount of the buffer added to the developer is preferably not less than 0.1 mol/litter, particularly from 0.1 to 0.4 mol/liter.

As the chelators, compounds having a biodegradability are preferred. Examples thereof include chelators described in JP-A-63-146998, JP-A-63-199295, JP-A63-267750, JP-A-63-267751, JP-A-2-229146, JP-A-3-186841, German patent No. 3,739,610, European patent No. 468,325, and the like.

The treating liquid in the replenishing tank of the color developer or the treating bath is preferably shielded with a liquid agent such as a high boiling point organic solvent to decrease the area in contact with air. The most preferable shielding agent is liquid paraffin, which is most preferably used in the replenishing liquid.

The temperature of the treatment to the color developer is from 30° to 55° C., preferably from 35° to 55° C. The period of the treatment of the photographic sensitive material is from 20 seconds to 5 minutes, preferably from 30 seconds to 3 minutes and 20 seconds.

The amount of replenishment is from 30 to 800 ml, preferably 50 to 500 ml, per square meter of the photosensitive material.

In the case of carrying out the reversal development, the color development is carried out after a monochromatic development has been carried out. In the monochromatic development, the known monochromatic developing agents, e.g., dihydroxybenzenes such as hydroquinone, 3-pyrazolidones such as 1-phenyl-3-pyrazolidone, and aminophenols such as N-methyl-p-aminophenol can be used singly or a mixture thereof.

If necessary, an optional developing accelerator can be added to the developer used in the present invention. Examples of the developing accelerators which can optionally be added are thioether compounds as described in JP-B-37-16088, JP-B-37-5987, JP-B-38-7826, JP-B-44-12380, JP-B-45-9019, and U.S. Pat. No. 3,813,247, etc., p-phenylenediamine compounds as described in JP-A-52-49829, JP-A-50-15554, etc., quaternary ammonium salts as described in JP-A-50-137726, JP-B-44-30074, JP-A-56-156826, JP-A-52-43429, amine compounds as described in U.S. Pat. Nos. 2,494,903, 3,128,182, 4,230,796, and 3,253,919, JP-B-41-11431, U.S. Pat. Nos. 2,482,546, 2,596,926, and 3,582,346, etc., polyalkylene oxides as described in JP-B-37-16088, JP-B-42-25201, U.S. Pat. No. 3,128,183, JP-B-41-11431, JP-B-23883, U.S. Pat. No. 3,532,501, etc., as well as 1-phenyl-3-pyrazolidones, imidazoles, and the like.

The stage for desilvering in the present invention will now be described.

In the stage for desilvering, a bleaching stage, a blixing stage, and a fixation stage, and various stages are generally involved. Typical stages include, but are not restricted thereto:

(Stage 1) Blixing
(Stage 2) Bleaching-Blixing
(Stage 3) Bleaching-Blixing-Fixation
(Stage 4) Fixation-Blixing
(Stage 5) Bleaching-fixation In the present invention, a particularly remarkable effect is exhibited in the case where a bath before water washing or stabilization stage is a blixing stage.

Examples of the bleaching agents which can be used in the treating liquid having a bleaching performance are aminopolycarboxylic acid-iron (III) complexes, persulfates, bromates, hydrogen peroxides, red prussiate, and the like, with aminopolycarboxylic acid-iron (III) complexes being most preferably used.

The ferric complex used in the present invention may be added as a previously complex-formed iron complex to be dissolved, or a complex may be formed in a liquid having a bleaching performance in the coexistence of complex-forming compound with and a ferric salt (such as ferric sulfate, ferric chloride, ferric bromide, iron (III) nitrate, ammonium iron (III) sulfate, etc.).

An amount of the complex-forming compound may be larger than that to be required to form a complex with the ferric salt, in which case, from 0.01 to 10% excess is preferable as a rule.

Examples of the compounds for forming a ferric salt in a liquid having a bleaching performance include, but are not restricted thereto, ethylenediamine tetraacetic acid (EDTA), 1,3-propanediamine tetraacetic acid (1,3-PDTA), diethylenetriamine pentaacetic acid, 1,2-cyclohexanediamine tetraacetic acid, iminodiacetic acid, methyliminodiacetic acid, N-(2-acetamido)-iminodiacetic acid, nitrilotriacetic acid, N-(2-carboxymethyl)imino diacetic acid, N-(2-carboxymethyl)imino dipropionic acid, A-alanine diacetic acid, 1,4-diaminobutane tetraacetic acid, glycol ether diaminetetraacetic acid, N-(2-carboxyphenyl)iminodiacetic acid, ethylenediamine-N-(2-carboxyphenyl)-N,N',N'-triacetic acid, ethylenediamine-N,N'-disuccinic acid, 1,3-diaminopropane-N,N'-disuccinic acid, ethylenediamine-N,N'-dimalonic acid, 1,3-diaminopropane-N,N'-dimalonic acid, etc.

The concentration of the ferric complex in the treating liquid having a bleaching performance of the present invention is suitably from 0.005 to 1.0 mol/liter, preferably from 0.01 to 0.50 mol/liter, and more preferably from 0.02 to 0.30 mol/liter.

The concentration of the ferric complex in the replenishing liquid of the treating liquid having a bleaching performance is preferably from 0.005 to 2 mol/liter, and more preferably from 0.01 to 1.0 mol/liter.

In the bath having a bleaching performance or a pre-bath thereof, various compounds can be used as bleaching accelerators. For example, compounds having mercapto group or disulfide group as described in U.S. Pat. No. 3,896,858, German patent No. 1,290,812, JP-A-53-95630, and Research Disclosure No. 17,129 (July, 1978), thiourea compounds as described in JP-B-45-8506, JP-A-52-20832, JP-A-53-32735, U.S. Pat. No. 3,706,561, etc., and halides such as iodide ion and bromide ion are preferable because of their excellent bleaching power.

In addition, the bath having a bleaching performance may contain re-halogenating agents such as bromides (such as potassium bromide, sodium bromide and ammonium bromide), chlorides (such as potassium chloride, sodium chloride, and ammonium chloride), and iodides (such as ammonium iodide). If necessary, one or more inorganic or organic acids having a buffering performance, or alkali, ammonium salts thereof, such as borax, methaboric acid, acetic acid, sodium acetate, sodium carbonate, potassium carbonate, potassium carbonate, phosphorous acid, phosphoric acid, sodium phosphorate, citric acid, sodium citrate, tartaric acid, malonic acid, succinic acid, and glutaric acid, or anti-corrosion agents such as ammonium nitrate, guanidine, etc. may be added.

Furthermore, various optical brighteners, defoaming agents, surfactants, organic solvents such as polyvinyl pyrrolidone and methanol may be added to the bath having a bleaching performance.

As a fixing component of the bleaching and fixing liquid, known fixers are used, i.e., water-soluble silver halide dissolving agents including thiosulfates such as sodium thiosulfate, ammonium thiosulfate; thiocyanates such as sodium thiocyanate and ammonium thiocyanate; thioethers such as ethylene-bisthioglycolic acid and 3,6-dithia-1,8-octane diol, meso-ionic compounds and thiourea, and they can be used singly or as a mixture of two or more of them. Also a special blixer comprising a combination of a fixer with a large amount of halide, such as potassium iodide or the like, as described in JP-A-55-155354 can be used. In the present invention, the use of thiosulfates, particularly ammonium thiosulfate and sodium thiosulfate is preferable. The amount of the fixer is preferably from 0.3 to 2 mol, and more preferably from 0.5 to 1.0 mol, per liter.

It is preferred to contain a sulfite (or bisulfite metabisulfite) in the blixing liquid or the fixing liquid as a preservative, preferably in an amount of 0.08 to 0.4 mol/liter, more preferably from 0.1 to 0.3 mol/liter. When this concentration is used and the final bath of the present invention is used, the magnetically recording performance is drastically improved and, at the same time, a desirable image storage ability can be obtained.

To the blixing liquid and the fixing liquid of the present invention, in addition to the above-mentioned sulfite ion discharging compounds such as sulfites (such as sodium sulfite, potassium sulfite, and ammonium sulfite), bisulfite (such as sodium bisulfite, potassium bisulfite, and ammonium bisulfite), methabisulfites (such as sodium metabisulfite, potassium metabisulfite, and ammonium metabisulfite), aldehydes (such as benzaldehyde and acetaldehyde), ketones (such as acetone), ascorbic acids, hydroxylamines, etc., may optionally be added.

Furthermore, to the bleaching liquid, bleaching and fixing liquid, and fixing liquid may optionally added optical buffers, brighteners, chelating agents, defoaming agents, antifungal agents, etc.

In the bleaching liquid and bleaching and fixing liquid used in the present invention, a preferred pH region is from 4.5 to 6.2, and more preferably from 5 to 6. If the pH value is higher or lower than this region, there sometimes arises the problem where no sufficient magnetically recording performance can be exhibited. In the case of the fixing liquid, the pH value of from 5 to 8 is preferable.

The replenishing amount to the bleaching liquid, blixing liquid and fixing liquid of the present invention is from 50 to 2,000 ml, more preferably from 100 to 1,000 ml, per $m^2$ of the photosensitive material. Optionally, overflow liquid of water washing and the stabilization bath, which are post-baths may be replenished.

The temperature for treating the bleaching liquid, blixing liquid and fixing liquid is from 20° to 50° C., preferably from 30° to 45° C. The treating period is from 10 seconds to 3 minutes, preferably from 20 seconds to 2 minutes.

When being treated with the treating liquid having a bleaching performance of the present invention, it is preferable to carry out an aeration in view of stabilization of photographic performances. The aeration may be carried out by a method known in the art, such as blowing air into the treating liquid having a bleaching performance or absorbing air with an ejector.

In blowing air, it is preferable to discharge air into the liquid through an air diffusion tube having fine pores. Such an air diffusion tube is widely used in an air exposing tank in an activated sludge process. For the aeration, the item described in "Z-121, "Using Process, C-41, the 3rd edition (1982), BL-1 to BL-2 page published from Eastman Kodak Inc. can be applied. In the treatment with the treating liquid having a bleaching performance of the present invention, it is preferable to be strongly stirred. In carrying out the treatment, the content described in JP-A-3-33847, page 8, from the upper right column line 6 to the lower left column, line 2, can be directly applied.

In the desilvering stage, it is preferred that the degree of vigorous stirring is carried out. As typical methods for strengthening the stirring, a method in which a jet is collided with the emulsion surface of the photosensitive material as described in JP-A-62-183460, a method for enhancing a rotation effect by using a rotation means as described in JP-A-62-183461, a method in which a turbulence takes place on the emulsion surface by moving the photosensitive material while bringing a wiper blade provided in the liquid in contact with the emulsion surface, thereby enhancing a stirring effect, and a method for increasing the total circulation amount of the treating liquid can be mentioned. These means for enhancing the stirring are available for all of the bleaching liquid, the blixing liquid, and the fixing liquid. It may be considered that the enhancement of the stirring makes a supply of the bleaching agent and the fixer into the emulsion film in an accelerated speed, resulting in a rapid desilvering. The above-mentioned means for enhancing the stirring are more effective when a bleaching accelerator is used, which makes possible to drastically increase in the acceleration effect of bleaching and to solve the problem of the interference of the fixation due to the bleaching accelerator.

An automatic developing machine used in the present invention preferably possesses means for transporting a sensitive material as described in JP-A-60-191257, JP-A-60-191258, and JP-A-60-191259. As described in JP-A-60-191257, such means for transporting a sensitive material can drastically save the carrying over of the treating liquid from the pre-bath to the post-bath, and therefore, has a high effect for preventing the deterioration of the performance of the treating liquid. Such an effect is effective for shortening the treating periods in the stages and reducing the replenishment amount of the treating liquid.

After desilvering, the sensitive material of the present invention is subjected to a water washing stage and/or a stabilization stage.

The concentration of the final bath of the present invention is not more than 7,000 ppm. The term "final bath" used herein is a treating bath of the final treating stage, which is generally a stage immediately before the drying stage. Typically, a water washing bath or a stabilization bath can be mentioned. In the case where the stabilization is carried out after water washing, it is preferable that the final bath is a stabilization bath. In the case where the final bath is a multi-stage countercurrent, it is preferable that the final tank has a prescribed salt concentration. The term "salt content" used herein corresponds to the total concentration of the solutes dissolved in water, for example, the concentration of the various organic and inorganic components, which can easily be determined by measuring the weight of the residue after the distillation of the water.

Examples of the components in the final bath include various components such as the bleaching components and the fixing components carried from the previous bath, the surfactants, antifungal agents, chelating agents, image-stabilizers, various metal ions or anions contained in the aqueous preparation liquid, various components eluted from the photosensitive material (dyestuffs and sensitizing pigments, etc.), etc. The total final concentration in the final bath in the present invention is not more than 7,000 ppm, preferably from 7,000 to 20 ppm, and more preferably from 5,000 to 500 ppm.

If the concentration is higher or lower than the above range, no sufficient magnetically recording performance can be obtained.

For maintaining the salt concentration of the present invention, it is desirable to decrease the amount of the additive to be added to the final bath. Also, it is preferable for the water washing stage and/or the stabilization stage to select a multistage countercurrent manner having 2 to 4 stages. Moreover, it is a preferable embodiment for reducing the salt content in the final bath to carry out reverse osmosis processing (RO) in the final bath to clean the final bath. The RO technique is disclosed in JP-A-3-121448 and JP-A-3-46652.

As the RO treatment, a method in which the liquid is taken from the final bath, the permeated water is returned into the final bath, the concentrate is replenished to the fixing liquid or the blixing liquid or a method in which the liquid former than the final bath is taken, and permeated water is replenished to the final bath to be diluted, and the concentrate is returned to the bath in which the liquid has been taken is preferable.

A low pressure type RO device such as driven at 2 to 30 $kg/cm^2$ is preferable as the RO device. Examples of the RO membranes which can be used include cellulose acetate membranes, ethyl cellulose/polyacrylic acid membranes, polyacrylonitrile membranes, polybutylene carbonate membranes, etc. Typical examples include NTR-959 HR, NTR-950 UP, NTR-729 HF, NTR-7250, NTR-719 HF, NTR-7410, and NTR-7450 (all produced by Nitto kagaku Kogyo Co., Ltd.), UTC-70, UTC-40 HR, SC-3000, SU-700, SU-410, SU-600, SU-200S, and PEC-1000 (all produced by Toray), BW-30, HR-30, NF-30, NF-40 HF, NF-50, NF-70 (all produced by Film Tec (Dow)), Permasep B-9, B-10, B-15, C-1 (all produced by Du Pont), etc.

It is also one preferable embodiment that in order to maintain the salt concentration in the final bath an ion-exchange resin is brought into contact with the final bath. To be specific, a cation exchange resin, an anion exchange resin, an amphoteric ion exchange resin, or the like is brought into contact with the final bath to remove undesirable organic and inorganic components. Above all, a method in which a mixture of a cation exchange resin and an anion exchange resin is used or a method of using a amphoteric ion exchange resin is a preferable embodiment. The amount is from approximately 10 to 1,000 B.V. (bed volume), and the resin can be regenerated for reuse.

As for the method for bringing the ion exchange resin into contact with the final bath, a method in which a resin built-in cartridge is set in the circulation system to always bring the resin into contact and a method of setting a resin into the treating tank are preferred embodiments.

Examples of the resins to be used include, for a cation exchange resin, styrene type strongly basic resins, methacrylic acid type weakly basic resins, and acrylic acid type weakly basic resins; for anion exchange resins, styrene type strongly basic resins (dimethylamine type and methylamine type), methacrylic acid type weakly basic resins, and acrylic acid type weakly basic resins, etc. In addition, chelate resins and amphoteric ion exchange resins can also be used. With regard to the construction of the resin, a gel type, porous type, a carrier-carried type, or the like can be used.

Typical examples of the ion exchange resins include, but are not restricted to, Amberlite IR-120 B, IR-122, IR-124, XYT-1022, 200 C, 252, IRC-50, IRC-76, IRA-400, IRA-900, IRA-901, IRA-938, IRA-458, and IRA-958 (all produced by Rohm & Hass), Dowex SAR, MSA-2, 66, WGR-2 and A-1 (all produced by Dow Chemicals), Diaion SK-1B, SK-104, SK-110, PK-208, PK-216, WK-10, WK-11, SA-10A, SA-11A, SA-12A, PA-306, PA-312, PA-318, SA-20A, SA-21A, PA-406, PA-412, PA-418, WA-10, WA-20, WA-30, CR-10, CR-20, and CRB-02 (all produced by Mitsubishi Chemicals Co., Ltd.), etc.

It is preferred in terms of reducing the stain adhered to the magnetically recording surface and improving an S/N ratio that a compound represented by the following formula (I) is contained in the liquid for water washing or the stabilization bath.

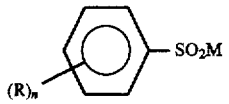

(I)

wherein R is a substituent on a benzene ring, n is an integer of from 0 to 5, and when n is 2 or more, R may be the same or different. Preferred substituents are alkyl groups having 1 to 3 carbon atoms, substituted alkyl groups having 1 to 3 carbon atom, alkoxy groups having 1 to 3 carbon atoms, hydroxyl group, amino group, nitro group, carboxylic acid group, sulfonic acid group, halogen atoms, phosphonic acid group, etc. Preferred examples of the substituents for the alkyl group are hydroxyl group, carboxylic acid group, sulfonic acid group, and the like. M is hydrogen, an alkali metal, an alkaline earth metal., ammonium, or amine. Preferred compounds of formula (I) are those wherein n is 1 or 2, and R is an alkyl group, a substituted alkyl group, an alkoxy group or amino group.

Typical examples of preferred compounds are described below, but are not restricted:

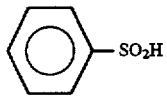

(I-1)

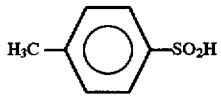

(I-2)

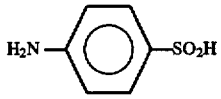

(I-3)

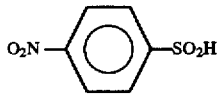

(I-4)

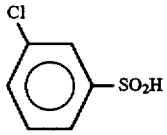

(I-5)

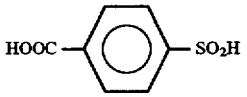

(I-6)

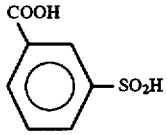

(I-7)

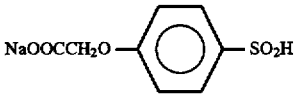

(I-8)

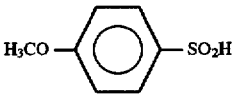

(I-9)

-continued

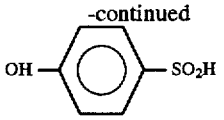

(I-10)

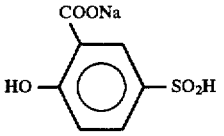

(I-11)

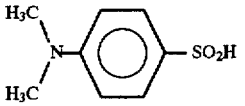

(I-12)

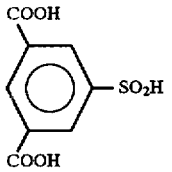

(I-13)

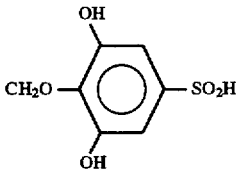

(I-14)

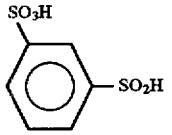

(I-15)

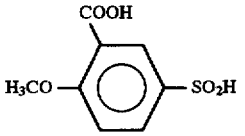

(I-16)

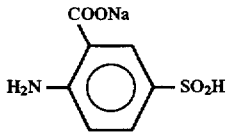

(I-17)

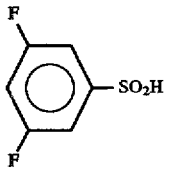

(I-18)

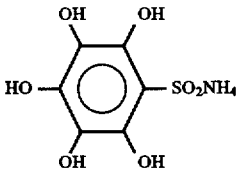

(I-19)

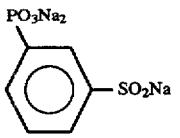

(I-20)

-continued (I-21)

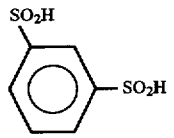

(I-22)

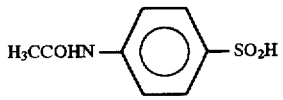

(I-23)

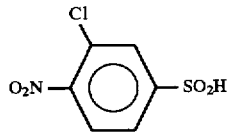

(I-24)

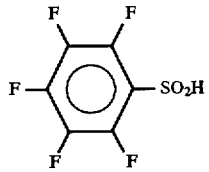

The amount of the compound to be added is from 0.001 to 0.2 mol, preferably from 0.005 to 0.1 mol. When the compound is added to the blixing liquid or the fixing liquid in the pre-bath to the water washing bath or stabilized bath and is brought into the water washing liquid or the stabilization liquid, this compound exhibits the effect there of. From the viewpoint of the fact that the stain on the magnetically recording surface tends to cause on the running treatment, the object can be attained even if a method for adding the compound only to the pre-bath to the water washing bath or stabilizing bath.

The replenishment amount of the liquid for water washing can be set at a wide range depending on the characteristics of the photosensitive material, the number of water washing tanks, the manner of replenishment such as countercurrent or direct flow, and other various conditions. The relation between the number of water washing tanks and the amount of the liquid is determined by a method described in Journal of the Society of Motion Picture and Television Engineers, Vol. 64, pp. 284–253 (May, 1955). According to the multistage countercurrent manner as described in the literature just described, the amount of the liquid for water washing can be drastically decreased, but an increase in the period for retaining in the tank growth bacteria, causing the problem that the float formed is adhered on the sensitive material, etc. In the treatment of a color sensitive material of the present invention, as means for solving such a problem, a method for reducing calcium ion and magnesium ion as described in JP-A-62-288838 can be effectively used. Also, isothiazolone compounds and thiabendazoles described in JP-A-57-8542, chlorine type disinfectants such as sodium chlorinated isocyanuric acid, benzotriazole, and disinfectants described in "Boukin Boukabizai no Kagaku (Chemistry of Sterilizer and Mildew Proofing agent)" ed, Hiroshi Horiguchi, (1986); "Biseibutsu no mekkin, sakkin boukabi Gijutsu (Microorganism Sterilization and Mildew Proofing Techniques)", (1982), Eiseigijutsu Kyokai, Sankyo Press; and "Boukin Boukabi Jiten "Dictionary for Sterilization and Mildew Proofing", eds. Kogyo Gijutsu kai and Nippon Boukin Boukabi Gakkai, (1986) can be used.

The pH values of the liquid for water washing and stabilization solution in the treatments of the photosensitive material of the present invention is from 4 to 9, and preferably from 5 to 8. The temperature can be set at a wide range depending on the characteristics and application of the sensitive material, etc., but is generally from 15 to 450° C., and preferably from 25° to 40° C. With regard to the period of the treatments, the sum period of the water washing and stabilization treatments is from approximately 5 seconds to 2 minutes, preferably from 15 to 45 minutes. In particular, in the above preferable period, the effect of the present invention is sufficiently exhibited.

Instead of water washing, the photosensitive material of the present invention can be directly treated with a stabilizing liquid. In such a stabilization treatment, all of the known methods as described in JP-A-57-8543, JP-A-58-14834, and JP-A-60-220345 can be used.

In the stabilization liquid, compounds which stabilize a pigment image, e.g., formalin, benzaldehydes such as m-hydroxybenzaldehyde, formaldehyde-bisulfate adducts, hexamethylene tetramine and derivatives thereof, hexahydrotriazine and derivatives thereof, dimethylol urea, N-methylol compounds such as N-methylolpyrazole, organic acids, pH buffering agents, etc., are contained. An preferred amount of the compounds added is from 0.001 to 0.02 mol per liter of the stabilization liquid, but they can be added within an range not exceeding the above salt concentration. The concentration of a free formaldehyde in the stabilization liquid is as low as possible since a small amount of formaldehyde gas is flown. In this context, as a dye image stabilizer, m-hydroxybenzaldehyde, hexamethylenetetramine, N-methylolazoles described in JP-A-4-270344 such as N-methylolpyrazole, and azolylmethylamines such as N,N'-bis(1,2,4-triazol-1-ylmethyl) piperazine as is described in JP-A-4-313753 are preferable. In particular, the joint use of azoles such as 1,2,4-triazole and azolylmethylamines or derivatives thereof such as 1,4-bis(1,2,4-triazol-1-ylmethyl)piperazine as described in JP-A-4-359249 (corresponding to European patent No. 519, 190 A2) is preferable in terms of the fact that the image stability is high, and vapor pressure of aldehyde becomes small. In the present invention, it is a preferred embodiment that such a an image stabilizer is not added in view of maintaining the salt concentration at a low degree.

Optionally, ammonium compounds such as ammonium chloride and ammonium sulfite, metal compounds such as Bi and Al compounds, optical brighteners, hardeners, alkanolamines described in U.S. Pat. No. 4,786,583, the preservatives which can be contained in the above-mentioned fixing liquid and bleaching and fixing liquid, such as sulfine compounds described in JP-A-1-231051 can be added.

In order to prevent water droplet marks on the photosensitive material caused by drying after the treatment, various surfactants may be contained in the liquid for water washing and/or the stabilization liquid. Of these, the use of a nonionic surfactant is preferable, with an alkylphenolethylene oxide adduct being more preferred. As the alkylphenol, octyl-, nonyl-, dodecyl-, or dinoylphenol is preferable, and the molar number of ethylene oxide added is preferably from 8 to 14. In addition, the use of a silicon surfactant having a high defoaming effect is also preferable.

In the liquid for water washing and/or the stabilization liquid, various chelators can be contained. Preferred chelators include aminopolycarboxlic acids such as ethylenediamine tetraacetic acid and diethyltriamine pentaacetic acid, organic phosphonic acids such as 1-hydroxyethylidene-1,1-diphosphonic acid, N,N,N'-trimethylenephosphonic acid, and diethylenetriamine-N,N,N',N'-tetramethylenephosphonic acid, and hydrolyzed products of maleic anhydride described in European patent No. 345,172 Al, etc.

The overflow liquid accompanying with the replenishment of the liquid for water washing and/or the stabilization liquid may be reused in any other stage such as the stage for desilvering.

In the case where the treatment liquid is concentrated by distillation in the treatment using an automatic developing machine, it is preferable for adjusting the concentration by distillation to replenish an adequate amount of water, an adjusting liquid or a treatment adjusting liquid. Although a method for replenishing water is not specifically restricted, a method described in JP-A-1-254959 and JP-A-1-254960 in which a monitor tank other than the bleaching tank is provided, an amount of water distilled in the monitor tank is determined, from which the amount of water distilled in the bleaching tank is calculated, and water is replenished in proportional to the amount of water distilled, or a method for adjusting the distillation using a liquid level sensor or an overflow sensor described in JP-A3-248155, JP-A-3-249644, JP-A-3-249645 and JP-A-3-249646 is preferable. Although the water for adjusting the amount of distillation may be tap water, deionized water or sterilized water which is preferably used in the stage for water washing is preferably used.

The sensitive material of the present invention will now be described.

The present invention is applied to any photosensitive material having the above-mentioned transparent substrates. The present invention is preferably applied to a color negative film color negative film or a color reversal film.

The silver halide emulsions, other materials (such as additives), and photograph-constructing layers (layer arrangement, etc.) and the treatments applicable to the treatment of the sensitive material and the additive for the treatment which are applied in the present invention are preferably those described in the following patent publications, in particular EP 0,355,660 A2 (Japanese patent application No.1-107011). Photographic construction elements, etc.

| Photographic Elements | JP-A 62-215272 | JP-A 2-33144 | EP 0,355,660A2 |
|---|---|---|---|
| Silver Halide Emulsions | From page 10, right upper column, line 6 to page 12, left lower column, line 5; and from page 12, right lower column, line 4 to page 13, left upper column, line 17 | From page 28, right upper column, line 16 to page 29, right lower column, line 11; and page 30, lines 2 to 5 | From page 45, line 53 to page 47, line 3; and page 47, lines 20 to 22 |
| Silver Halide Solvents | Page 12, left lower column, lines 6 to 14; and from page 13, left upper column, line 3 from below to page 18, left lower column, last line | — | — |
| Chemical Sensitizers | Page 12, from left lower column, line 3 from below to right lower column, line 5 from below; and from page 18, right lower column, line 1 to page 22, right upper column, line 9 from below | Page 29, right lower column, line 12 to last line | Page 47, lines 4 to 9 |
| Color Sensitizers (Color Sensitizing Methods) | From page 22, right upper column, line 8 from below to page 38, last line | Page 30, left upper column, lines 1 to 13 | Page 47, lines 10 to 15 |
| Emulsion Stabilizers | From page 39, left upper column, line 1 to page 72, right upper column, last line | Page 30, from left upper column, line 14 to right upper column, line 1 | Page 47, lines 16 to 19 |
| Development Promoters | From page 72, left lower column, line 1 to page 91, right upper column, line 3 | — | — |
| Color Couplers (Cyan, Magenta and Yellow Couplers) | From page 91, right upper column, line 4 to page 121, left upper column, line 6 | From page 3, right upper column, line 14 to page 18, left upper column, last line; and from page 30, right upper column, line 6 to page 35, right lower column, line 11 | Page 4, lines 15 to 27; from page 5, line 30 to page 28, last line; page 45, lines 29 to 31; and from page 47, line 23 to page 63, line 50 |
| Coloring Enhancers | From page 121, left upper column, line 7 to page 125, right upper column, line 1 | — | — |
| Ultraviolet Absorbents | From page 125, right upper column, line 2 to page 127, left lower column, last line | From page 37, right lower column, line 14 to page 38, left upper column, line 11 | Page 65, lines 22 to 31 |
| Anti-fading Agents (Color Image Stabilizers) | From page 127, right lower column, line 1 to page 137, left lower column, line 8 | From page 36, right upper column, line 12 to page 37, left upper column, line 19 | From page 4, line 30 to page 5, line 23; from page 29, line 1 to page 45, line 25; page 45, lines 33 to 40; and page 65, lines 2 to 21 |
| High Boiling Point and/or Low Boiling Point Organic Solvents | From page 137, left lower column, line 9 to page 144, right upper column, last line | From page 35, right lower column, line 14 to page 36, left upper column, line 4 from below | Page 64, lines 1 to 51 |
| Dispersing Methods of Photographic Additives | From page 144, left lower column, line 1 to page 146, right upper column, line 7 | From page 27, right lower column, line 10 to page 28, left upper column, last line; and from page 35, right | From page 63, line 51 to page 64, line 56 |

-continued

| Photographic Elements | JP-A 62-215272 | JP-A 2-33144 | EP 0,355,660A2 |
|---|---|---|---|
| | | lower column, line 12, to page 36, right upper column, line 7 | |
| Hardening Agents | From page 146, right upper column, line 8 to page 155, left lower column, line 4 | — | — |
| Developing Agent Precursors | Page 155, from left lower column, line 5 to right lower column, line 2 | — | — |
| Development Inhibitor Releasing Compounds | Page 155, right lower column, lines 3 to 9 | — | — |
| Supports | From page 155, right lower column, line 19 to page 156, left upper column, line 14 | From page 38, right upper column, line 18 to page 39, left upper column, line 3 | From page 66, line 29 to page 67, line 13 |
| Constitution of Photographic Layers | Page 156, from left upper column, line 15 to right lower column, line 14 | Page 28, right upper column, lines 1 to 15 | Page 45, lines 41 to 52 |
| Dyes | From page 156, right lower column, line 15 to page 184, right lower column, last line | Page 38, from left upper column, line 12 to right upper column, line 7 | Page 66, lines 18 to 22 |
| Color Mixing Preventing Agents | From page 185, left upper column, line 1 to page 188, right lower column, line 3 | Page 36, right lower column, lines 8 to 11 | From page 64, line 57 to page 65, line 1 |
| Gradation Adjusting Agents | Page 188, right lower column, lines 4 to 8 | — | — |
| Stain Inhibitors | From page 188, right lower column, line 9 to page 193, right lower column, line 10 | Page 37, from left upper column, last line to right lower column, line 13 | From page 65, line 32 to page 66, line 17 |
| Surfactants | From page 201, left lower column, line 1 to page 210, right upper column, last one | From page 18, right upper column, line 1 to page 24, right lower column, last line; and page 27, from left lower column, line 10 from below to right lower column, line 9 | — |
| Fluorine-containing Compounds (as antistatic agents, coating aids, lubricants, and anti-blocking agents) | From page 210, left lower column, line 1 to page 222, left lower column, line 5 | From page 25, left upper column, line 1 to page 27, right lower column, line 9 | — |
| Binders (hydrophilic colloids) | From page 222, left lower column, line 6 to page 225, left upper column, last line | Page 38, right upper column, lines 8 to 18 | Page 66, lines 23 to 28 |
| Tackifiers | From page 225, right upper column, line 1 to page 227, right upper column, line 2 | — | — |
| Antistatic Agents | From page 227, right upper column, line 3 to page 230, left upper column, line 1 | — | — |
| Polymer Latexes | From page 230, left upper column, line 2 to page 239, last line | — | — |
| Mat Agents | Page 240, from left upper column, line 1 to right upper column, last line | — | — |
| Photographic Processing Methods (Processing steps and additives) | From page 3, right upper column, line 7 to page 10, right upper column, line 5 | From page 39, left upper column, line 4 to page 42, left upper column, last line | From page 67, line 14 to page 69, line 28 |

Note) The portions quoted in JP-A-62-215272 contain contents amended in the amendment filed on May, 16, 1987 described in the last of this publication.
Of the above couplers, so-called short wave form yellow couplers described in JP-A-63-231451, JP-A-63-123047, JP-A-63-241547, JP-A-1-173499, JP-A-1-213648, and JP-A-1-250944 can be preferably used as the yellow coupler.

The silver halide emulsions which can be used in the present invention may be emulsion having various halogen compositions such as silver iodobromide, silver iodochloride, silver iodochlorobromide, silver chlorobromide, silver bromide, and silver chloride. In particular, they preferably have a layer containing a silver iodobromide emulsion, and the use of an emulsion having an iodo content of from 0.1 to 10 mol % is preferred. Although the amount of solver applied is not specifically restricted, it is preferably from approximately 2 to 10 g/m$^2$, more preferably from 3 to 8 g/m$^2$.

The sensitive material of the present invention may contain various couplers, and details are listed in Table.

Furthermore, as the cyan couplers, diphenylimidazole cyan couplers described in JP-A-2-33144, 3-hydroxypyridine cyan couplers described in European patent No. EP 0,333,185 A2 (above all, 4 equivalent coupler listed as typically exemplified coupler (42) having a chlorine atom releasing group to be 2 equivalent, couplers (6) and (9) listed as typically examples are particularly preferable), and cyclic active methylene cyan couplers described in JP-A-64-32260 (above all coupler Nos. 3, 8, 34 listed as typical examples are particularly preferable) are preferably used.

As the magenta couplers, it is preferable to contain at least one coupler selected from the following formulae (II) and (III):

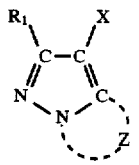

(II)

wherein $R_1$ is a hydrogen atom or a substituent, Z is a non-metal atomic group required for forming a 5-membered azole ring containing 2 to 4 nitrogen atoms, said azole may possess a substituent (including a condensed ring), and X is hydrogen or a group which can be released during the coupling reaction of an oxidized substance of a developing agent.

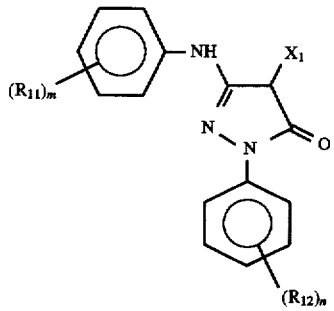

(III)

wherein $R_{11}$, is a substituent, $R_{12}$ is an electron attractive group, m is an integer of from 1 to 5, when m is 2 or more, $R_1$, may be the same or different, n is an integer of from 2 to 5, $R_{12}$ may be the same or different, $X_1$ is a group which can be released during the coupling reaction of an oxidized substance of a developing agent, and dimer or polymer may be formed at $R_{11}$, $R_{12}$ or $X_1$ via di- or multivalent group.

It can be specially said that by using a coupler represented by formulae (II) or (III) in the present invention, water washing and/or stabilization baths can be commonly used without impairing image storage properties (increase in yellow stain and light color fading) and, at the same time, the period can be shortened.

The coupler represented by formula (II) will now be described in detail. Preferred skeletons among the coupler skeleton represented by formula (II) are 1H-imidazo[1,2-b] pyrazole, 1-H-pyrazolo[1,5-b][1,2,4]-triazole, 1-H-pyrazolo [5,1-c][1,2,4]-triazole, 1-H-pyrazolo[1,5-d]tetrazole, and 1-H-pyrazolo[1,5-a]benzimidazole.

In formula (II), the substituents represented by $R_1$ are not specifically restricted, but groups such as alkyl, aryl, anilino, acylamino, sulfonamide, alkylthio, alkenyl, and cycloalkyl groups can be typically mentioned. In addition, halogen atoms, cycloalkenyl, alkynyl, heterocyclic rings, sulfonyl, sulfinyl, phosphonyl, acyl, carbamoyl, sulfamoyl, cyano, alkoxy, aryloxy, heterocyclic oxy, siloxy, acyloxy, carbamoyloxy, amino, alkylamino, imido, ureido, sulfamoylamino, alkoxycarbonylamino, aryloxycarbonylamino, heterocyclic thio groups as well as spiro compound residues and organic hydrocarbon compound residues can also be mentioned.

The alkyl groups represented by $R_1$ preferably have 1 to 32 carbon atoms, and may be straight or branched chain.

The aryl group represented by $R_1$ is preferably phenyl group.

The acylamino groups represented by $R_1$ include alkylcarbonylamino groups, and arylcarbonylamino groups.

The sulfonamido groups represented by $R_1$ include alkylsulfonylamino groups and arylsulfonylamino groups.

As the alkyl moieties and aryl moieties in the alkylthio groups and arylthio groups represented by $R_1$, those described in the alkyl groups and aryl groups represented by R can be mentioned.

The alkenyl groups represented by $R_1$ have 2 to 32 carbon atoms, the cycloalkenyl groups have 3 to 12 carbon atoms, and preferably 5 to 7, and these alkenyl groups may be straight or branched.

The cycloalkenyl groups represented by $R_1$ have 3 to 12 carbon atoms, preferably 5 to 7 carbon atoms.

Examples of the sulfonyl groups represented by $R_1$ include alkylsulfonyl groups, arylsulfonyl groups, etc.; the sulfinyl groups include alkylsulfinyl groups, arylsulfinyl groups, etc.; the phosphonyl groups include alkylphosphonyl groups, alkoxyphosphyl group, aryloxyphosphonyl group, arylphosphonyl groups; the acyl groups include alkylcarbonyl groups, arylcarbonyl groups, etc.; the carbamoyl groups include alkylcarbamoyl groups, arylcarbamoyl groups, etc.; sulfamoyl groups include alkylsulfamoyl groups, arylsulfamoyl group, etc.; the acyloxy groups include alkylcarbonyloxy groups, arylcarbonyloxy groups, etc.; carbamoyloxy groups include alkylcarbamoyloxy groups, arylcarbamoyloxy groups, etc.; the ureido groups include alkylureido groups, arylureido groups, etc.; the sulfamoylamino groups include alkylsulfamoylamino groups, arylsulfamoylamino groups, etc.; the heterocyclic groups are preferably 5 to 7-membered groups, and typically include 2-furyl group, 2-thienyl group, 2-pyrimidyl group, 2-benzothiazolyl group, etc.; the heterocyclic oxy groups are preferably 5 to 7-membered heterocyclic oxy groups, such as 3.,4,5,6-tetrahydropyranyl-2-oxy group, and 1-phenyltetrazole-5-oxy group; the heterocyclic thio groups are preferably 5 to 7-membered heterocyclic thio groups, such as 2-pyridylthio group, benzothiazolylthio group, and 2,4-diphenoxy-1,3,5-triazole-6-thio group; the siloxy groups include trimethylsiloxy group, triethylsiloxy group, dimethylbutylsiloxy group, etc.; imido groups include succinic imido group, 3-heptadecylsuccinic imido group, phthalimido groups, glutarylimido group, etc.; the spiro compound residues include spiro[3,3]heptan-1-yl, and the organic hydrocarbon compound residue include bicyclo[2,2,1] heptan-1-yl group, tricyclo-[3,3,1,$1^{3,7}$ ]decan-1-yl, 7,7-dimethyl-bicyclo[2,2,1]heptan-1-yl, etc.

Examples of the groups represented by X which can be released during the coupling reaction with the oxidized substance of the developing agent include halogen atoms (such as chlorine atom, bromine atom, and fluorine atom), alkoxy, aryloxy, heterocyclic oxy, acyloxy, sulfonyloxy, alkoxycarbonyloxy, aryloxycarbonyl, alkyloxalyloxy, alkylthio, arylthio, heterocyclic thio, alkyloxycarbonylthio, acylamino, sulfonamide, nitrogen-containing heterocyclic groups which are bonded by N atom, alkyloxycarbonylamino, aryloxycarbonylamino, carboxyl groups, etc. Of them, a halogen atom is more preferred, and a chlorine atom is most preferable.

The nitrogen-containing heterocyclic rings formed by Z include pyrazole rings, imidazole rings, triazole, tetrazole rings, etc., and as the substituents which may be possessed by these rings, those described in RI can be mentioned.

Of the pyrazoloazole couplers represented by formula [M], imidazo[1,2-b]pyrazoles described in U.S. Pat. No. 4,500,630, pyrazolo[1,5-b][1,2,4]triazoles described in U.S. Pat. No. 4,540,654, and pyrazolo[5,1-c][1,2,4]triazoles described in U.S. Pat. No. 3,725,067 are preferable in terms of absorption characteristics of the colored dye, with pyrazolo[1,5-b][1,2,4]triazole being particularly preferable in terms of light fastness.

For the detail of the substituent $R_1$, X and the substituents for the azole rings represented by Z, for example, there is a description on the 2nd column, line 41 to the 8th column, line 27 of U.S. Pat. 4,540,654. Preferable are pyrazoloazole couplers in which a branched alkyl group is directly connected to the pyrazorotriazole ring in the 2-, 3-, or 6-position as described in JP-A-61-65245 and JP-B-2-60167, pyrazoloazole couplers containing sulfonamide group in the molecule thereof as described in JP-A-61-65246, pyrazoloazole couplers having an alkoxyphenylsulfonamido ballast group as described in JP-A-61-147254, pyrazolotriazole couplers having an alkoxy group or an group in the 6-position as described in JP-A-62-209457 and JP-A-63-307453, pyrazolotriazole couplers having phenylene group in the 2-position as described in JP-A-63-41851, and pyrazoloazole couplers having carbonamido group in molecule thereof as described in Japanese patent application No. Hei.1-22279.

Of these couplers, typical examples of the pyrazoloazole couplers will be listed below:

(I-1)

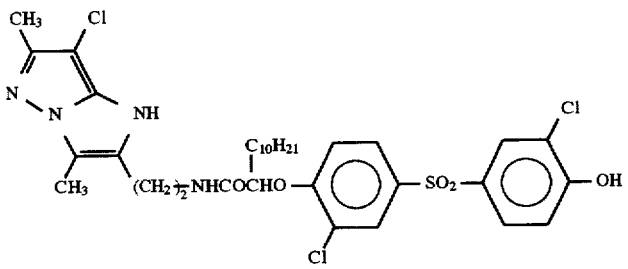

(I-2)

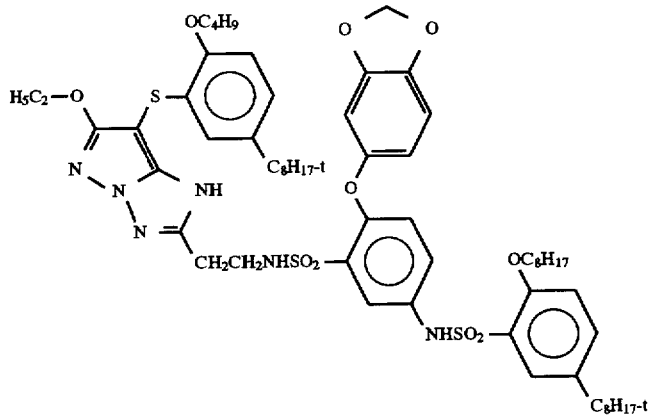

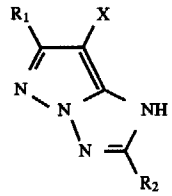
| Compound | $R_1$ | $R_2$ | X |
|---|---|---|---|
| II-3 | $CH_3-$ | 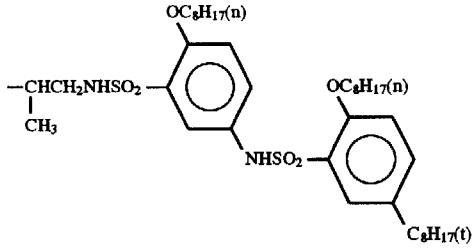 | Cl |
| II-4 | $CH_3-$ | 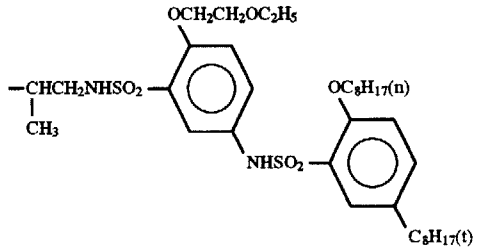 | Cl |
| II-5 | " | 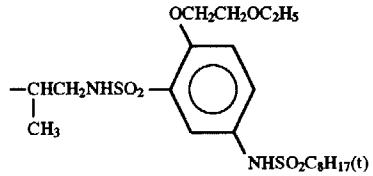 | " |
| II-6 | " | 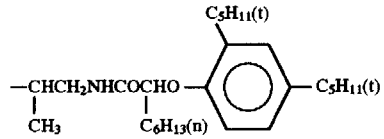 | " |

-continued
| | | | |
|---|---|---|---|
| II-7 | " | 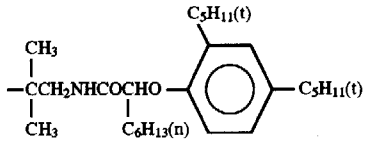 | " |
| II-8 | 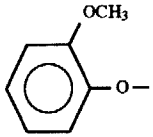 | 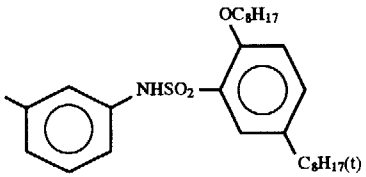 | 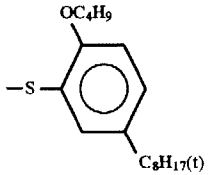 |
| II-9 | 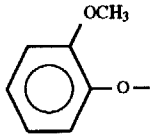 | 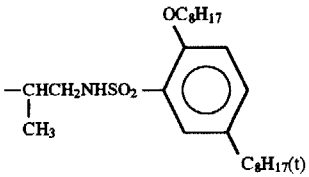 | Cl |
| II-10 | 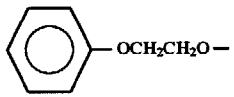 | 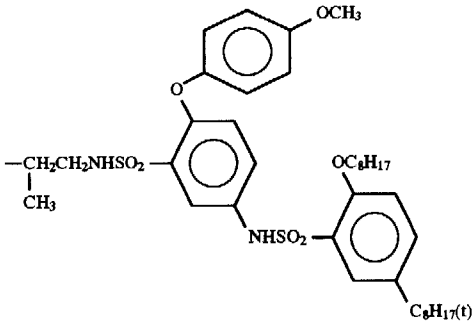 | 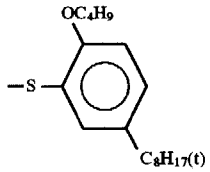 |
| II-11 | 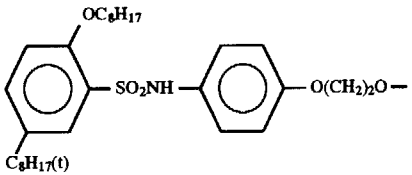 | 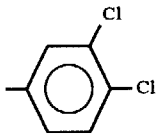 | 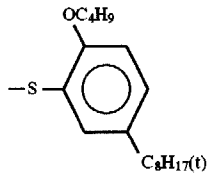 |

-continued
| | | | |
|---|---|---|---|
| II-12 | 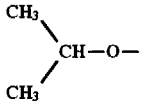 | 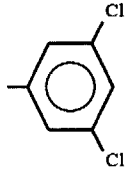 | 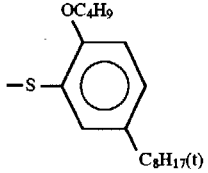 |
| II-13 | $C_2H_5-$ | 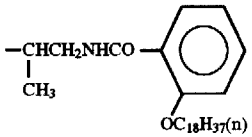 | 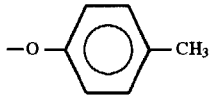 |
| II-14 | $CH_3-$ | 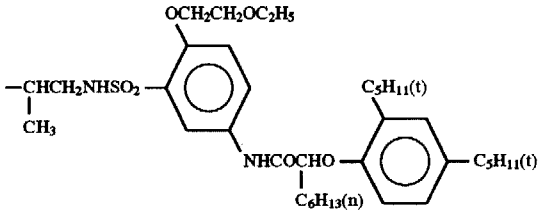 | Cl |
| II-15 | 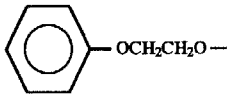 | 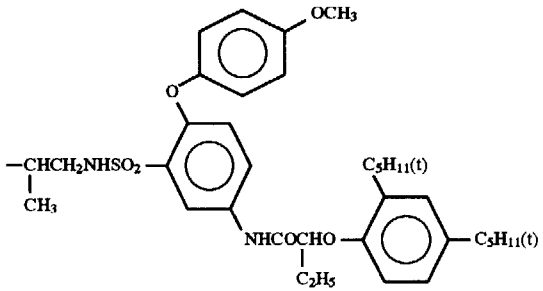 | 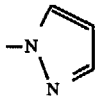 |
| II-16 | 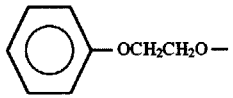 | 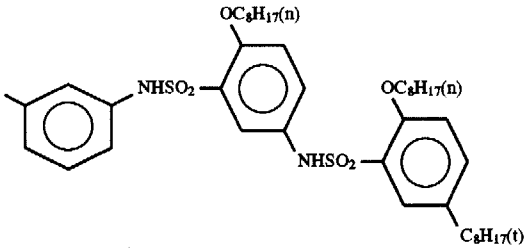 | 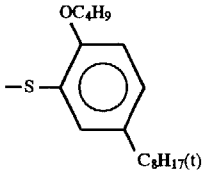 |

-continued
| | | | |
|---|---|---|---|
| II-17 | 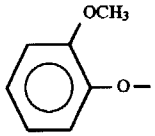 | 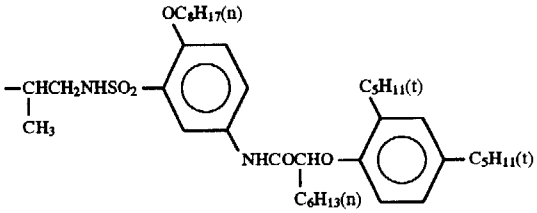 | Cl |
| II-18 | 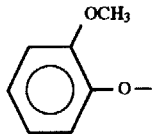 | 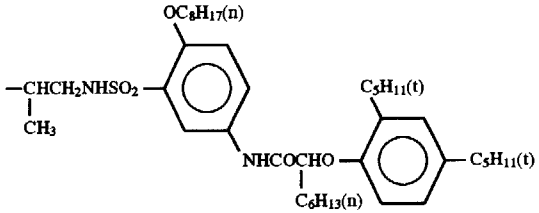 | 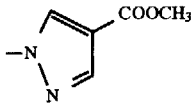 |
| II-19 | 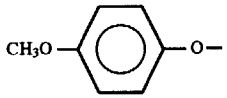 | 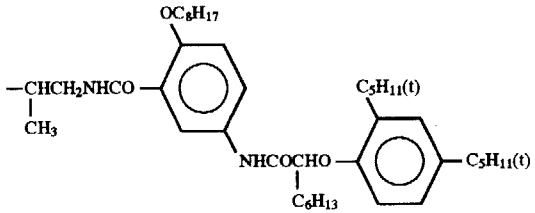 | 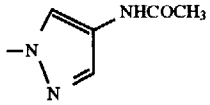 |
| II-20 | 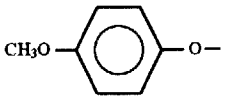 | 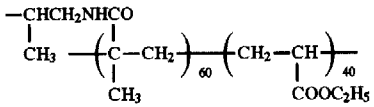 | 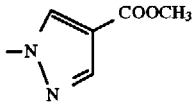 |
| II-21 | 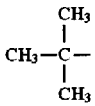 | 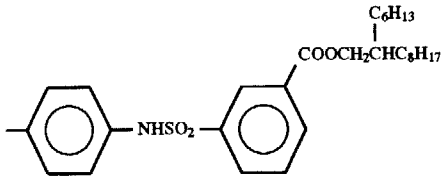 | Cl |

-continued
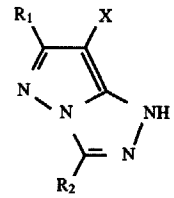
| Compound | $R_1$ | $R_2$ | X |
|---|---|---|---|
| II-22 | $CH_3$ | 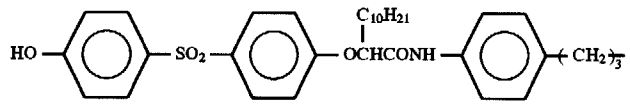 | Cl |
| II-23 | " | 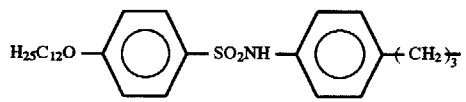 | " |
| II-24 | " | 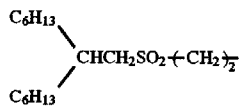 | " |
| II-25 | 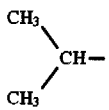 | 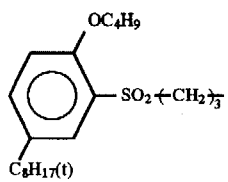 | Cl |
| II-26 | $CH_3-$ | 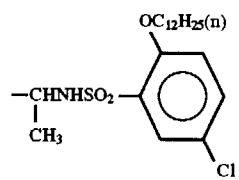 | " |

-continued
| | | | |
|---|---|---|---|
| II-27 | $C_2H_5-$ | 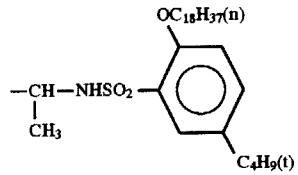 | 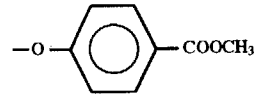 |
| II-28 | $C_2H_5-$ | 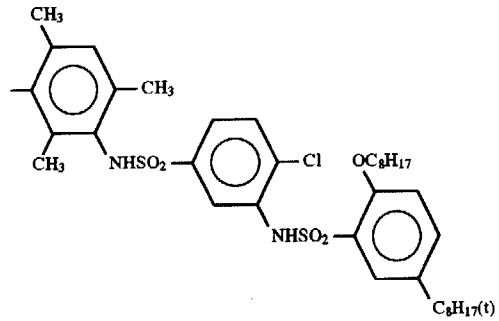 | 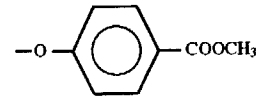 |
| II-29 | $CH_3-$ | 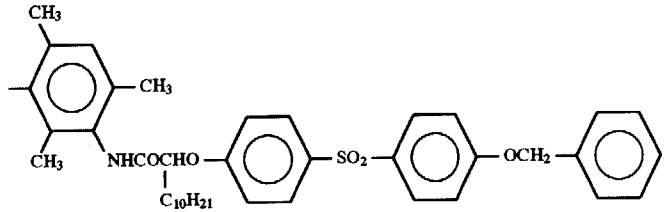 | Cl |
| II-30 | " | 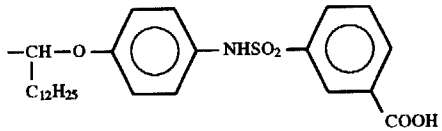 | " |
| II-31 | $CH_3$ | 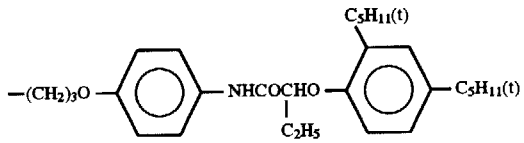 | Cl |

-continued
| | | | |
|---|---|---|---|
| II-32 | $C_2H_5-$ | 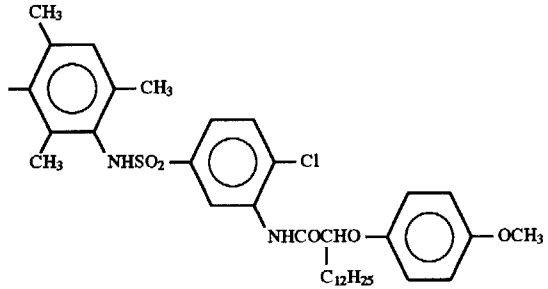 | 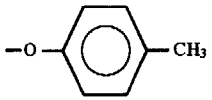 |
| II-33 | 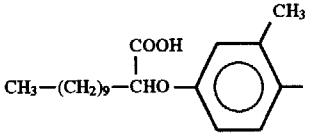 | 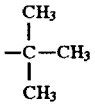 | Cl |
| II-34 | 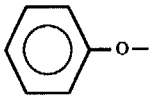 | 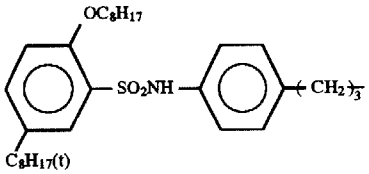 | Cl |
| II-35 | 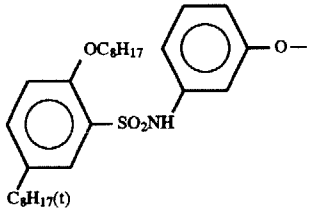 | $H_5C_2-$ | " |
| II-36 | 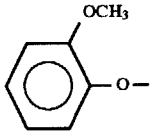 | $H_5C_2OOC-$ | 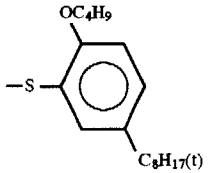 |

-continued
| | | | |
|---|---|---|---|
| II-37 | 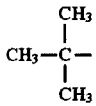 | 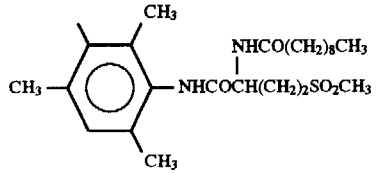 | Cl |
| II-38 | 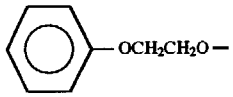 | 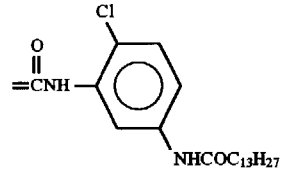 | 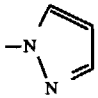 |

The-couplers represented by formula (II) can be synthesized according to a method of U.S. Pat. Nos. 4,540,654 and 4,705,863, JP-A-61-65245, JP-A-62-209457, JP-A62-249155, JP-B-47-27411, U.S. Pat. No. 3,725,067, or the like.

Now, $R_{11}$, $R_{12}$ and $X_1$ in the couplers represented by formula (III) will be described in detail.

$R_{11}$, is a substituent, and specifically a halogen atom, an alkyl group, an aryl group, a heterocyclic ring, cyano group, hydroxy group, nitro group, carboxy group, sulfo group, amino group, an alkoxy group, an aryloxy group, an acylamino group, an alkylamino group, an anilino group, a ureido group, a sulfamoyl amino group, an alkylthio group, an arylthio group, an alkoxycarbonylamino group, a sulfonamido group, a carbamoyl group, a sulfamoyl group, a sulfonyl group, an alkoxycarbonyl group, a heterocyclicoxy group, an azo group, an acyloxy group, a carbamoyloxy group, a silyloxy group, an aryloxycarbonylamino group, an imido group, a heterocyclic thio group, a sulfinyl group, a phosphonyl group, an aryloxycarbonyl group, an acyl group, and an azolyl group, and $R_{11}$ may form a bis-form through a divalent group.

More specifically, $R_{11}$, is hydrogen atom; a halogen atom (e.g., chlorine atom or bromide atom); an alkyl group (e.g., an straight or branched alkyl group, aralkyl group, alkenyl group, alkynyl group, cycloalkyl group or cycroalkenyl group having 1 to 32 carbon atoms, specifically methyl, ethyl, propyl, isopropyl, t-butyl, tridecyl, 2-methanesulfonylethyl, 3-(3-pentadecylphenoxy)propyl, 3-{4-{2-[4-(4-hydroxyphenylsulfonyl)phenoxy]dodecanamido}-phenyl}propyl, 2-ethoxytridecyl, trifluoromethyl, cyclopentyl, or 3-(2,4-di-t-amylphenoxy)propyl group); an aryl group (e.g., phenyl, 4-t-butylphenyl, 2,4-di-t-amylphenyl, or 4-tetradecanamidophenyl), a heterocyclic ring (e.g., 2-furyl, 2-thienyl, 2-pyrimidyl, or 2-benzothiazolyl), cyano group, hydroxy group, nitro group, carboxy group, amino group, an alkoxy group (e.g., methoxy, ethoxy, 2-methoxyethoxy, 2-dodecylethoxy, or 2-methanesulfonylethoxy), an aryloxy group (e.g., phenoxy, 2-methylphenoxy, 4-t-butylphenoxy, 3-nitrophenoxy, 3-t-butyloxycarbamoylphenoxy, or 3-methoxycarbamoyl), an acylamino group (e.g., acetamido, benzamido, tetradecanamido, 2-(2,4-di-t-amylphenoxy)butanamido, 2-(3-t-butyl-4-hydroxyphenoxy)butanamido, or 2-{4-(4-hydroxyphenylsulfonyl)phenoxy}decanamido), an alkylamino group (e.g., methylamino, butylamino, dodecylamino, diethylamino, or methylbutylamino), an anilino group (e.g, phenylamino, 2-chloroanilino, 2-chloro-5-tetradecaneaminoanilino, 2-chloro-5-tetradecaneaminoanilino, 2-chloro-5-dodecyloxycarbonylanilino, N-acetylanilino, or 2-chloro-5-{2-(3-t-butyl-4-hydroxyphenoxy)decanamido}anilino), a ureido group (e.g., phenylureido, methylureido, or N,N-dibutylureido), a sulfamoyl group (e.g., N,N-dipropylsulfamoylamino or N-methyl-N-decylsulfamoylamino), an alkylthio group (e.g, methylthio, octylthio, tetradecylthio, 2-phenoxyethylthio, 3-phenoxypropylthio, or 3-(4-t-butylphenoxy)propylthio), an arylthio group (e.g., phenylthio, 2-butoxy-5-t-octylthio, 3-pentadecylphenylthio, 2-carboxyphenylthio, or 4-tetradecanamidophenylthio), an alkoxycarbonylamino group (e.g., methoxycarbonylamino or tetradecyloxycarbonylamino), a sulfonamido group (e.g., methanesulfonamido, hexadecanesulfonamido, benzenesulfonamide, p-toluenesulfonamido, octadecanesulfonamido, or 2-methoxy-5-t-butylbenzenesulfonamido), a carbamoyl group (e.g, N-ethylcarbamoyl, N,N-dibutylcarbamoyl, N-(2-dodecyloxyethyl)carbamoyl, N-methyl-N-dodecylcarbamoyl, or N{3-(2,4-di-t-amylphenoxy)propyl}carbamoyl), a sulfamoyl group (e.g., N-ethylsulfamoyl, N,N-dipropylsulfamoyl, N-(2-dodecyloxyethyl)sulfamoyl, N-ethyl-N-dodecylsulfamoyl, or N,N-diethylsulfamoyl), a sulfonyl group (e.g., methanesulfonyl, octanesulfonyl, benzenesulfonyl, or toluenesulfonyl), an alkoxycarbonyl group (e.g., methoxycarbonyl, butoxycarbonyl, dodecyloxycarbonyl, or octadecyloxycarbonyl), a heterocyclic oxy group (e.g., 1-phenyltetrazole-5-oxy or 2-tetrahydropyranyloxy), an azo group (e.g., phenylazo, 4-methoxyphenylazo, 4-pivaloylaminophenylazo), or 2-hydroxy-4-propanoylphenylazo), an acyloxy group (e.g., acetoxy), a carbamoyloxy group (e.g., N-methylcarbamoyloxy or N-phenylcarbamoyloxy), a silyloxy group (e.g., trimethylsilyloxy or dibutylmethylsilyloxy), an aryloxycarbonylamino group (e.g., phenoxycarbonylamino), an imido group (N-succinimido, N-phthalimido, or 3-octadecenylsuccinido), a heterocyclic thio group (e.g, 2-benzothiazolylthio, 2,4-diphenoxy-1,3-5-triazole-6-thio, or 2-pyridylthio), a sulfinyl group (e.g, dodecanesulfinyl, 3-pentadecylphenylsulfinyl, or 3-phenoxypropylsulfinyl), a phosphonyl group (e.g., phenoxyphosphonyl, octyloxyphosphonyl, or phenylphosphonyl), an aryloxycarbonyl group (e.g., phenoxycarbonyl), an acyl group (e.g, acetyl, 3-phenylpropanoyl, benzoyl, or 4-dodecyloxybenzolyl), and an azolyl group (e.g, imidazolyl, pyrazolyl, 3-chloro-pyrazol-1-yl, or triazolyl).

Of these substituents, the groups which can possess a substituent may possess an organic substituent which is connected by carbon atom, oxygen atom, nitrogen atom or sulfur atom or may further possess a halogen atom. Preferred $R_{11}$ of these substituents are halogen atoms, alkoxy groups, aryloxy groups, acylamino groups, ureido groups, sulfamoyl groups, alkoxycarbonylamino groups, sulfonamido groups, carbamoyl groups, sulfamoyl groups, alkoxycarbonyl groups, carbamoyloxy groups, imido groups, and acyl groups.

$R_{12}$ is an electron attractive group and specifically is a halogen atom, an aryl group, a heterocyclic group, cyano group, nitro group, carboxy group, sulfo group, an acylamino group, a ureido group, a sulfamoylamino group, an alkylthio group, an arylthio group, an alkoxycarbonylamino group, a sulfonamido group, a carbamoyl group, a sulfamoyl group, a sulfonyl group, an alkoxycarbonyl group, an imido group, a heterocyclic thio group, a sulfinyl group, a phosphonyl group, an acyl group, or an azolyl group. More specifically, these groups have the same meaning as those typically described in $R_{11}$. Preferably, $R_{12}$ is a halogen atom, an acylamino group, or carbamoyl group, with a halogen atom being more preferable. n is preferably from 3 to 5. m is preferably from 1 to 3.

$X_1$ is a group which can be released during the coupling reaction of the oxidized developing agent. To be specific, the group which can be released is a halogen atom, an alkoxy group, an aryloxy group, an acyloxy group, an alkyl- or arylsulfonyloxy group, an acylamino group, an alkyl- or arylsulfonamido group, an alkoxycarbonyloxy group, an aryloxycarbonyloxy group, an alkyl-, aryl- or heterocyclic thio group, a carbamoylamino group, a 5- or 6-membered nitrogen-containing heterocyclic group, an imido group, an arylazo group, etc., and these groups may be further substituted by the group permitted in $R_{11}$.

More specifically, $X_1$ is a halogen atom (e.g., fluorine atom, chlorine atom or bromide atom), an alkoxy group (e.g., ethoxy, dodecyloxy, methoxyethylcarbamoylmethoxy, carboxypropyloxy, methylsulfonylethoxy, or ethoxycarbonylmethoxy), an aryloxy group (e.g., 4-methylphenoxy, 4-chlorophenoxy, 4-methoxyphenoxy, 4-carboxyphenoxy, 3-ethoxycarboxyphenoxy, 3-acetylaminophenoxy, or 2-carboxyphenoxy), an acyloxy group (e.g. acetoxy, tetradecanoyloxy, or benzoyloxy), an alkyl- or aryloxy group (e.g., methanesulfonyloxy or toluenesulfonyloxy), an acylamino group (e.g., dichloroacetylamino or heptafluorobutyrylamino), an alkyl- or arylsulfonamido group (e.g., methanesulfonamino, trifluoromethanesulfonamino, or p-toluenesulfonamino), an alkoxycarbonyloxy group (e.g., ethoxycarbonyloxy or benzyloxycarbonyloxy), an aryloxycarbonyloxy group (e.g., phenoxycarbonyloxy), an alkyl-, aryl- or heterocyclic thio group (e.g., dodecylthio, 1-carboxydodecylthio, phenylthio, $^2$-butoxy-5-t-octylphenylthio, or tetrazolylthio), a carbamoylamino group (e.g. N-methylcarbamoylamino or N-phenylcarbamoylamino), a 5- or 6-membered nitrogen-containing heterocyclic group (e.g. imidazolyl, pyrazolyl group, triazolyl, tetrazolyl, or 1,2-dihydro-2-oxo-1-pyridyl), an imido group (e.g., succinimido or hydantoinyl), an arylazo group (e.g. phenylazo or 4-methoxyphenylazo), etc. In addition, XI may be in a bis-type coupler obtained by condensating 4 equivalent coupler with aldehydes or ketones as a releasing group bonding via a carbon atom. Moreover, $X_1$ may contain a group which is photographically useful such as a developing inhibitor or a developing accelerator. Preferred $X_1$ is a halogen atom, an alkoxy group, an aryloxy group, an alkyl- or arylthio group, a 5- or 6-membered nitrogen-containing heterocyclic group in which nitrogen atom bonded to a coupling active position, with an arylthio being most preferable.

In the case where the coupler represented by formula (III) is contained in a vinyl monomer, the vinyl group may possess a substituent other than those represented in formula (III). The substituent is preferably hydrogen, chlorine atom, or a lower alkyl group having 1 to 4 carbon atoms (e.g., methyl group or ethyl group).

The monomer containing the coupler represented by formula (III) may be copolymerized into a copolymer with a non-coloring ethylenically unsaturated monomer which is not coupled with the oxidized product of the aromatic primary amine developing agent.

Examples of the non-coloring ethylenically unsaturated monomers which are not coupled with the oxidized product of the aromatic primary amine developing agent include acrylic acid, a-chloroacrylic acid, α-alkylacrylic acid (e.g., methacrylic acid) and esters thereof and amides (e.g. acrylamide, n-butylacrylamide, t-butylacrylamide, diacetoneacrylamide, metacrylamide, methyl acrylate, ethyl acrylate, n-propyl acrylate, n-butyl acrylate, t-butyl acrylate, iso-butyl acrylate, 2-ethylhexyl acrylate, n-octyl acrylate, lauryl acrylate, methyl methacrylate, ethyl methacrylate, n-butyl methacrylate, and β-hydroxy methacrylate), methylenedibisacrylamide, vinyl esters (e.g., vinyl acetate, vinyl propionate and vinyl laurate), acrylonitrile, methacrylonitrile, aromatic vinyl compounds e.g., styrene and derivatives thereof, vinyl toluene, divinylbenzene, vinylacetophenone and sulfostyrene), itaconic acid, citraconic acid, crotonic acid, vinylidene chloride, vinyl alkyl ethers (e.g., vinyl ethyl ether), maleic acid, maleic anhydride, maleates, N-vinyl-2-pyrolidone, N-vinylpyridine, 2- and 4-vinylpyridine, and the like. The non-coloring ethylenically unsaturated monomers to be used herein may be used as a mixture of two or more, of them. For example, mixtures of n-butyl acrylate and methyl acrylate, of styrene and methacrylic acid, of methacrylic acid and acrylamide, of methyl acrylate and diacetoneacrylamide, etc. can be used.

As is well known in the art of the polymer coupler, the non-coloring ethylenically unsaturated monomer to be copolymerized with the solid water-insoluble monomeric coupler can be selected so as to have good influences upon physical properties and/or chemical properties of the formed copolymer, such as solubility, compatibility with a binder for photographic colloidal composition, e.g., gelatine, flexibility and heat stability.

The polymer coupler used in the present invention may be soluble or insoluble in water, and is preferably a polymer coupler latex.

Typical examples of the couplers represented by formula (III) will now be described, but the present invention is not restricted thereto.

(III-1)

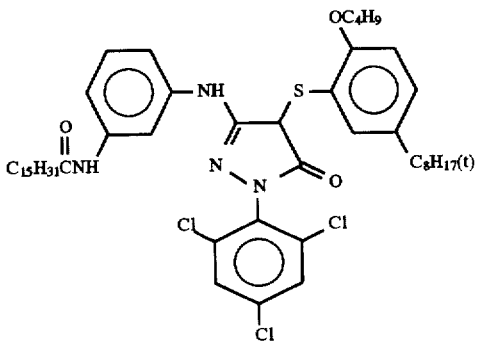

(III-2)

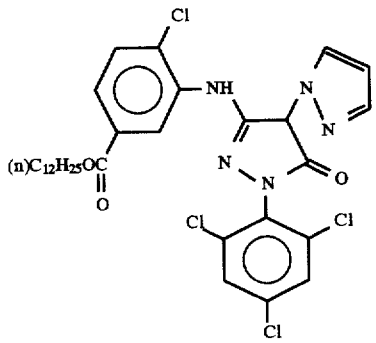

-continued
(III-3)
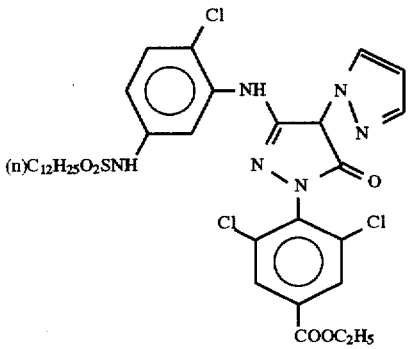
(III-4)
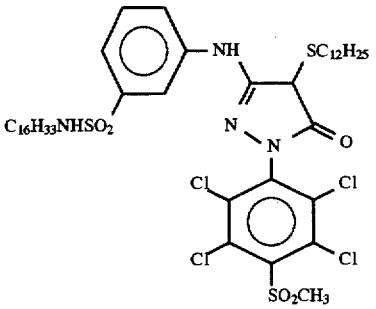
(III-5)
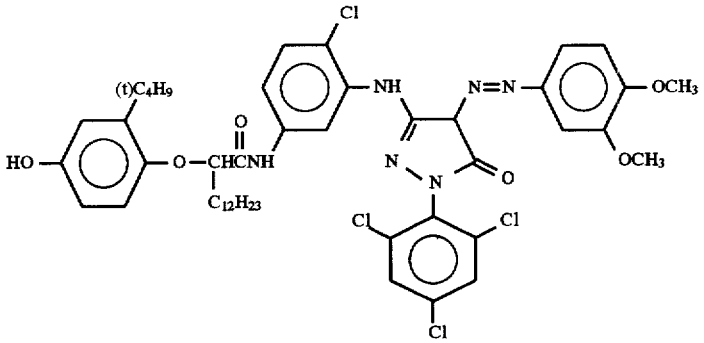
(III-6)
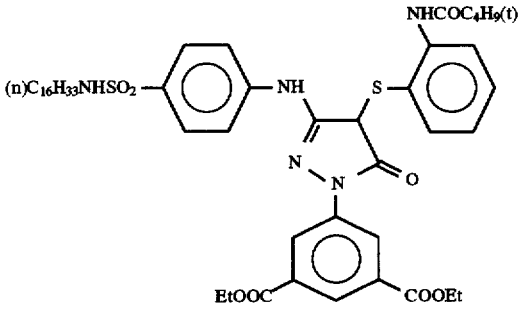
(III-7)
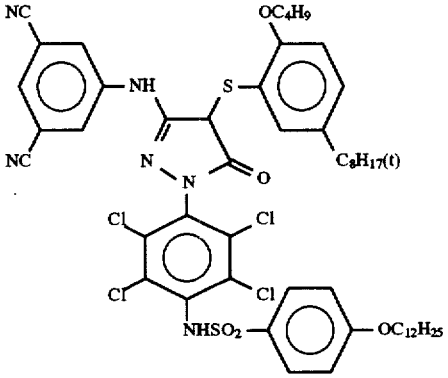
(III-8)
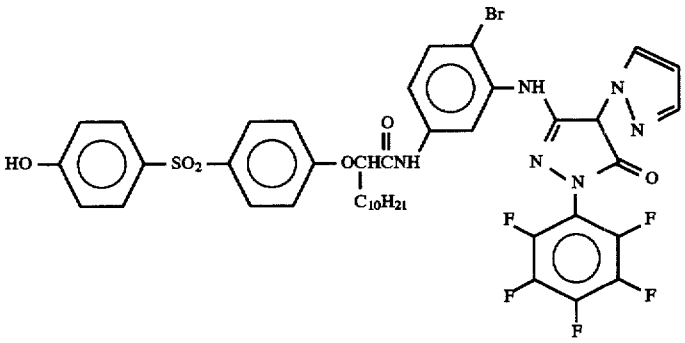

-continued
(III-9)
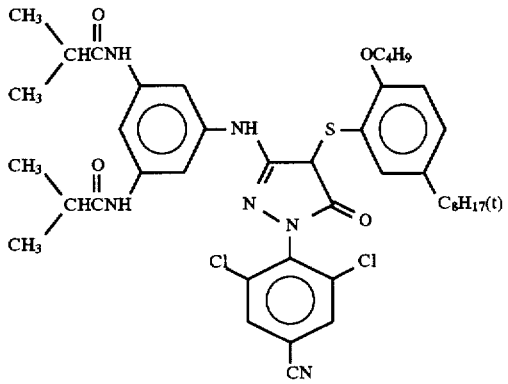
(III-10)
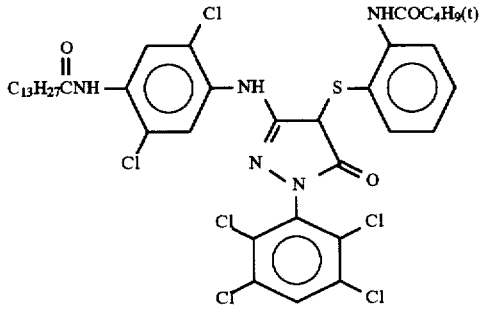
(III-11)
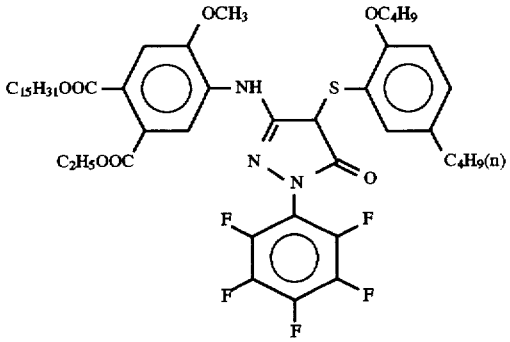
(III-12)
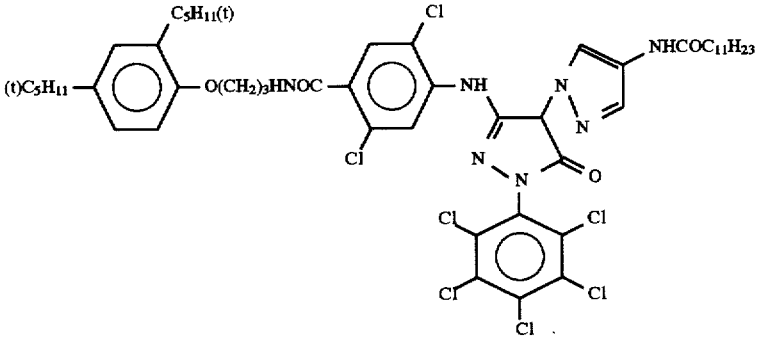
(III-13)
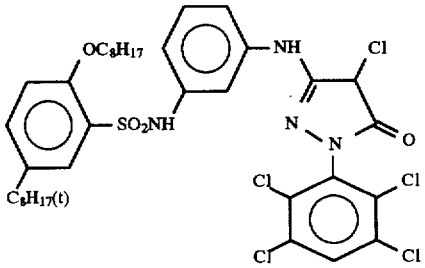

-continued
(III-14)
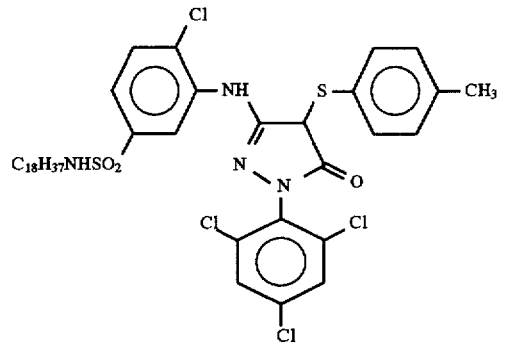
(III-15)
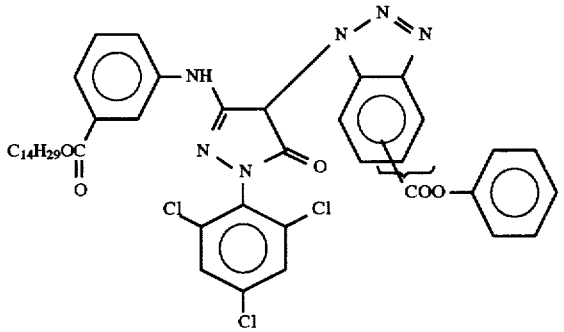
(III-16)
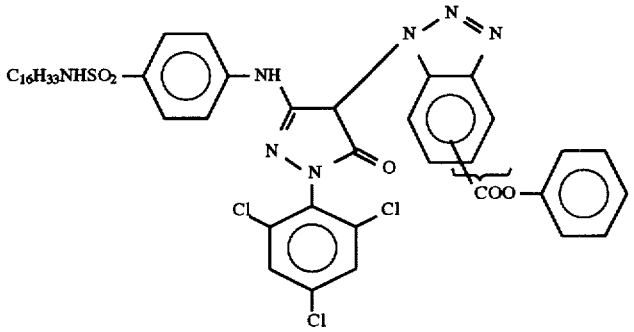
(III-17)
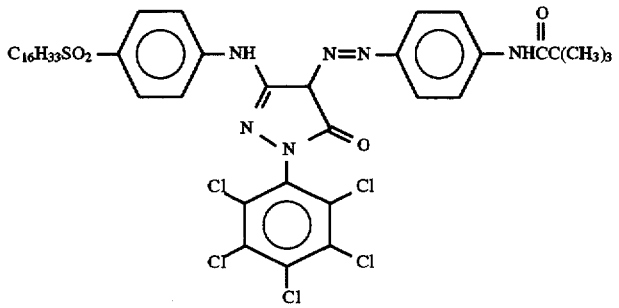

-continued
(III-18)
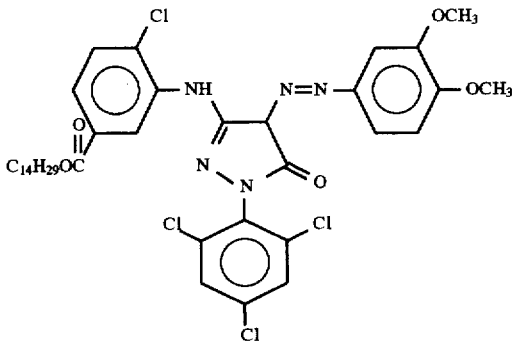
(III-19)
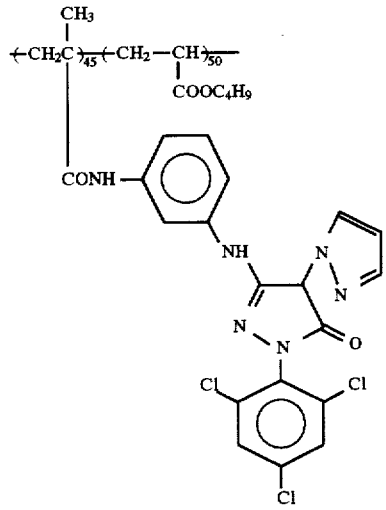
(III-20)
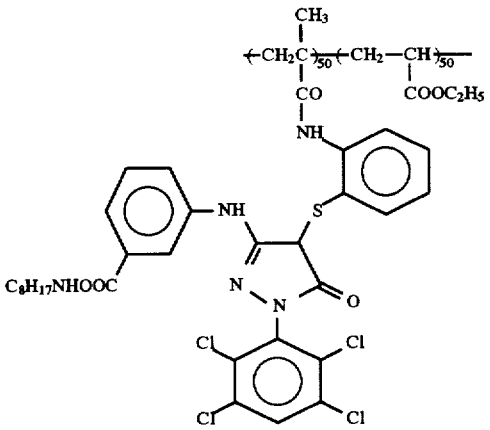
(III-21)
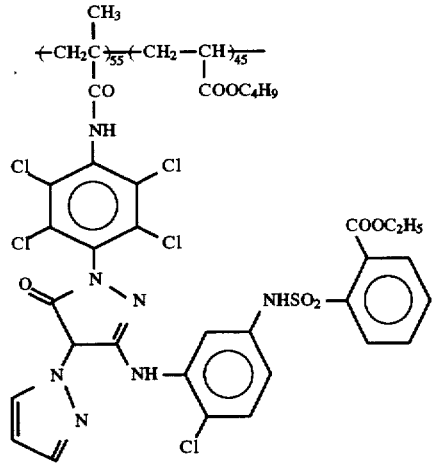
(III-22)
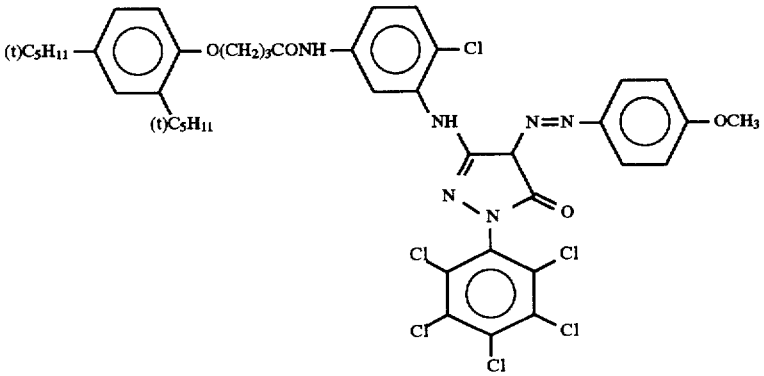

-continued (III-23)

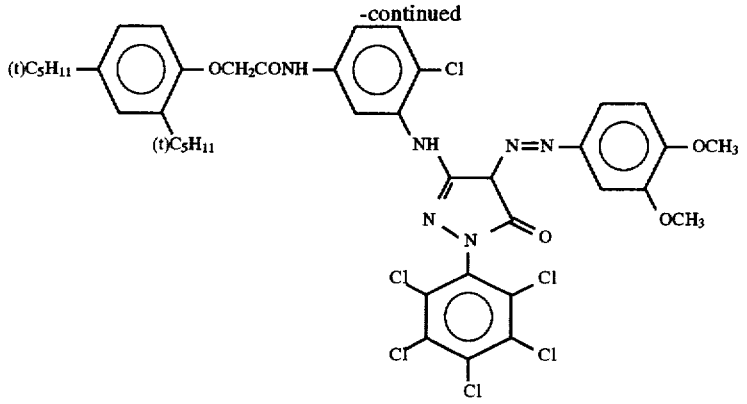

(III-24)

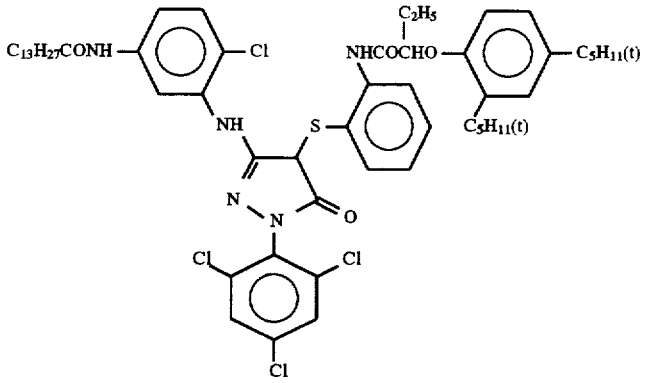

(III-25)

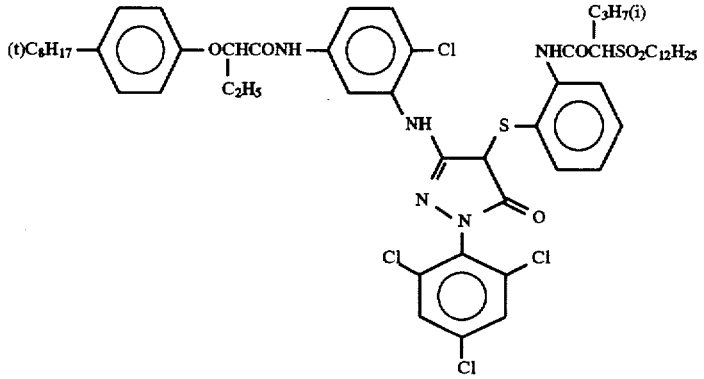

(III-26)

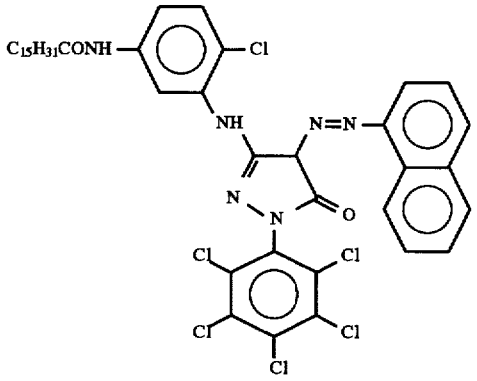

These couplers can be synthesized according to any of methods disclosed in U.K. patent No. 1,552,701 and European patent publication No. 348,135, etc.

The coupler of the present invention can be synthesized according to U.K. patent No. 1,552,701, European patent publication No. 348,135, U.S. Pat. Nos. 3,227,554, 4,351,897, 4,556,630, 4,584,266, 4,264,723, 4,308,343, 4,367,282, and 4,436,808, etc.

The couplers represented by formulae (II) and (III) are selected so that spectral absorption wavelengths of the dyes obtained from these couplers by color development are similar to those obtained from the other couplers used in the same layer. This makes it possible to maintain the printer suitability in various automatic printers produced from various companies using color filters having various spectral characteristics, light sources, and density sensors in a stable manner, even when the conditions of photograph are varied, whereby a good print having a constant quality can be provided. Furthermore, the couplers represented by formulae (II) and (III) of the present invention improve the sensitivity of the photograph, and has a stable color developing property.

The couplers represented by formulae (II) and (III) of the present invention may be used in any layer of the silver halide sensitive material, but are preferably added to the green-sensitive layer and/or the layer adjacent to the former layer. The total amount is from $1\times10^{-3}$ to 1.0 g/m$^2$, preferably from $5\times10^{-3}$ to 0.8 g/m$^2$, and more preferably from $1\times10^{-2}$ to 0.5 g/m$^2$.

The method for adding the couplers of the present invention to the photosensitive material is according to the method of adding the other couplers which is described later on, the weight ratio of the magenta coupler relative to the high-boiling point organic solvent used as the dispersing solvent is preferably from 0 to 3.0, more preferably from 0.3 to 2.0, and most preferably from 0.5 to 1.2.

The couplers represented by formulae (II) and (II) of the present invention may be used together with known magenta couplers.

As the known coupler, a 5-pyrazolone compound is preferred. In particular, those described in U.S. Pat. Nos. 4,310,619 and 4,351,897, European patent No. 73,6336, U.S. Pat. Nos. 3,061,432 and 3,725,067, Research Disclosure No. 24220 (June, 1984), JP-A-60-33552, Research Disclosure No. 24230 (June, 1984), JP-A-60-43659, JP-A-61-72238, JP-A-60-35730, JP-A-55-118034, JP-A-60-185951, U.S. Pat. Nos. 4,500,630, 4,540,654, and 4,556,630, WO 88/04795, etc. are particularly preferable.

For the purpose improving sharpness of image, a dyestuff which can be discolored by a treatment (above all, an oxonol dyestuff) may be added to the sensitive material of the present invention so that the optical refraction density of the sensitive material at 680 nm is not less than 0.70.

In the color photosensitive material according to the present invention, a color storage ability improving agent as described in European patent EP 0,277,589 A2 is preferably used together with couplers. In particularly the combination of this with a pyrazoazole coupler is preferred.

To be specific, for example, for preventing the generation of stain due to the formation of coloring pigments by the reaction between the color developing agent or the oxidized product thereof remaining in the membrane and the coupler during the course of the storage after the treatment or any other side action, it is preferable to use solely or in combination compound (F) which is chemically bonded to the aromatic amine developing agent remaining after developing treatment to form a substantially colorless compound which is chemically inert and/or compound (G) which is chemically bonded to the oxidized aromatic amine developing agent remaining after developing treatment to form a substantially colorless compound which is chemically inert.

It is preferable for preventing the growth of various mildews and microorganisms, which glow up in the hydrophilic colloidal layer to deteriorate an image, to add an antifungal agent as described in JP-A-63-271247 to the color photosensitive material according to the present invention.

In the present invention, it is preferable for reducing the carry over amount and enhancing the recovery of silver that the dry film thickness of the silver halide photosensitive material other than the substrate is not more than 25 μm., preferably from approximately 13 to 23 μm, and more preferably from approximately 9 to 19 μm.

The reduction of the film thickness can be achieved by reducing the amounts of gelatine, silver, the oils, the reduction of the film thickness is preferably attained by the reduction of the amount of gelatine. The film thickness can be determined according to the conventional method after the sample has been left standing at 25° C. and at 60 RH % for 2 weeks.

In the silver halide color photosensitive material used in the present invention, it is preferable for improving stain and the image storage property that the film swelling degree of the photographic layer is from 1.5 to 4.0. Particularly, at a swelling degree of from 1.5 to 3.0, markedly effects can be obtained. The term "swelling degree" used in the present invention represents a value obtained by dividing the thickness of the photographic layer of the color sensitive material after being soaked in distilled water at 33° C. for 2 minutes by the thickness of the dried photographic layer.

The term "photographic layer" used herein means the laminate layer having at least one light- sensitive silver halide emulsion layer, and hydrophilic colloidal layer having a water-permeating which correlates to the former layers laminated thereon. The "photographic layer" does not mean to contain a back layer provided on the side opposite to the photographic sensitive layer via the substrate. The photographic layer is formed from a plurality of layers and includes an intermediate layer, a filter layer, an anti-halation layer, a protective layer other than the silver halide emulsion layer.

Any method can be used to adjust the swelling degree", and the swelling degree can be adjusted, for example, by varying the amount or type of gelatine, the amount or type of the hardener, or the conditions for drying or period after the application of the photographic layer. Although gelatine can be advantageously used in the photographic layer, another hydrophilic collide can also be used. For example, gelatine derivatives, graft polymers of gelatine and other macromolecules, proteins such as albumin and casein, cellulose derivative such as hydroxyethyl cellulose, carboxymethyl cellulose, and cellulose sulfate, saccharide derivatives such as sodium alginate and starch derivatives, synthetic hydrophilic macromolecules like homopolymers or copolymers such as polyvinyl alcohol, partially acetalated polyvinyl alcohol, poly-N-vinyl pyrolidone, polyacrylic acid, polymethacrylic acid, polyacrylamide, polyvinylimidazole, polyvinylpyrazole can be used.

As the gelatine, in addition to lime-treated gelatine, acid-treated gelatine may be used and a gelatine hydrolyzed products and gelatine enzymatically decomposed products may also be used. Examples of the gelatine derivatives include those obtained by the reaction with various compounds such as acid halides, anhydride, isocyanates, bromoacetic acid, alkane sultone, vinylsulfonamides, maleinimide compounds, polyalkylene oxides, and epoxy compounds.

As the gelatine graft polymers, those in which homopolymers or copolymers of vinyl monomer such as acrylic acid, methacrylic acid, and derivative thereof such as their esters and amides, acrylonitrile, and styrene are grafted onto gelatine can be used. Above all, polymers having a compatibility with gelatine to some degree such as graft polymer with polymers obtained by polymerization of acrylic acid, methacrylic acid, acrylamide, methacrylamide, and hydroxyalkyl methacrylate are preferred. Their examples are described in U.S. Pat. Nos. 2,763,625, 2,831,767, and 2956, 844, etc. Typical synthetic hydrophilic macromolecules are described, for example, in German patent application (OLS) 2,312,708, U.S. Pat. Nos. 3,620,751, and 3,879,205, JP-B-43-7561, etc.

As the hardener, chromium salts (chromium alum, chromium acetate, etc.), aldehydes (formaldehyde, glyoxal, glutaraldehyde, etc.), N-methylol compounds(dimethylol urea, methyloldimethylhydantoin, etc.), dioxane derivatives (2,3-dihydrodioxane, etc.), active vinyl compounds (1,3,5-triacryloyl-hexahydro-s-triazine, etc.), bis(vinylsulfonyl)methyl ether, N,N'-methylenebis-[β-(vinylsulfonyl)pronionamide, etc.), active halogen compounds (2,4-dichloro-6-hydroxy-s-triazine, etc.), mucohalogens (mucochloric acid, mucophenoxychloric acid, etc.), isooxazoles, dialdehyde starch, 2-chloro-6-hydroxytriazinylated gelatine, etc. may be used solely or in combination. Of them, aldehydes, active vinyl compounds and active halides are more preferred.

The sensitive material according to the present invention may be exposed with a visible light or an infrared light. The exposure may be carried out either at a low illumination or at a high illumination for a short period. Particularly, in the latter case, a laser scanning exposure method in which exposure period per pixel is shorter than $10^{-4}$ is preferable.

In the exposure, the use of a band stop filter described in U.S. Pat. No. 4,880,726 is preferable. This removes color mixing, and, thus, a color reproductivity is drastically enhanced.

The treating process of the present invention can be applied to a wide variety of sensitive materials. Particularly, color negative films, color reversal films, negative films for movie, positive films for movie, etc., can be mentioned. Above all, the application to a color negative film is preferable.

According to the process for the present invention, the deterioration in an S/N ratio of a magnetically recorded information can be drastically improved.

Without impairing the image storage property and photographic characteristics, the S/N ratio can be improved.

EXAMPLES

The present invention will now be described in greater detail with reference to Examples, but it should be noted that the present invention is not restricted thereto.

Example 1

(1) Materials of Substrates

The substrates used in the present invention were produced by the following methods.

PEN: After 100 parts by weight of commercially available poly(ethylene-2,6-naphthalate) polymer corresponding to P-1 previously disclosed in this specification and 2 parts of Tinuvin P.326 (produced by Gaigy) as a ultraviolet absorbent were dried according to the conventional method, the mixture was melted at 300° C., extruded from a T die, stretched by 330% at 140° C. longitudinally, and stretched by 330% at 130° C. in the width direction, and then thermally solidified at 250° C. for 6 seconds. The glass transition temperature was found to be 120° C.

TAC: Triacethyl cellulose support was produced according to a usual solution casting method by a band method using methylene chloride/methanol in a weight ratio of 82/8, in TAC concentration of 13%, with using 15 wt % of plasticizer TPP/BDP in a weight ratio of 2/1 (TPP: triphenyl phosphate; BDP: biphenyldiphenyl phosphate).

(2) Application of Primer Layer

After both surfaces of the substrate had been subjected to a corona discharge treatment, a primer coating solution having the following composition was applied to provide a primer layer on a high temperature side when stretching was subjected. The corona discharge treatment was carried out using Solid state corona discharger, Model 6 KVA", produced from Pillar Inc. at a transition speed of 20 m/min. for a 30 cm width substrate. From the values of current and voltage, it was found that the substrate to be treated was treated at 0.375 KV.A.min/$m^2$. The discharge frequency during the course of the treatment was 9.6 KHz and the gap clearance between the electrode and dielectric substance was 1.6 mm.

| | |
|---|---|
| Gelatine | 3 g |
| Distilled water | 250 ml |
| Sodium α-sulfodi-2-ethylhexyl succinate | 0.05 g |
| Formaldehyde | 0.02 g |

On the substrate, TAC, a primer coat having the following composition was provided.

| | |
|---|---|
| Gelatine | 0.2 g |
| Salicylic acid | 0.1 g |
| Methanol | 15 ml |
| Acetone | 85 ml |
| Formaldehyde | 0.01 g |

(3) Application of Back Layer

On one side of the primer-coated substrate produced under (2) the first to third back layers shown below were applied.

a) First Back Layer

| | |
|---|---|
| Fine Co-containing needle-form γ-iron oxide fine particle (incorporated as a gelatine dispersion; average particle size: 0.08 μm) | 0.2 g/$m^2$ |
| Gelatine | 3 g/$m^2$ |
| Compound (a) shown below | 0.1 g/$m^2$ |
| Compound (b) shown below | 0.02 g/$m^2$ |
| Poly(ethyl acrylate) (average diameter: 0.08 μm) | 1 g/$m^2$ |

$(CH_2{=}CHSO_2NHCH_2CH_2NH)_2CO$ (a)

(b)

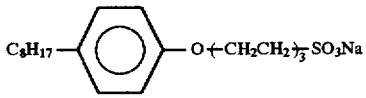

b) Second Back Layer

| | |
|---|---|
| Gelatine | 0.05 g/$m^2$ |
| Electric conductive material [$S_nO_3/Sb_2O_3$ (9:1), particle size: 0.15 μm) | 0.16 g/$m^2$ |
| Sodium dodecylbenzenesulfate | 0.05 g/$m^2$ |

c) Third Back Layer

| | |
|---|---|
| Gelatine | 0.5 g/$m^2$ |
| Polymethyl methacrylate (average particle size: 1.5 μm) | 0.02 g/$m^2$ |
| Cetyl stearate(dispersing sodium dodecylbenzenesufonate) | 0.01 g/$m^2$ |

-continued

| | |
|---|---|
| Sodium di(2-ethylhexyl)sulfosuccinate | 0.01 g/m$^2$ |
| Compound (c) | 0.01 g/m$^2$ |

The resulting back layers had a magnet resistance of 960 Oe.

$$C_8F_{17}SO_2N(C_3H_7)\text{-}(CH_2CH_2O)_4\text{-}(CH_2)_4\text{-}SO_3Na \quad (c)$$

(4) Heat Treatment of Substrate

After the primer layer and the back layers were applied as described above, dried and rolled, a heat treatment was carried out at 110° C. for 48 hours.

On the two types of substrates, a photosensitive layers described under (5) were applied to produce photosensitive materials. The material having the PEN substrate is designated as Sample 101 and that having the TAC substrate is designated as Sample 102. The material having the PEN substrate without any heat treatment is designated as Sample 103.

(5) Production of Sensitive Layer

The layers each having the following composition were superimposed to produce color negative film samples.

(Composition of Photosensitive Layer).

The materials used in each layer are classified as follows:

Exc: Cyan coupler UV: Ultraviolet absorbent

ExM: Magenta coupler HBS: High boiling point organic solvent

ExY: Yellow coupler H: Gelatine hardener

ExS: Sensitizing dye

The number corresponding to each components shows the amount of application indicated in g/m$^2$ unit, and for silver halide, shows a coating amount in terms of silver, provided that the amount of the sensitizing dye applied is shown in molar unit per mol of silver halide applied in the same layer.

| | | |
|---|---|---|
| 1st layer (Anti-halation layer) | | |
| Black colloidal silver | silver | 0.09 |
| Gelatine | | 1.60 |
| ExM-1 | | 0.12 |
| ExF-1 | | $2.0 \times 10^{-3}$ |
| Solid dispersion dye ExF-2 | | 0.030 |
| Solid dispersion dye ExF-3 | | 0.040 |
| HBS-1 | | 0.15 |
| HBS-1 | | 0.02 |
| 2nd layer (Intermediate layer) | | |
| Silver iodobromide emulsion M | silver | 0.065 |
| ExC-2 | | 0.04 |
| Polyethyl acrylate latex | | 0.20 |
| Gelatine | | 1.04 |
| 3rd layer (Low red-sensitive emulsion layer) | | |
| Silver iodobromide emulsion A | silver | 0.25 |
| Silver iodobromide emulsion B | silver | 0.25 |
| ExS-1 | | $6.9 \times 10^{-5}$ |
| ExS-2 | | $1.8 \times 10^{-5}$ |
| ExS-3 | | $3.1 \times 10^{-4}$ |
| ExC-1 | | 0.17 |
| ExC-3 | | 0.030 |
| ExC-4 | | 0.10 |
| Exc-5 | | 0.020 |
| Exc-6 | | 0.010 |
| Cpd-2 | | 0.025 |
| HBS-1 | | 0.10 |
| Gelatine | | 0.87 |

-continued

| | | |
|---|---|---|
| 4th layer (Middle red-sensitive emulsion layer) | | |
| Silver iodobromide emulsion C | silver | 0.70 |
| ExS-1 | | $3.5 \times 10^{-4}$ |
| ExS-2 | | $1.6 \times 10^{-5}$ |
| ExS-3 | | $5.1 \times 10^{-4}$ |
| ExC-1 | | 0.13 |
| ExC-2 | | 0.060 |
| ExC-3 | | 0.0070 |
| ExC-4 | | 0.090 |
| ExC-5 | | 0.015 |
| ExC-6 | | 0.0070 |
| Cpd-2 | | 0.023 |
| HBS-1 | | 0.10 |
| Gelatine | | 0.75 |
| 5th layer (High red-sensitive emulsion layer) | | |
| Silver iodobromide emulsion D | silver | 1.40 |
| ExS-1 | | $2.4 \times 10^{-4}$ |
| ExS-2 | | $1.0 \times 10^{-4}$ |
| ExS-3 | | $3.4 \times 10^{-4}$ |
| ExC-1 | | 0.10 |
| ExC-3 | | 0.045 |
| ExC-6 | | 0.020 |
| ExC-7 | | 0.010 |
| Cpd-2 | | 0.050 |
| HBS-1 | | 0.22 |
| HBS-2 | | 0.050 |
| Gelatine | | 1.10 |
| 6th layer (Intermediate layer) | | |
| Cpd-1 | | 0.090 |
| Solid dispersion dye | | 0.030 |
| HBS-1 | | 0.050 |
| Polyethylacrylate latex | | 0.15 |
| Gelatine | | 1.10 |
| 7th layer (Low green-sensitive layer) | | |
| Silver iodobromide emulsion E | silver | 0.15 |
| Silver iodobromide emulsion F | silver | 0.10 |
| Silver iodobromide emulsion G | silver | 0.10 |
| ExS-4 | | $3.0 \times 10^{-5}$ |
| ExS-5 | | $2.1 \times 10^{-4}$ |
| ExS-6 | | $8.0 \times 10^{-4}$ |
| ExM-2 | | 0.33 |
| ExM-3 | | 0.086 |
| ExY-1 | | 0.015 |
| HBS-1 | | 0.30 |
| HBS-3 | | 0.010 |
| Gelatine | | 0.73 |
| 8th layer (Middle green-sensitive layer) | | |
| Silver iodobromide emulsion H | silver | 0.80 |
| Exs-4 | | $3.2 \times 10^{-5}$ |
| ExS-5 | | $2.2 \times 10^{-4}$ |
| ExS-6 | | $8.4 \times 10^{-4}$ |
| ExC-8 | | 0.010 |
| ExM-2 | | 0.10 |
| ExM-3 | | 0.025 |
| ExY-1 | | 0.018 |
| ExY-4 | | 0.010 |
| ExY-5 | | 0.040 |
| HBS-1 | | 0.13 |
| HBS-3 | | $4.0 \times 10^{-3}$ |
| Gelatine | | 0.80 |
| 9th layer (High sensitive green-sensitive emulsion layer) | | |
| Silver iodobromide emulsion I | silver | 1.25 |
| ExS-4 | | $3.7 \times 10^{-5}$ |
| ExS-5 | | $8.1 \times 10^{-5}$ |
| ExS-6 | | $3.2 \times 10^{-4}$ |
| ExC-1 | | 0.010 |
| ExM-1 | | 0.020 |
| ExM-4 | | 0.025 |
| ExM-5 | | 0.040 |
| Cpd-3 | | 0.040 |
| HBS-1 | | 0.25 |
| Polyethyl acrylate latex | | 0.15 |
| Gelatine | | 1.33 |

-continued

| 10th layer (Yellow filter layer) | | |
|---|---|---|
| Yellow collidal silver | silver | 0.015 |
| Cpd-1 | | 0.16 |
| Solid dispersion dye ExF-5 | | 0.060 |
| Solid dispersion dye ExF-6 | | 0.060 |
| Oil-soluble dye ExF-7 | | 0.010 |
| HBS-1 | | 0.60 |
| Gelatine | | 0.60 |

-continued

| 11th layer (Low blue-sensitive emulsion layer) | | |
|---|---|---|
| Silver iodobromide emulsion J | silver | 0.09 |
| Silver iodobromide emulsion K | silver | 0.09 |
| ExS-7 | | $8.6 \times 10^{-4}$ |
| ExC-8 | | $7.0 \times 10^{-3}$ |
| ExY-1 | | 0.050 |
| ExY-2 | | 0.22 |
| ExY-3 | | 0.50 |
| ExY-4 | | 0.020 |
| Cpd-2 | | 0.10 |
| Cpd-3 | | $4.0 \times 10^{-3}$ |
| HBS-1 | | 0.28 |
| Gelatine | | 1.20 |
| 12th layer (High sensitive blue-sensitive emulsion layer) | | |
| Silver iodobromide emulsion L | silver | 1.00 |
| ExS-7 | | $4.0 \times 10^{-4}$ |
| ExY-2 | | 0.10 |
| ExY-3 | | 0.10 |
| ExY-4 | | 0.010 |
| Cpd-2 | | 0.10 |
| Cpd-3 | | $1.0 \times 10^{-3}$ |
| HBS-1 | | 0.070 |
| Gelatine | | 0.70 |
| 13th layer (1st protective layer) | | |
| UV-1 | | 0.19 |
| UV-2 | | 0.075 |
| UV-3 | | 0.065 |
| HBS-1 | | $5.0 \times 10^{-2}$ |
| HBS-4 | | $5.0 \times 10^{-2}$ |
| Gelatine | | 1.8 |
| 14th layer (2nd protective layer) | | |
| Silver iodobromide emulsion M | silver | 0.10 |
| H-1 | | 0.40 |
| B-1 (Diameter: 1.7 μm) | | $5.0 \times 10^{-2}$ |
| B-2 (Diameter: 1.7 μm) | | 0.15 |
| B-3 | | 0.05 |

-continued

| | |
|---|---|
| S-1 | 0.20 |
| Gelatine | 0.70 |

Furthermore, W-1 to W-3, B-4 to B-6, F-1 to F-17, and iron salts, lead salts, gold salts, platinum salts, palladium salts, iridium salts, and rhodium salts were optionally incorporated for enhancing storage property, treating property, pressure resistance, antifungal property, antibacterial property, anti-static property and coating ability.

TABLE 1

| Emulsion | Average AgI content (%) | Coefficient of variation in AgI content depending on particles (%) | Average particle size corresponding to sphere (μm) | Coefficient of variation in particle size (%) | Diameter of projected face corresponding to circle (μm) | Diameter/thickness ratio |
|---|---|---|---|---|---|---|
| A | 1.7 | 10 | 0.46 | 15 | 0.56 | 5.5 |
| B | 3.5 | 15 | 0.57 | 20 | 0.78 | 4.0 |
| C | 8.9 | 25 | 0.66 | 25 | 0.87 | 5.8 |
| D | 8.9 | 18 | 0.84 | 26 | 1.03 | 3.7 |
| E | 1.7 | 10 | 0.46 | 15 | 0.56 | 5.5 |
| F | 3.5 | 15 | 0.57 | 20 | 0.78 | 4.0 |
| G | 8.8 | 25 | 0.61 | 23 | 0.77 | 4.4 |
| H | 8.8 | 25 | 0.61 | 23 | 0.77 | 4.4 |
| I | 8.9 | 18 | 0.84 | 26 | 1.03 | 3.7 |
| J | 1.7 | 10 | 0.46 | 15 | 0.50 | 4.2 |
| K | 8.8 | 18 | 0.64 | 23 | 0.85 | 5.2 |
| L | 14.0 | 25 | 1.28 | 26 | 1.46 | 3.5 |
| M | 1.0 | — | 0.07 | 15 | — | 1 |

In Table 1;

(1) Emulsions J to L were subjected to a reduction sensitization with thiourea dioxide and thiosulfonic acid during the preparation of the particles according to Examples of JP-A-2-191938.

(2) Emulsion A to I were subjected to a gold-sensitization, a sulfur-sensitization, and a selenium-sensitization in the presence of spectral sensitizing dye and sodium thiocyanate as is disclosed in each photosensitive layer according, to Examples of JP-A-3-237450.

(3) At the time of preparing the tabular particles, low molecular weight gelatine was used according to Examples of JP-A-1-158426.

(4) A transition line as described in JP-A-3-237450 was observed in the tabular particles through a high voltage electron microscope.

(5) Emulsion L was double structure particles having a core material containing internally high internal high iodine content as described in JP-A-60-143331.

Preparation of Organic Solid Dispersed Dyestuff

The following ExF-2 was dispersed in the following manner: Into a 700 ml volume of pot mill were incorporated 21.7 ml of water, 3 ml of an aqueous solution of 5% sodium p-octylphenoxyethoxy-ethanesulfonate, and 0.5 g of an aqueous solution of 5% p-octylphenoxy polyoxyethylene ether (polymerization degree: 10), and then 5.0 g of Dye ExF-2 and 500 ml of zirconium oxide beads (diameter: 1 mm) were added, and the content was dispersed for 2 hours. In this dispersion, BO type vibration ball mill produced by Chuo Koki was used. After the dispersion, the content was taken out, added to 8 g of an aqueous solution of 12.5% gelatine, and the beads were filtered off to obtain a gelatine dispersion of the dye. The average particle size of the fine dyestuff particles was 0.44 μm.

Similarly, the solid dispersions of ExF-3, ExF-4 and ExF-6 were obtained. The average particle size of the fine dyestuff particles each was 0.24 μm, 0.45 μm, and 0.52 μm, respectively. ExF-5 was dispersed according to a microprecipitation dispersing method described in Example 1 of EP 549,489 A. The average particle size was 0.06 μm.
ExC-1
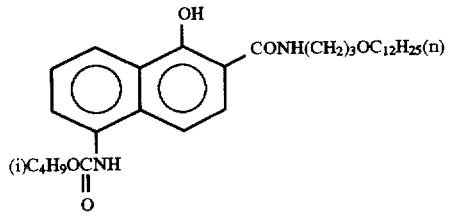
ExC-2
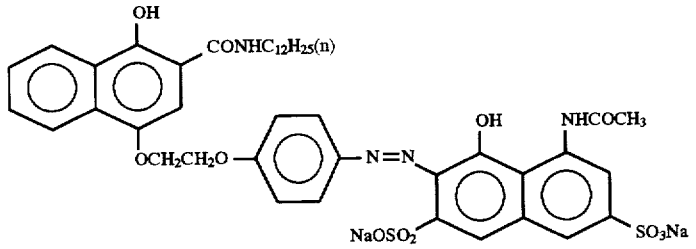
ExC-3
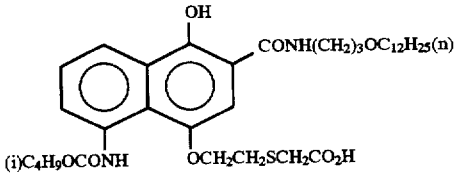
ExC-4
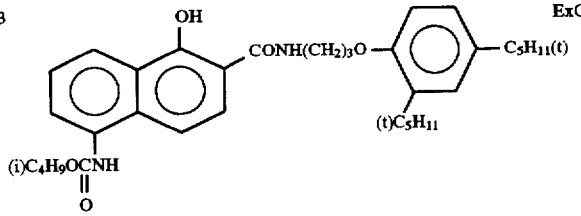
ExC-5
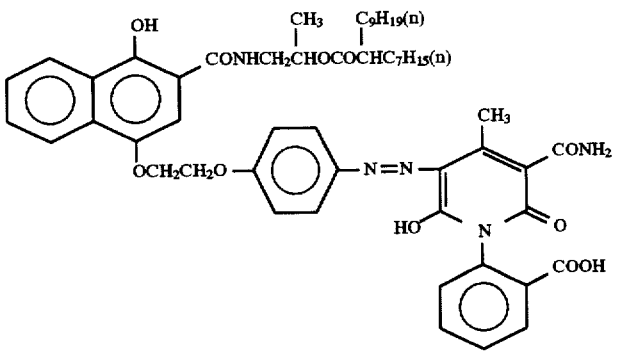
ExC-6
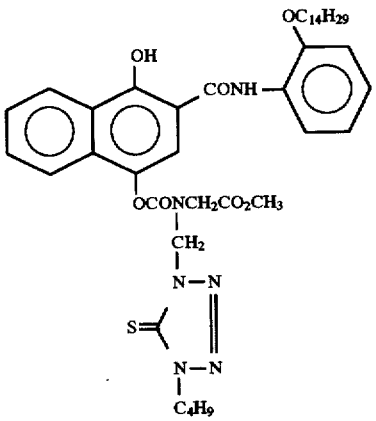
ExC-7
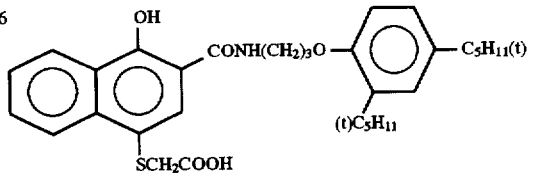

-continued
ExC-8
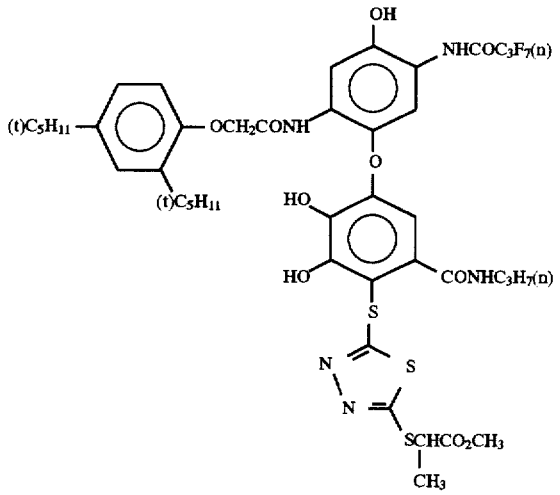
ExM-1
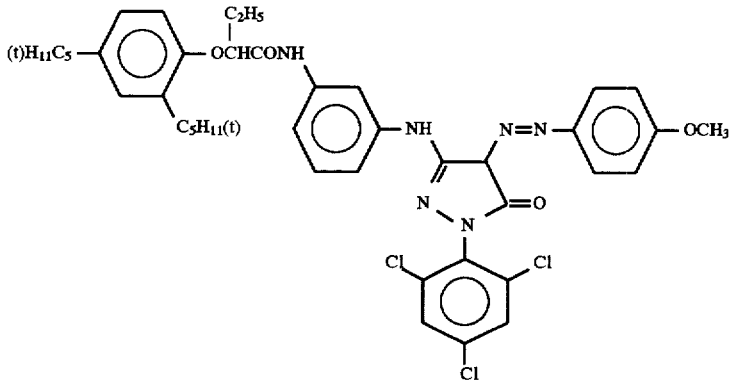
ExM-2
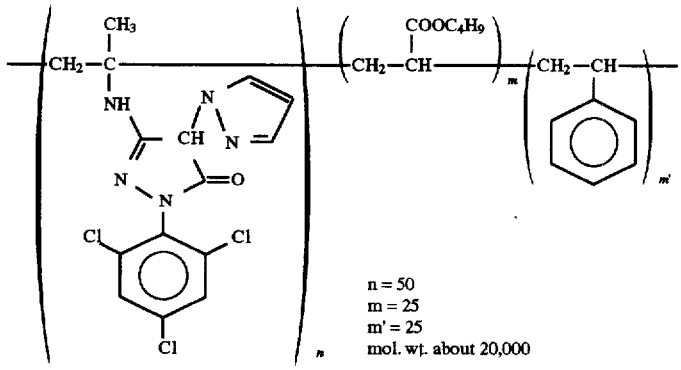
ExM-3
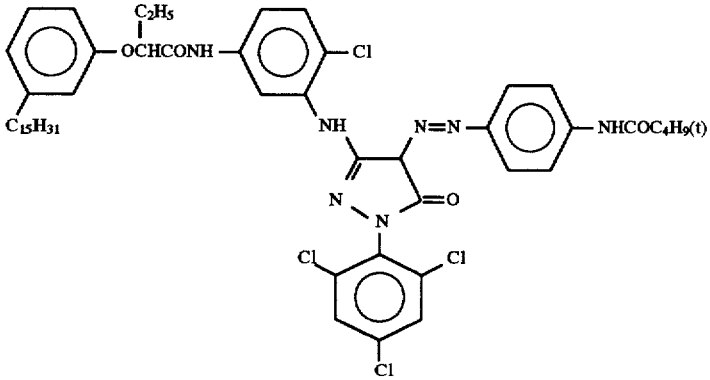

-continued
ExM-4
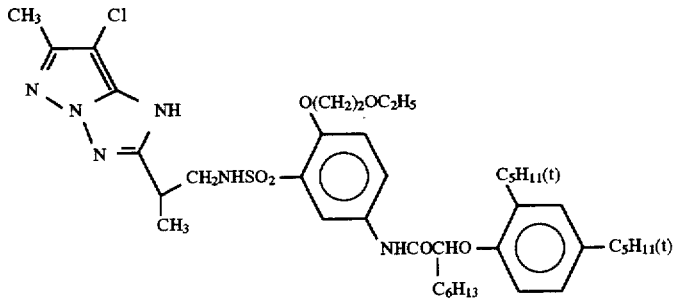
ExM-5
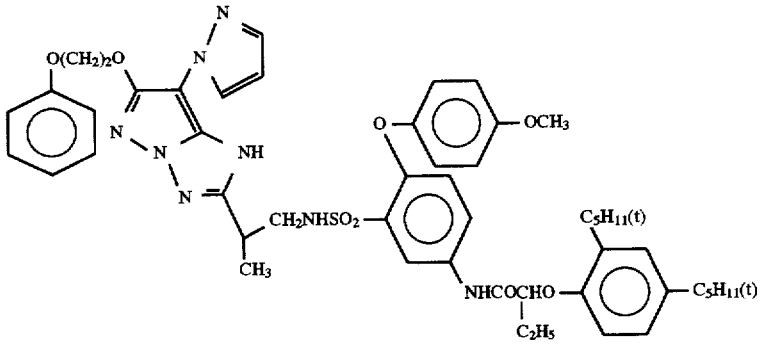
ExY-1
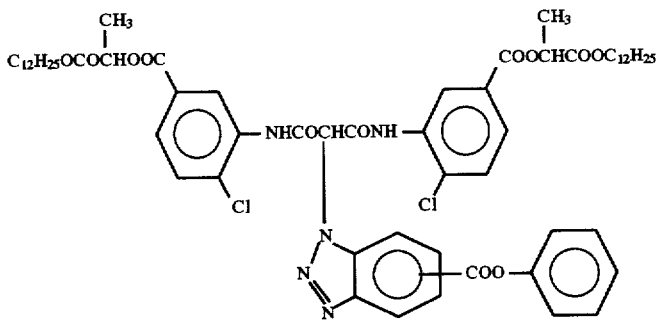
ExY-2
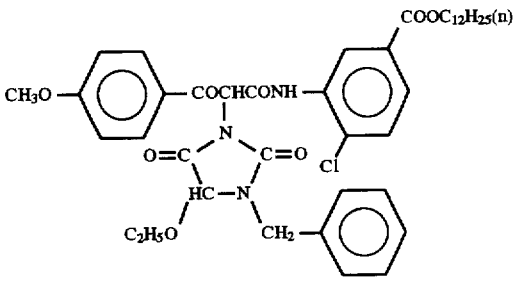
ExY-3
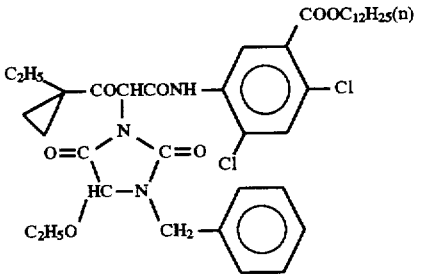
ExY-4
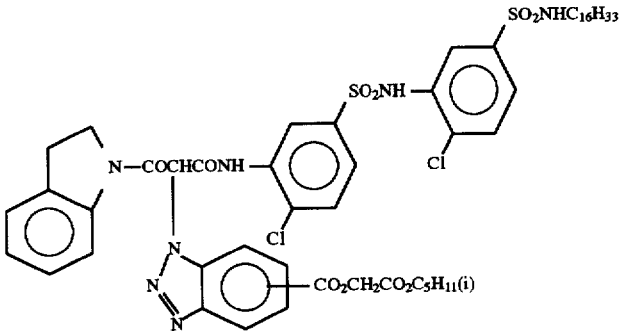

-continued
ExY-5
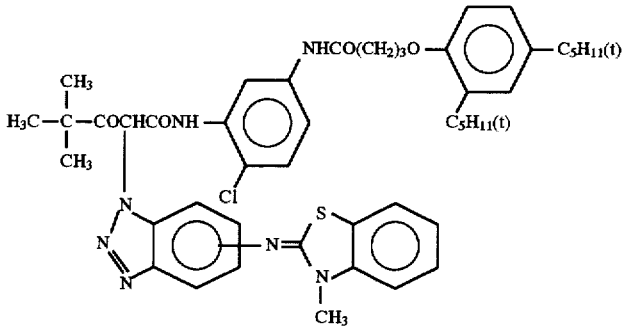
ExF-1
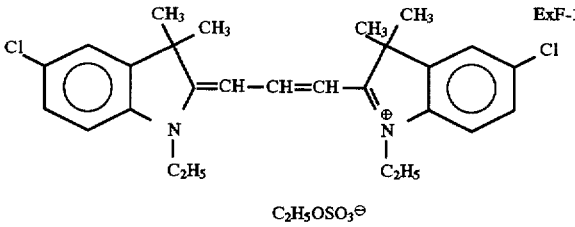
ExF-2
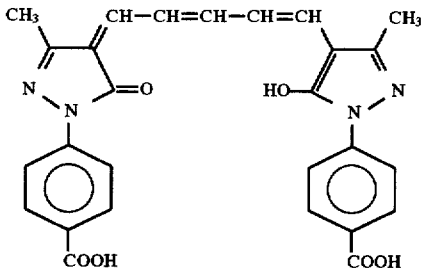
ExF-3
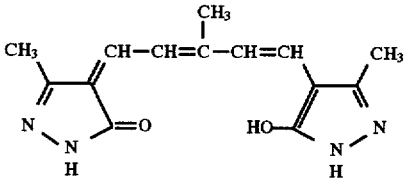
ExF-4
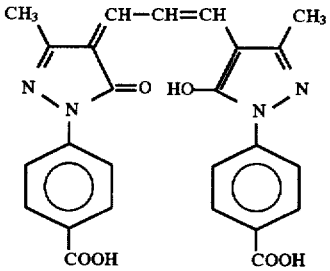
ExF-5
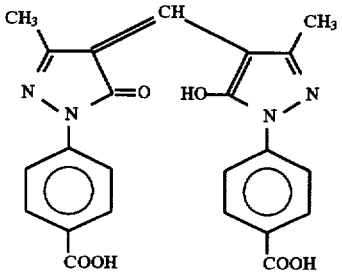
ExF-6
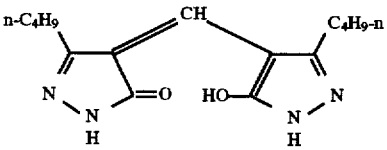
ExF-7
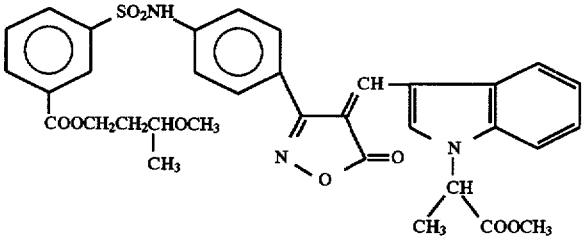
Cpd-1
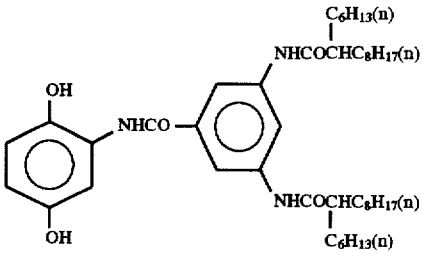
Cpd-2
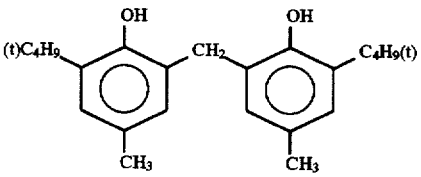

-continued
Cpd-3
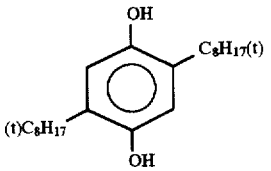
UV-1
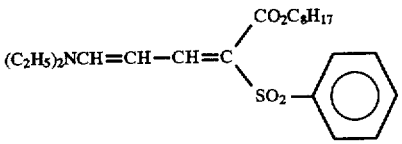
UV-2
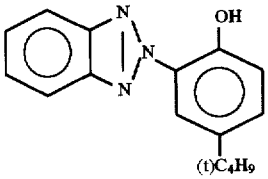
UV-3
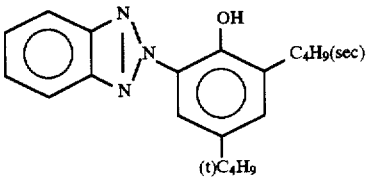
Tricresyl phosphate HBS-1
Di-n-butyl phthalate HBS-2
HBS-3
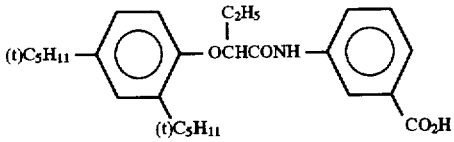
Tri-(2-ethylhexyl)phosphate HBS-4
ExS-1
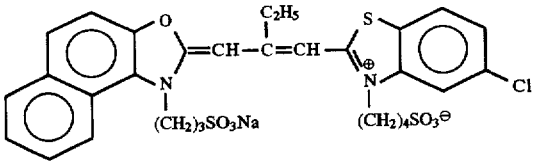
ExS-2
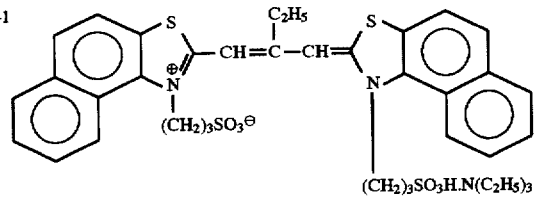
ExS-3
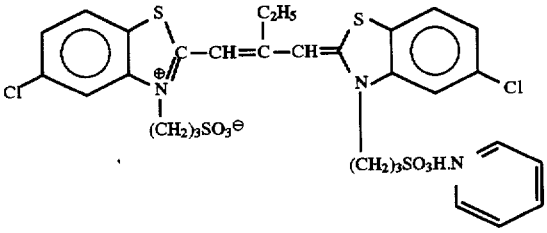
ExS-4
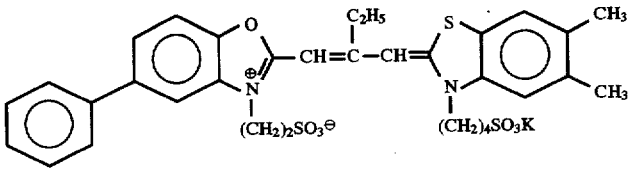
ExS-5
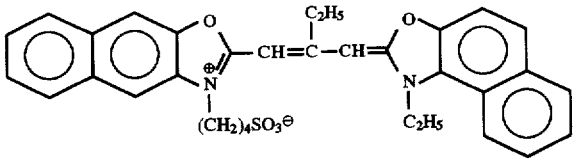
ExS-6
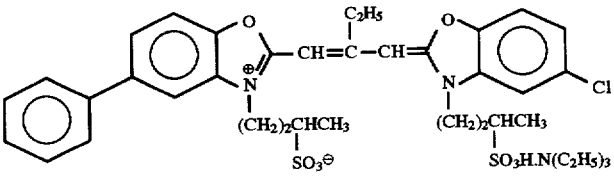

-continued
ExS-7
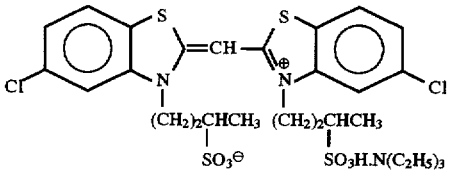
S-1
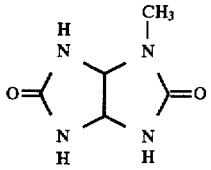
H-1
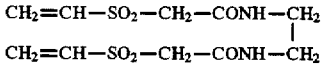
B-1
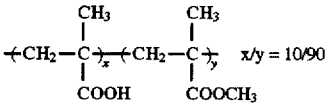
B-2
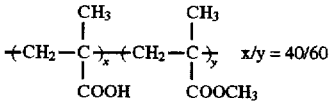
B-3
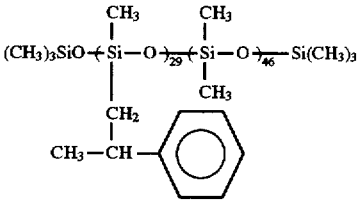
B-4
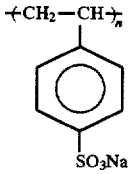
B-5
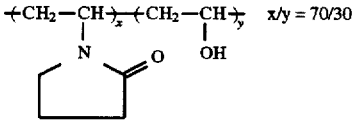
B-6
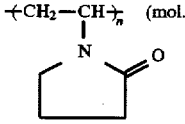
W-1
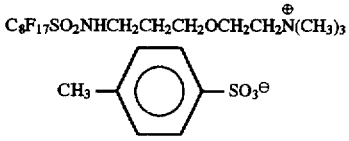
W-2
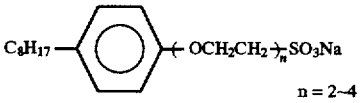
W-3
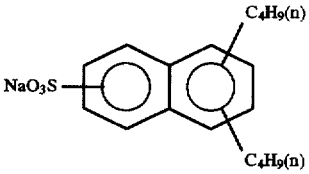
F-1
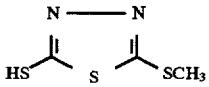
F-2
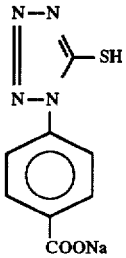
F-3
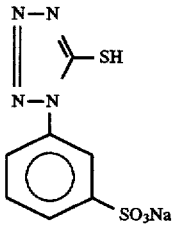
F-4
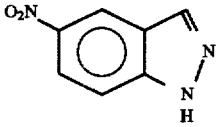
F-5
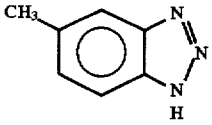
F-6
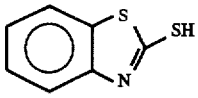

-continued

F-7

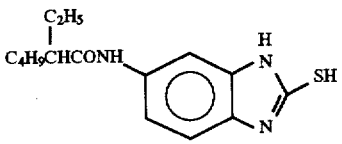

F-8

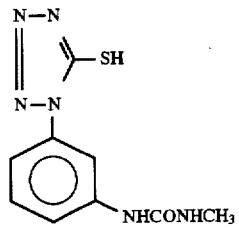

F-9

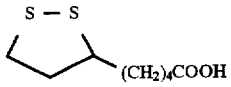

F-10

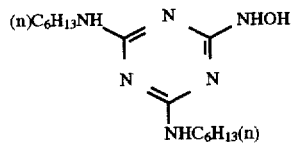

F-11

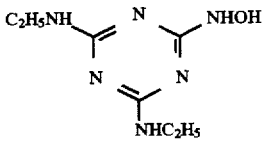

F-12

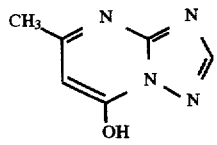

F-13

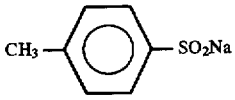

F-14

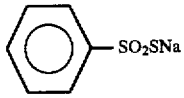

F-15

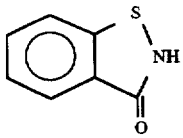

F-16

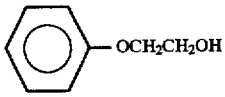

F-17

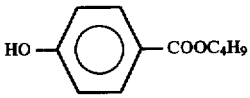

The sensitive material produced as described above was cut into a size of 24 mm×160 cm, and two 2 mm square perforations were provided longitudinally with 5.8 mm internal at the position 0.7 mm apart from a side of the photosensitive material. A sample having two of the set which was provided with an interval of 32 mm was produced and stored in a film cartridge made of plastic resin as explained in FIG. 1 to FIG. 7 of U.S. Pat. No. 5,296,887.

FM signal was recorded between the perforations of the photosensitive material transition rate of 100 mm/s using a head having a head gap of 5 μm and capable of in- and outputting in a turn number of 2000 from a side having a magnetic recording layer.

After the FM signal had been recorded, 1000 cms of a uniform exposure on the whole surface was applied on the emulsion surface, the surface was treated by the methods described below, and again stored in the film-cartridge.

Subsequently, the stored film was taken out, the signal was read-out at the same speed as that on recording the signal, and whether or not the signal was correctly output was examined. Table 2 shows a rate of a bit number bringing about an error relative to the input bit number. If the error rate is not more than 0.1%, there is no problem in practical use, but an error rate of more than 0.1% is no good.

The treatments carried out are described in detail.

The samples described above was subjected to a 1000 cms of gray exposure at a color temperature of 4800K, and treated in the following treating stages in the following treating liquids using a cinematic automatic developing machine. In the final treating liquid, the salt concentration and the additives were varied as shown below, and the treating stages were carried out in this order.

(Treating Stage)

| Stage | Period | Treating Temperature |
|---|---|---|
| Color developing | 2'00" | 40.0° C. |
| Bleaching | 30" | 38.0° C. |
| Fixing | 1'00" | 38.0° C. |
| Final Treatment (1) | 15" | 38.0° C. |
| Final Treatment (2) | 15" | 38.0° C. |
| Final Treatment (3) | 15" | 38.0° C. |
| Drying | 1' | 55° C. |

The final bath was a countercurrent manner from (3) to (1).

The compositions of the treating liquids were as follows:

| | Tank liquid (g) |
|---|---|
| (Color developer) | |
| Diethylenetriamine pentaacetic acid | 5.0 |
| Sodium sulfite | 4.0 |
| Potassium carbonate | 30.0 |
| Potassium bromide | 2.0 |
| Potassium iodide | 1.2 mg |
| Hydroxyiamine sulfate | 2.0 |
| N,N-(disulfonate ethyl)hydroxylamine | 5.0 |

-continued

| | Tank liquid (g) |
|---|---|
| 4-[N-ethyl-N-(β-hydroxyethyl)amino]-2-methylaniline sulfate | 7.0 |
| Water to make | 1.0 liter |
| pH (adjusted with potassium hydroxide and sulfuric acid) | 10.0 |
| (Bleaching liquid) | |
| 1,3-Diaminopropane tetraacetic acid ferric ammonium monohydrate | 150.0 |
| 1,3-Diaminopropane tetraacetic acid | 3.0 |
| Ammonium bromide | 80.0 |
| Ammonium nitrate | 17.5 |
| Aqueous ammonium (27%) | 10.0 |
| Acetic acid (98%) | 50.0 |
| Potassium carbonate | 10.0 |
| Water to make | 1.0 liter |
| pH (adjusted with aqueous ammonia and acetic acid) | 4.3 |
| (Fixing liquid) | |
| Ethylenediamine tetraacetic acid.2Na | 1.7 |
| Sodium sulfite | 16.0 |
| Ammoniumthiosulfate aqueous solution (700 g/l) | 210.0 ml |
| Sodium bisulfite | 11.0 |
| Ammonium thiocyanate | 150.0 |
| Thiourea | 1.8 |
| Water to make | 1.0 liter |
| pH | 6.5 |

| (Final treating liquid) Stabilization liquid A | Unit (g) |
|---|---|
| Surfactant $[CH_{10}H_{21}—O—(CH_2CH_2O)_{10}—H]$ | 1.0 |
| Polymaleic acid (average molecular weight: 2,000) | 1.0 |
| 1,2-benzisothiazolin-3-one | 0.05 |
| Hexamethylenetetramine | 6.0 |
| Water to make | 1.0 liter |

The salt concentration in this stabilization was 8100 ppm as determined by a distillation residue method.

Stabilization liquid B

Stabilization liquid A was diluted to 75%

The salt concentration was 6100 ppm.

Stabilization liquid C

Stabilization liquid A was diluted to 50%

The salt concentration was 4000 ppm.

Stabilization liquid D

Stabilization liquid A was diluted to 25%

The salt concentration was 2000 ppm.

| Washing water E | |
|---|---|
| Surfactant $[CH_{10}H_{21}—O—(CH_2CH_2O)_{10}—H]$ | 1.0 |
| Water to make | 1 liter |
| pH (adjusted with NaOH) | 7.0 |

The salt concentration was 1200 ppm.

Washing water F

Washing water E was diluted to 50%.

The salt concentration was 600 ppm.

Washing water G

Distilled water was used.

The salt concentration was 10 ppm.

Using the final baths described above, Sample Nos. 101, 102, and 103 were treated, and the error rates of magnetic recording were examined. The results are shown in Table 2.

TABLE 2

| No. | Sample | Final treatment liquid | Salt concentration (ppm) | Error rate (%) | Remarks |
|---|---|---|---|---|---|
| 01 | 101 | A | 8100 | 0.21 | Comparative |
| 02 | 101 | B | 6100 | 0.008 | Inventive |
| 03 | 101 | C | 4000 | 0.001 | Inventive |
| 04 | 401 | D | 2000 | 0.001 | Inventive |
| 05 | 101 | E | 1200 | 0.001 | Inventive |
| 06 | 101 | F | 600 | 0.001 | Inventive |
| 07 | 101 | G | 10 | 0.005 | Inventive |
| 08 | 102 | A | 8100 | 0.20 | Comparative |
| 09 | 102 | B | 6100 | 0.010 | Inventive |
| 10 | 102 | C | 4000 | 0.006 | Inventive |
| 11 | 102 | D | 2000 | 0.004 | Inventive |
| 12 | 102 | E | 1200 | 0.004 | Inventive |
| 13 | 102 | F | 600 | 0.004 | Inventive |
| 14 | 102 | G | 10 | 0.010 | Inventive |
| 15 | 103 | A | 8100 | 0.21 | Comparative |
| 16 | 103 | B | 6100 | 0.009 | Inventive |
| 17 | 103 | C | 4000 | 0.003 | Inventive |
| 18 | 103 | D | 2000 | 0.003 | Inventive |
| 19 | 103 | E | 1200 | 0.002 | Inventive |
| 20 | 103 | F | 600 | 0.002 | Inventive |
| 21 | 103 | G | 10 | 0.008 | Inventive |

Form Table 2, in the final treating liquids B–G having a salt concentration of not more than 7000 ppm, error rates were low, to provide good results. Moreover, in the case of the salt concentration being from 5000 to 500 ppm, most preferred results were obtained.

When the thermally treated PEN (Sample No. 101) was selected as a substrate, error rate in reading-out of magnetic recording information was decreased, and more preferred results were obtained.

Example 2

Sample No. 101 of Example 1 was treated, except for varying the periods of the treatments with the final treating liquids A, D, and G as shown in Table 3, and error rates were determined as in Example 1. The treated sample was left standing at 600° C./70% RH for 1 week, and the color fading rates of the yellow dye were obtained. The results are shown in Table 3.

TABLE 3

| No. | Stabilization liquid | Salt concentration (ppm) | Period* | Error rate (%) | Yellow fading rate (%) | Remarks |
|---|---|---|---|---|---|---|
| 31 | A | 8100 | 3" × 3 | 0.34 | 29 | Comparative |
| 32 | A | 8100 | 5" × 3 | 0.30 | 20 | Comparative |
| 33 | A | 8100 | 10" × 3 | 0.26 | 18 | Comparative |
| 34 | A | 8100 | 15" × 3 | 0.21 | 17 | Comparative |
| 35 | A | 8100 | 20" × 3 | 0.20 | 17 | Comparative |
| 36 | A | 8100 | 40" × 3 | 0.20 | 17 | Comparative |
| 37 | D | 2000 | 3" × 3 | 0.008 | 13 | Comparative |
| 38 | D | 2000 | 5" × 3 | 0.002 | 11 | Inventive |
| 39 | D | 2000 | 10" × 3 | 0.001 | 10 | Inventive |
| 40 | D | 2000 | 15" × 3 | 0.001 | 10 | Inventive |
| 41 | D | 2000 | 20" × 3 | 0.004 | 12 | Inventive |
| 42 | D | 2000 | 40" × 3 | 0.006 | 14 | Inventive |
| 43 | G | 10 | 3" × 3 | 0.01 | 13 | Comparative |
| 44 | G | 10 | 5" × 3 | 0.006 | 11 | Inventive |

TABLE 3-continued

| No. | Stabilization liquid | Salt concentration (ppm) | Period* | Error rate (%) | Yellow fading rate (%) | Remarks |
|---|---|---|---|---|---|---|
| 45 | G | 10 | 10" × 3 | 0.005 | 10 | Inventive |
| 46 | G | 10 | 15" × 3 | 0.005 | 10 | Inventive |
| 47 | G | 10 | 20" × 3 | 0.008 | 12 | Inventive |
| 48 | G | 10 | 40" × 3 | 0.01 | 14 | Inventive |

*: expressed as (period of treatment in one final bath) × number (3) of tanks

In Table 3, when the final treating liquids D and G were used, the error rates were decreased. Above all, when the period of the final treating liquid is from 15 to 45 seconds, good results were obtained (Nos. 38, 39, 40, 44, 45, 46).

Example 3

After image-like exposure, Sample No. 101 of the present invention was continuously treated in the following treatment stages until the treating liquid was replenished in an amount twice the volume of the color developing tank (running test). In this Example, the specification of the final bath was changed as described below, and, in each bath, the running test was carried out. The treatment stages are described below.

(Treatment stages)

| Treatment stage | Temperature | Time | Replenishment Amount* |
|---|---|---|---|
| Color developing | 45° C. | 60 sec. | 260 (ml/m$_2$) |
| Blixing | 40° C. | 60 | 650 |
| Final Treatment (1) | 40° C. | 15 | — |
| Final Treatment (2) | 40° C. | 15 | — |
| Final Treatment (3) | 40° C. | 15 | See below |
| Stabilization (3) | 75° C. | 30 | — |

The final bath was a countercurrent manner from (3) to (1).

The amount of carrying over from the pre-bath was 60 milliliter per square meter of the photosensitive material.

The compositions of treating liquids were as follows:

| | (Unit; g) | |
|---|---|---|
| | Tank Liquid | Replenishing Liquid |
| (Color Developer) | | |
| Diethyltriamine pentaacetic acid | 4.0 | 4.0 |
| Sodium 4,5-dihydroxybenzene-1,3-disulfonate | 0.5 | 0.5 |
| Sodium sulfite | 4.0 | 8.0 |
| Potassium carbonate | 38.0 | 38.0 |
| Potassium bromide | 4.0 | — |
| Potassium iodide | 1.3 mg | — |
| Hydorxylmine sulfate | 4.8 | 8.0 |
| 2-Methyl-4-[N-ethyl-N-(β-hydroxyethyl)amino]aniline sulfate | 18.5 | 28.0 |
| Water to make | 1 liter | 1 liter |
| pH (adjusted with potassium hydroxide and sulfuric acid) | 10.05 | 10.40 |
| (Bleaching and Fixing liquid) | | |
| Ethylenediamine-(2-carboxy-phenyl)-N,N',N'-triacetic acid | 0.18 mol | 0.20 mol |
| Ferric chloride | 0.16 mol | 0.18 mol |
| Aqueous ammonium thiosulfate (700 g/l) | 300 ml | 330 ml |
| Ammonium iodide | 1.0 | — |
| Ammonium sulfite | 10.0 | 40.0 |
| Succinic acid | 12.0 | 12.0 |
| Water to make | 1 liter | 1 liter |
| pH (adjusted with nitrate and aqueous ammonia) | 6.0 | 5.5 |

| (Final Treating Liquid) | The tank liquid and replenishing liquid had the same formulation. (Unit, g) |
|---|---|
| Polyoxyethylene-p-monononylphenyl ether (Average polymerization degree: 10) | 0.2 |
| Sodium chlorinated isocyanurate | 0.02 |
| Deionized water (dielectricity: not more than 5 μs/cm) | 1000 ml |
| pH | 6.5 |

The specifications of the treatments used were as follows:

Treatment A

The final treating liquid described above was replenished in an amount of 180 ml/m$^2$. The salt concentration at running equilibrium concentration was 7500 ppm.

Treatment B

The final treating liquid described above was replenished in an amount of 240 ml/m$^2$. The salt concentration at running equilibrium concentration was 4500 ppm.

Treatment C

The final treating liquid described above was replenished in an amount of 180 ml/m$^2$. To final bath 3 was equipped a reverse osmosis device "RC-50", produced by Fuji Film Co., Ltd., to return the concentrate to final bath 2, and to return the permeated water to final bath 3, thereby the salt concentration is decreased in final bath 3. As a result, the salt concentration in final bath 3 was 3800 ppm. Treatment D The final treating liquid described above was replenished in an amount of 180 ml/m$^2$. Final bath 3 was brought into contact with 1 liter of an ion exchange resin and circulated. The ion exchange resin used was a mixture of Amberlite IRA 400 and IRC-50 in a ratio of 1:1, and amphoteric ion exchanging was carried out. As a result, the salt concentration in the final bath was 4900 ppm.

The results of evaluations of magnetic recording performance and the ratio of yellow color fading are shown in Table 4.

TABLE 4

| No. | Treatment | Salt Concentration | Error Rate (%) | Rate of Yellow Fading (%) | Remarks |
|---|---|---|---|---|---|
| 51 | A | 7500 (ppm) | 0.19 | 25 | Comparative |
| 52 | B | 4500 | 0.006 | 13 | Inventive |
| 53 | C | 3800 | 0.003 | 10 | Inventive |
| 54 | D | 4900 | 0.004 | 11 | Inventive |

As is clear from Table 4, it was understood that by maintaining the salt concentration of the final bath according to the present invention, the sensitive substrate could be treated without impairing the signal recorded on the magnetically recording layer. With regard to the yellow fading, maintaining the salt concentration in the final bath provided good results.

Example 4

In Example 3, a sulfinic acid of formula (I) was added in an amount of 0.2M and 0.4M, and running operations Treatment A and Treatment B were similarly carried out.

After running, an FM signal and exposure were subjected to Sample 101 as in Example 2. As shown in Table 5, the treatment was carried out with the blixing liquid position, and the accuracy in reading-out magnetically recorded information and yellow color fading were evaluated.

TABLE 5

| No. | Treat-ment | Formula (I) | Salt Con-centration (ppm) | Error rate (%) | Rate of Yellow Fading (%) | Remarks |
|---|---|---|---|---|---|---|
| 61 | A | — | 7500 | 0.19 | 25 | Comparative |
| 62 | A | I-2 | 7600 | 0.20 | 26 | Comparative |
| 63 | A | I-3 | 7600 | 0.19 | 27 | Comparative |
| 64 | A | I-8 | 7600 | 0.21 | 26 | Comparative |
| 65 | A | I-9 | 7600 | 0.20 | 26 | Comparative |
| 66 | A | I-15 | 7600 | 0.20 | 27 | Comparative |
| 67 | B | — | 4500 | 0.006 | 13 | Inventive |
| 68 | B | I-2 | 4600 | 0.002 | 11 | Inventive |
| 69 | B | I-3 | 4600 | 0.001 | 10 | Inventive |
| 70 | B | I-8 | 4600 | 0.001 | 10 | Inventive |
| 71 | B | I-9 | 4600 | 0.002 | 10 | Inventive |
| 72 | B | I-15 | 4600 | 0.003 | 11 | Inventive |

It was understood from table 5 that the use of the blixing liquid containing a sulfinic acid represented by formula (I) gave more preferred results.

Example 5

Color negative film sample Nos. 104 to 107 were produced as in Example 1, except for changing the magenta coupler in the green sensitive layers as follows.

| | Sample | | | | |
|---|---|---|---|---|---|
| | 101 | 104 | 105 | 106 | 107 |
| 7th layer | EXM-2 | III-24 | II-22 | M-1 | M-4 |
| | EXM-3 | EXM-3 | EXM-3 | M-2 | M-2 |
| 8th layer | EXM-2 | III-24 | II-22 | M-1 | M-4 |
| | EXM-3 | EXM-3 | EXM-3 | M-2 | M-2 |
| 9th layer | EXM-1 | EXM-1 | EXM-1 | M-1 | M-4 |
| | EXM-4 | EXM-4 | EXM-4 | M-2 | M-2 |
| | EXM-5 | EXM-5 | EXM-5 | M-3 | M-3 |

The constructions of magenta couplers M-1 to M-4 were as follows:

M-1

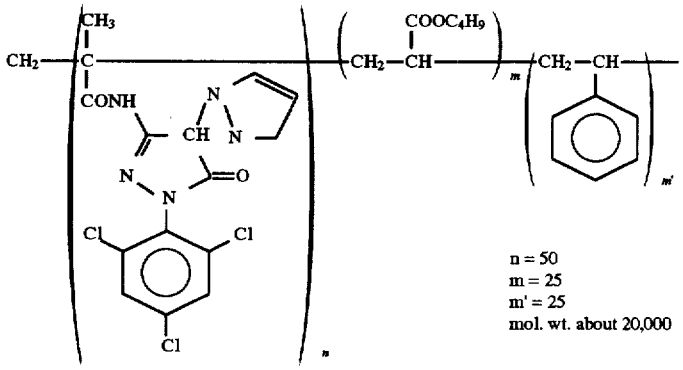

M-2

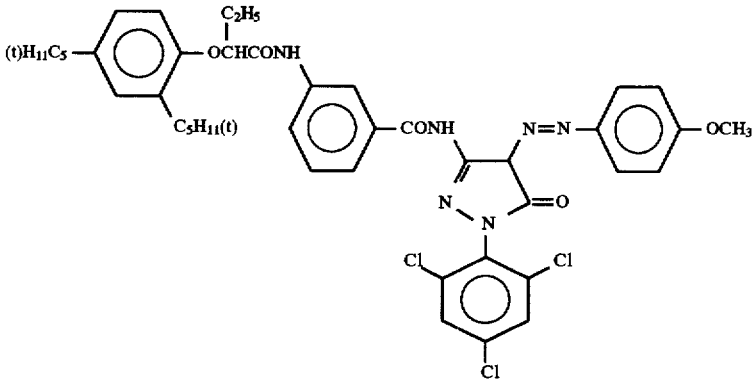

-continued

M-3

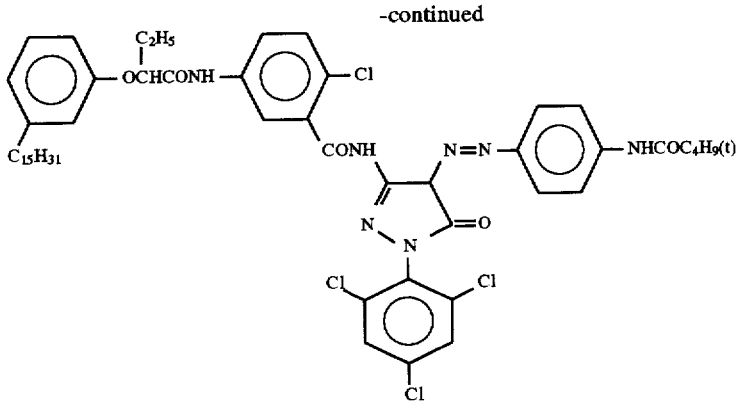

M-4

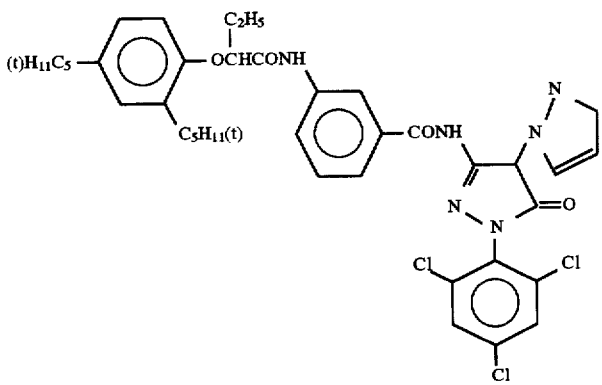

These samples were treated with the running liquids Nos. 61, 62, 63, 67, 68, and 69 as in Example 4, and a light fading ratio (ΔDg) of the magenta and an increase in yellow staining ($\Delta DB_{min}$) on the unexposed portion were determined.

The light fading was obtained by irradiating a sample with a xenon light at 70,000 Lux for 4 days, and determining the rate of fading the magenta density at an initial density of 2.0. The increase in the yellow density on the unexposed portion was determined after a sample had been left standing at 80° C./70% RH over a period of 3 days. The results are shown in Table 6.

TABLE 6

| No. | Treatment | Formula (I) | Salt concentration (ppm) | Sensitive material | ΔDG % | ΔDBmin | Remarks |
|---|---|---|---|---|---|---|---|
| 81 | A | — | 7500 | 101 | 25 | 0.10 | Comparative |
| 82 | A | — | 7500 | 104 | 25 | 0.10 | Comparative |
| 83 | A | — | 7500 | 105 | 25 | 0.10 | Comparative |
| 84 | A | — | 7500 | 106 | 26 | 0.11 | Comparative |
| 85 | A | — | 7500 | 107 | 24 | 0.11 | Comparative |
| 86 | A | I-2 | 7600 | 101 | 25 | 0.10 | Comparative |
| 87 | A | I-2 | 7600 | 104 | 25 | 0.10 | Comparative |
| 88 | A | I-2 | 7600 | 105 | 25 | 0.10 | Comparative |
| 89 | A | I-2 | 7600 | 106 | 25 | 0.11 | Comparative |
| 90 | A | I-2 | 7600 | 107 | 24 | 0.11 | Comparative |
| 91 | A | I-3 | 7600 | 101 | 25 | 0.11 | Comparative |
| 92 | A | I-3 | 7600 | 104 | 25 | 0.11 | Comparative |
| 93 | A | I-3 | 7600 | 105 | 25 | 0.11 | Comparative |
| 94 | A | I-3 | 7600 | 106 | 25 | 0.12 | Comparative |
| 95 | A | I-3 | 7600 | 107 | 24 | 0.12 | Comparative |
| 96 | B | — | 4500 | 101 | 13 | 0.07 | Inventive |
| 97 | B | — | 4500 | 104 | 13 | 0.07 | Inventive |
| 98 | B | — | 4500 | 105 | 13 | 0.07 | Inventive |
| 99 | B | — | 4500 | 106 | 17 | 0.09 | Inventive |
| 100 | B | — | 4500 | 107 | 17 | 0.09 | Inventive |
| 101 | B | I-2 | 4600 | 101 | 10 | 0.05 | Inventive |
| 102 | B | I-2 | 4600 | 104 | 10 | 0.05 | Inventive |
| 103 | B | I-2 | 4600 | 105 | 10 | 0.05 | Inventive |
| 104 | B | I-2 | 4600 | 106 | 13 | 0.07 | Inventive |
| 105 | B | I-2 | 4600 | 107 | 13 | 0.07 | Inventive |

TABLE 6-continued

| No. | Treatment | Formula (I) | Salt concentration (ppm) | Sensitive material | ΔDG % | ΔDBmin | Remarks |
|---|---|---|---|---|---|---|---|
| 106 | B | I-3 | 4600 | 101 | 10 | 0.05 | Inventive |
| 107 | B | I-3 | 4600 | 104 | 10 | 0.05 | Inventive |
| 108 | B | I-3 | 4600 | 105 | 10 | 0.05 | Inventive |
| 109 | B | I-3 | 4600 | 106 | 13 | 0.07 | Inventive |
| 110 | B | I-3 | 4600 | 107 | 13 | 0.07 | Inventive |

According to the present invention, a light fading of magenta and a thermal staining of yellow became good. Sample Nos. 101, 104, and 105, which used particularly preferable magenta couplers of formulae (II) and (III), exhibits excellent performances.

While the invention has been described in detail and with reference to specific examples thereof, it will be apparent to one skilled in the art that various changes and modifications can be made therein without departing from the spirit and scope thereof.

What is claimed is:

1. A process for processing a silver halide color photosensitive material comprising a transparent substrate, a red-sensitive layer, a green-sensitive layer, a blue-sensitive layer and a magnetic layer comprising ferromagnetic fine powder, comprising the steps of color developing said photosensitive material, desilvering said photosensitive material and water washing and/or stabilizing said photosensitive material, wherein a final bath of the washing and/or stabilizing has a salt content of not more than 7000 ppm, the water washing and/or stabilizing is conducted in a multistage countercurrent manner having 2 to 4 stages, the stabilizing is conducted in the absence of formaldehyde, the washing and/or stabilizing is conducted immediately after the desilvering, said water washing and/or stabilizing is conducted for a total treating period of from 15 to 45 seconds, and the step of water washing and/or stabilizing said photosensitive material comprises washing and/or stabilizing said material with a bath comprising a compound represented by the following formula (I):

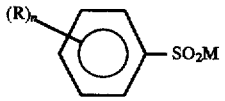

(I)

wherein R represents a substituent on a benzene ring, n represents an integer of from 0 to 5, and when n represents 2 or more, R may be the same or different, and M represents a hydrogen atom, an alkali metal, an alkaline earth metal ammonium or amine.

2. The process of claim 1, further comprising the step of treating the final bath of the water washing and/or stabilizing with a reverse osmosis device or with an ion-exchange resin.

3. The process of claim 1, wherein said ferromagnetic powder has a needle form having a long axis thereof of from 0.01 to 0.8 μm, and a long axis/short axis ratio of from 2 to 100.

4. The process of claim 1, wherein said ferromagnetic powder is a silane coupling agent-treated ferromagnetic powder or a titanium coupling agent-treated ferromagnetic powder.

5. The process of claim 4, wherein said ferromagnetic powder is treated with a silane coupling agent or a titanium coupling agent in an amount of from 1.0 to 200% by weight based on the amount of the ferromagnetic powder.

6. The process of claim 1, wherein said magnetic layer has thickness of from 0.1 to 10 μm.

7. The process of claim 1, wherein said ferromagnetic fine powder is present in said silver halide color photosensitive material in an amount of from 0.005 to 3 g/m$^2$.

8. The process of claim 1, further comprising the step of contacting the final bath of the water washing and/or stabilizing step with an ion-exchange resin.

9. The process of claim 1, wherein said photosensitive material comprises a magenta coupler represented by the following formula (II) or (III):

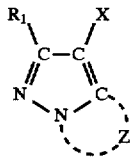

(II)

wherein $R_1$ is a hydrogen atom or a substituent, Z is a non-metal atomic group that forms a 5-membered azole ring containing 2 to 4 nitrogen atoms, X is a hydrogen atom or a group which is released during a coupling reaction with an oxidized substance of a developing agent;

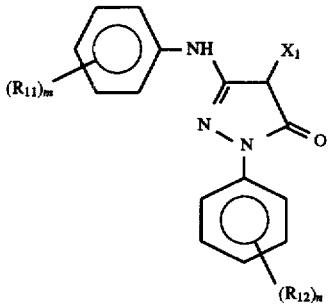

(III)

wherein $R_{11}$ represents a substituent, $R_{12}$ represents an electron attractive group, m represents an integer of from 1 to 5, when m represents 2 or more, $R_{11}$ may be the same or different, n represents an integer of from 2 to 5, $R_{12}$ may be the same or different, $X_1$ represents a group which is released during a coupling reaction with an oxidized substance of a developing agent.

10. The process of claim 1, wherein said transparent substrate is a polyethylene aromatic dicarboxylate type polyester substrate.

* * * * *

UNITED STATES PATENT AND TRADEMARK OFFICE

CERTIFICATE OF CORRECTION

PATENT NO. : 5,753,424

DATED : May 19, 1998

INVENTOR(S) : Ishikawa

It is certified that error appears in the above-identified patent and that said Letters Patent is hereby corrected as shown below:

Column 97, line 49, after "metal (second occurrence) insert --,--.

Signed and Sealed this

Sixteenth Day of February, 1999

*Attest:*

*Acting Commissioner of Patents and Trademarks*

*Attesting Officer*